US008556393B2

(12) United States Patent
Mallory et al.

(10) Patent No.: US 8,556,393 B2
(45) **Date of Patent: *Oct. 15, 2013**

(54) SIMPLE PRINTHEAD COUPLING FOR FLUID DISTRIBUTION

(75) Inventors: Bob Mallory, San Diego, CA (US); Robert Rosati, San Diego, CA (US); Mike Eckard, San Diego, CA (US); Geoffrey Philip Dyer, Balmain (AU)

(73) Assignee: Zamtec Ltd, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 13/108,849

(22) Filed: May 16, 2011

(65) Prior Publication Data

US 2011/0279584 A1 Nov. 17, 2011

Related U.S. Application Data

(60) Provisional application No. 61/345,552, filed on May 17, 2010.

(51) Int. Cl.
*B41J 2/175* (2006.01)

(52) U.S. Cl.
USPC ..... 347/85

(58) Field of Classification Search
None
See application file for complete search history.

(56) References Cited

U.S. PATENT DOCUMENTS

| | | | | |
|---|---|---|---|---|
| 3,096,665 | A | 7/1963 | Cappelle et al. | |
| 3,586,049 | A | 6/1971 | Adamson | |
| 4,249,187 | A | 2/1981 | Erikson et al. | |
| 4,567,954 | A | 2/1986 | Voight et al. | |
| 4,568,954 | A * | 2/1986 | Rosback | 347/86 |
| 4,899,178 | A * | 2/1990 | Tellier | 347/65 |
| 5,153,613 | A | 10/1992 | Yamaguchi et al. | |
| 5,631,681 | A | 5/1997 | Klaus et al. | |
| 5,819,798 | A | 10/1998 | Claflin et al. | |
| 6,065,828 | A * | 5/2000 | Lo et al. | 347/85 |
| 6,170,937 | B1 * | 1/2001 | Childers et al. | 347/85 |
| 6,196,266 | B1 | 3/2001 | Breda | |
| 6,796,644 | B1 * | 9/2004 | Anderson et al. | 347/85 |
| 6,883,896 | B2 | 4/2005 | Umeda | |
| 6,991,325 | B2 * | 1/2006 | Oda et al. | 347/85 |
| 7,121,652 | B2 | 10/2006 | Harada et al. | |
| 7,163,282 | B2 * | 1/2007 | Kumagai et al. | 347/85 |
| 7,303,271 | B2 | 12/2007 | Shimizu et al. | |
| 7,410,248 | B2 | 8/2008 | Umeda et al. | |
| 7,472,986 | B2 | 1/2009 | Hori | |

(Continued)

FOREIGN PATENT DOCUMENTS

| | | | |
|---|---|---|---|
| JP | 2002113880 | | 4/2002 |
| JP | 2002113880 | A * | 4/2002 |

*Primary Examiner* — Matthew Luu
*Assistant Examiner* — Patrick King
(74) *Attorney, Agent, or Firm* — Cooley LLP

(57) ABSTRACT

A coupling assembly for distributing fluid to a printhead, the coupling assembly having a housing, a seal member received in a recess of the housing, a port plate movably mounted on the housing by a washer which is press-on mounted to a shaft through the port plate and housing, and a tube retainer mounted within a groove of the housing for retaining fluid distribution tubes, the retainer having a plurality of holes aligned with respective ones of a plurality of ports in the port plate and a plurality of seals of the seal member for fluidically connecting the retained fluid distribution tubes with respective fluid spouts of the printhead, wherein mounting of each of the seal member, port plate and retainer to the housing is achieved in a non-fastened manner.

4 Claims, 73 Drawing Sheets

(56) References Cited

U.S. PATENT DOCUMENTS

| | | | | |
|---|---|---|---|---|
| 7,722,174 | B2 * | 5/2010 | Kimura et al. | 347/86 |
| 7,914,124 | B2 * | 3/2011 | Seshimo et al. | 347/66 |
| 7,950,764 | B2 | 5/2011 | Kobayashi | |
| 7,997,670 | B2 | 8/2011 | Taira et al. | |
| 8,083,333 | B2 * | 12/2011 | Freitag et al. | 347/85 |
| 2001/0019344 | A1 | 9/2001 | Harada et al. | |
| 2002/0024571 | A1 * | 2/2002 | Childers et al. | 347/85 |
| 2003/0001934 | A1 | 1/2003 | Kitabatake et al. | |
| 2005/0052513 | A1 | 3/2005 | Inoue | |
| 2005/0174402 | A1 * | 8/2005 | Yamada et al. | 347/86 |
| 2005/0248634 | A1 | 11/2005 | Aruga | |
| 2006/0139419 | A1 | 6/2006 | Shigemura | |
| 2006/0268081 | A1 | 11/2006 | Sugata | |
| 2007/0081056 | A1 | 4/2007 | Ito | |
| 2007/0222834 | A1 * | 9/2007 | Seshimo et al. | 347/85 |
| 2007/0296777 | A1 * | 12/2007 | Hanaoka | 347/86 |
| 2008/0211890 | A1 * | 9/2008 | Kimura et al. | 347/86 |
| 2008/0218568 | A1 * | 9/2008 | Kimura et al. | 347/86 |
| 2008/0231671 | A1 | 9/2008 | Lee et al. | |
| 2009/0141093 | A1 * | 6/2009 | Lee et al. | 347/85 |
| 2009/0219368 | A1 | 9/2009 | Esdaile-Watts et al. | |
| 2010/0134570 | A1 * | 6/2010 | Yuen | 347/85 |
| 2010/0201762 | A1 * | 8/2010 | Seino et al. | 347/86 |
| 2010/0289856 | A1 | 11/2010 | Yamamoto et al. | |
| 2011/0050815 | A1 | 3/2011 | Kakigahara | |
| 2011/0181670 | A1 | 7/2011 | Tsubaki | |
| 2011/0277303 | A1 | 11/2011 | Mallory et al. | |
| 2011/0279586 | A1 | 11/2011 | Mallory et al. | |

* cited by examiner

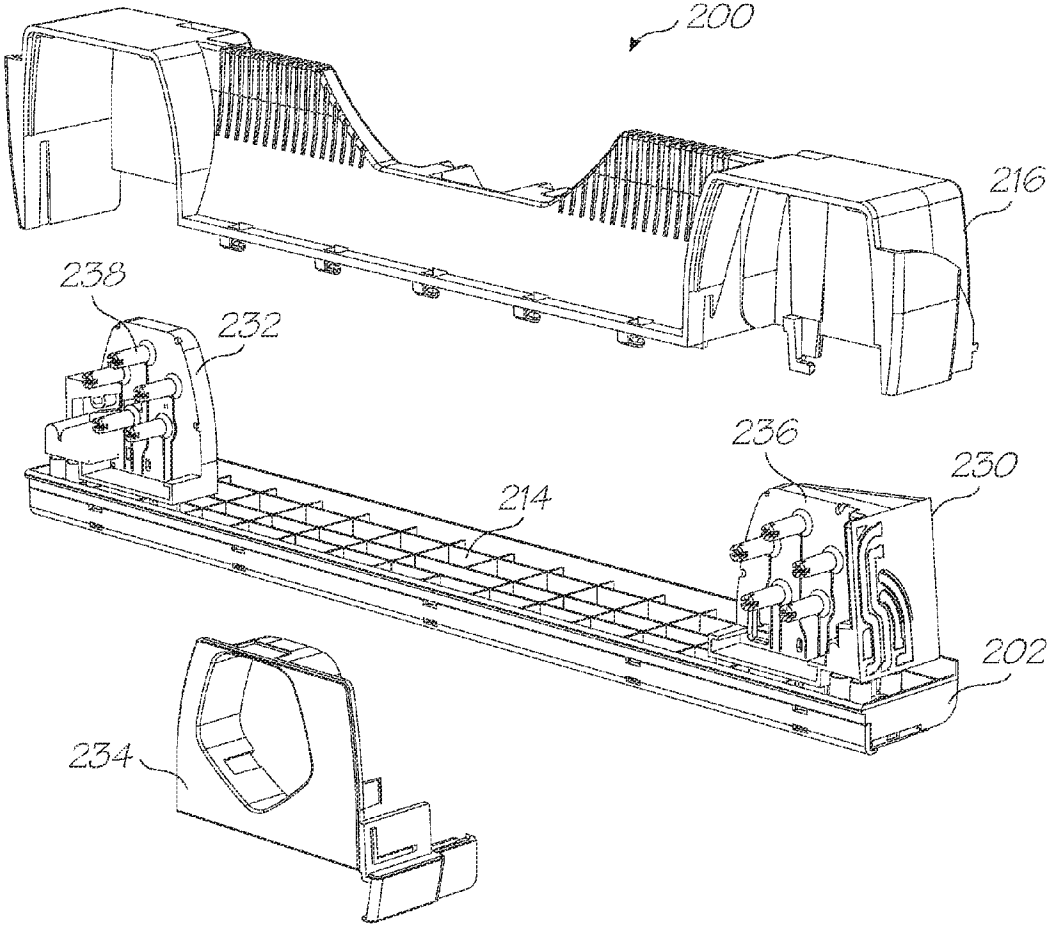
FIG. 4
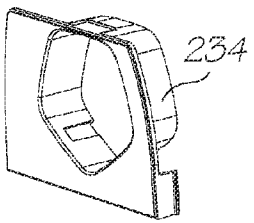

SIMPLE PRINTHEAD COUPLING FOR FLUID DISTRIBUTION

FIELD OF INVENTION

The invention relates to fluid systems, apparatus, and methods for distributing fluid within a printing environment and to the configuration and arrangement of the components of such systems and apparatus. In particular, the fluid is a printing fluid, such as ink or ink fixing agent, as is distributed to and from a fluid ejection printhead, such as an inkjet printhead. More particularly, fluid distribution to an inkjet media width printhead is provided.

CO-PENDING APPLICATIONS

The following applications have been filed by the Applicant simultaneously with the present application:

| | | | | |
|---|---|---|---|---|
| KPF001US | KPF002US | KPF003US | KPF004US | KPF005US |
| KPF006US | KPF007US | KPF008US | KPF009US | KPF010US |
| KPF011US | KPF012US | KPF013US | KPF014US | KPF015US |
| KPF016US | KPF017US | KPF018US | KPF019US | KPF020US |
| KPF021US | KPF022US | KPF023US | KPF024US | KPF025US |
| KPF026US | KPF027US | KPF028US | KPF029US | KPF030US |
| KPF031US | KPF032US | KPF033US | KPF034US | KPF035US |
| KPF036US | KPF037US | KPF038US | KPF039US | KPF040US |
| KPF041US | KPF042US | KPF043US | KPF044US | KPF045US |
| KPF046US | KPF048US | KPF049US | KPF050US | KPM001US |
| KPM002US | KPM003US | KPM004US | KPM005US | KPM006US |
| KPM007US | KPM008US | KPM009US | KPM010US | KPM011US |
| KPM012US | KPM013US | KPM014US | KPM015US | KPM016US |
| KPM017US | KPM018US | KPM019US | KPM020US | LNP001US |
| LNP002US | LNP003US | LNP004US | LNP005US | LNP006US |
| LNP007US | LNP008US | LNP009US | LNP010US | LNP011US |
| LNP012US | LNP013US | LNP014US | LNP015US | LNP016US |
| LNP017US | LNP018US | LNP019US | | |

The disclosures of these co-pending applications are incorporated herein by reference. The above applications have been identified by their filing docket number, which will be substituted with the corresponding application number, once assigned.

CROSS REFERENCES

The following patents or patent applications filed by the applicant or assignee of the present invention are hereby incorporated by cross-reference.

| | | | | |
|---|---|---|---|---|
| 6,276,850 | 6,443,555 | 7,215,441 | 6,906,778 | 6,688,528 |
| 6,641,315 | 7,155,395 | 7,118,481 | 6,750,901 | 6,496,654 |
| 7,021,745 | 6,712,453 | 6,428,147 | 6,416,170 | 6,402,300 |
| 6,464,340 | 6,612,687 | 6,412,912 | 6,447,099 | 6,505,913 |
| 7,249,108 | 6,566,858 | 6,442,525 | 09/517,384 | 09/505,951 |
| 6,374,354 | 7,246,098 | 6,816,968 | 6,757,832 | 6,334,190 |
| 6,745,331 | 7,249,109 | 10/940,653 | 10/942,858 | 7,286,169 |
| 6,985,207 | 6,878,299 | 10/780,625 | 10/831,234 | 10/831,233 |
| 7,246,897 | 7,077,515 | 10/831,235 | 10/853,336 | 6,913,875 |
| 11/012,024 | 11/011,925 | 6,710,457 | 6,530,339 | 6,238,044 |
| 11/003,786 | 11/003,463 | 11/003,701 | 11/003,683 | 11/003,614 |
| 7,284,820 | 11/293,800 | 11/482,975 | 11/482,970 | 11/482,968 |
| 11/482,972 | 11/482,971 | 11/482,969 | 6,431,777 | 6,471,331 |
| 11/097,266 | 11/685,084 | 11/740,925 | 11/763,444 | 7,206,654 |
| 6,786,420 | 6,948,661 | 7,073,713 | 11/518,238 | 7,032,899 |
| 11/084,237 | 6,350,023 | 11/246,676 | 11/246,707 | 11/482,958 |
| 11/482,955 | 11/482,962 | 11/482,963 | 11/482,956 | 11/482,954 |
| 11/482,974 | 11/482,957 | 11/482,987 | 11/482,959 | 11/482,960 |
| 11/482,961 | 11/482,964 | 11/482,965 | 11/482,976 | 11/482,973 |

-continued

| | | | | |
|---|---|---|---|---|
| 11/495,815 | 10/803,074 | 10/922,970 | 10/922,836 | 10/922,842 |
| 10/922,848 | 10/922,843 | 7,125,185 | 7,229,226 | 10/815,621 |
| 7,243,835 | 10/815,630 | 10/815,638 | 10/815,635 | 10/815,647 |
| 10/815,636 | 11/041,650 | 11/041,556 | 10/815,609 | 6,227,652 |
| 6,588,882 | 6,742,873 | 6,918,655 | 6,547,371 | 6,938,989 |
| 6,598,964 | 6,923,526 | 6,273,544 | 6,425,654 | 6,623,101 |
| 6,406,129 | 6,505,916 | 6,457,809 | 6,550,895 | 6,457,812 |
| 7,152,962 | 6,428,133 | 11/607,976 | 11/685,074 | 11/696,650 |
| 11/763,446 | 6,224,780 | 6,665,094 | 7,072,076 | 6,851,782 |
| 10/636,211 | 11/305,274 | 6,231,148 | 7,006,143 | 6,412,993 |
| 7,204,941 | 7,278,727 | 7,148,345 | 11/172,816 | 11/831,961 |
| 10/407,212 | 11/482,980 | 11/482,967 | 11/124,158 | 11/124,197 |
| 11/124,163 | 7,236,271 | 11/124,201 | 11/124,188 | 11/124,170 |
| 11/124,187 | 11/124,189 | 11/124,190 | 11/124,180 | 11/124,178 |
| 11/124,148 | 11/124,168 | 11/124,167 | 11/124,179 | 11/187,976 |
| 11/188,011 | 11/188,014 | 11/482,979 | 11/228,540 | 11/228,502 |
| 11/228,484 | 11/228,489 | 11/228,518 | 11/228,488 | 11/228,523 |
| 11/228,520 | 11/228,498 | 11/228,479 | 6,238,115 | 6,087,638 |
| 10/868,866 | 11/242,916 | 11/198,235 | 11/861,282 | 7,152,972 |
| D529952 | 6,390,605 | 6,322,195 | 6,426,014 | 6,364,453 |
| 6,315,399 | 6,595,624 | 6,417,757 | 7,095,309 | 6,817,700 |
| 6,425,971 | 6,383,833 | 6,746,105 | 6,412,904 | 6,398,343 |
| 6,652,074 | 6,682,174 | 6,648,453 | 6,682,176 | 6,755,509 |
| 7,222,943 | 7,188,419 | 7,168,166 | 7,086,719 | 11/763,440 |
| 11/246,687 | 11/829,957 | 11/829,962 | 11/829,966 | 11/829,967 |
| 7,156,508 | 11/246,684 | 7,246,886 | 7,128,400 | 7,108,355 |
| 6,991,322 | 7,287,836 | 7,118,197 | 10/728,784 | 10/728,783 |
| 7,077,493 | 6,962,402 | 10/728,803 | 7,147,308 | 7,118,198 |
| 7,168,790 | 7,172,270 | 7,229,155 | 6,830,318 | 7,195,342 |
| 7,175,261 | 10/773,183 | 7,108,356 | 7,118,202 | 10/773,186 |
| 7,134,744 | 7,134,743 | 7,182,439 | 7,210,768 | 10/773,187 |
| 7,134,745 | 7,156,484 | 7,118,201 | 7,111,926 | 10/773,184 |
| 11/060,751 | 11/060,805 | 11/744,885 | 11/097,308 | 11/210,687 |
| 11/097,212 | 7,147,306 | 11/482,953 | 11/482,977 | 11/544,778 |
| 11/764,808 | 7,156,289 | 7,178,718 | 7,225,979 | 11/084,796 |
| 09/575,197 | 09/722,174 | 7,175,079 | 7,162,259 | 11/520,170 |
| 11/830,848 | 11/830,849 | 7,068,382 | 10/743,671 | 7,094,910 |
| 7,091,344 | 7,122,685 | 7,038,066 | 7,099,019 | 7,062,651 |
| 6,644,642 | 7,064,851 | 6,965,439 | 7,093,991 | 7,190,491 |
| 10/932,044 | 10/965,733 | 10/965,933 | 10/982,974 | 7,180,609 |
| 11/653,219 | 6,982,798 | 6,870,966 | 6,792,165 | 7,015,901 |
| 7,289,882 | 10/919,379 | 11/193,481 | 11/255,941 | 11/495,814 |
| 11/495,822 | 7,055,739 | 7,182,247 | 7,082,562 | 6,766,944 |
| 10/409,864 | 7,108,192 | 7,111,791 | 10/683,151 | 6,957,768 |
| 6,786,397 | 11/856,061 | 11/672,522 | 11/672,950 | 11/672,947 |
| 11/672,891 | 11/672,954 | 11/754,310 | 11/754,321 | 11/754,320 |
| 11/754,319 | 11/754,318 | 11/754,317 | 11/754,316 | 11/754,315 |
| 11/754,314 | 11/754,313 | 11/754,312 | 11/754,311 | 7,132,679 |
| 6,755,513 | 6,904,678 | 7,097,273 | 6,824,245 | 7,222,947 |
| 6,860,581 | 6,929,351 | 7,063,404 | 11/066,161 | 11/066,160 |
| 6,804,030 | 10/727,181 | 10/754,536 | 10/754,938 | 10/934,720 |
| 6,795,215 | 11/482,981 | 7,195,328 | 10/854,521 | 10/934,628 |
| 11/601,757 | 11/014,731 | D529081 | D528597 | 6,924,907 |
| 10/636,234 | 10/636,233 | 7,301,567 | 10/636,216 | 7,274,485 |
| 7,139,084 | 7,173,735 | 7,068,394 | 7,286,182 | 7,086,644 |
| 7,250,977 | 7,146,281 | 7,023,567 | 7,136,183 | 7,083,254 |
| 6,796,651 | 7,061,643 | 7,057,758 | 6,894,810 | 6,995,871 |
| 7,085,010 | 7,092,126 | 7,123,382 | 7,061,650 | 10/853,143 |
| 11/225,158 | 11/544,764 | 11/293,804 | 11/293,794 | 11/293,828 |
| 11/482,978 | 11/640,356 | 11/679,786 | 10/760,254 | 11/014,764 |
| 11/014,763 | 11/014,748 | 11/014,747 | 11/014,761 | 11/014,760 |
| 11/014,757 | 11/014,714 | 7,249,822 | 11/014,762 | 11/014,724 |
| 11/014,723 | 11/014,756 | 11/014,736 | 11/014,759 | 11/014,758 |
| 11/014,725 | 11/014,739 | 11/014,738 | 11/014,737 | 11/014,726 |
| 11/014,745 | 11/014,712 | 7,270,405 | 11/014,751 | 11/014,735 |
| 11/014,734 | 11/014,719 | 11/014,750 | 11/014,749 | 7,249,833 |
| 11/014,769 | 11/014,729 | 11/014,743 | 11/014,733 | 11/014,754 |
| 11/014,755 | 11/014,765 | 11/014,766 | 11/014,740 | 7,284,816 |
| 7,284,845 | 7,255,430 | 11/014,744 | 11/014,741 | 11/014,768 |
| 11/014,767 | 11/014,718 | 11/014,717 | 11/014,716 | 11/014,732 |
| 11/014,742 | 11/097,268 | 11/097,185 | 11/097,184 | 11/293,820 |
| 11/688,863 | 11/688,864 | 11/688,865 | 11/688,866 | 11/741,766 |
| 11/482,982 | 11/495,819 | 11/677,049 | 11/014,722 | D528156 |
| 10/760,180 | 6,364,451 | 7,093,494 | 6,454,482 | 11/014,728 |
| 11/014,727 | D536031 | 7,237,888 | 10/760,214 | 10/962,413 |
| 10/962,427 | 7,261,477 | 7,225,739 | 10/962,402 | 10/962,425 |
| 10/962,428 | 7,191,978 | 10/962,426 | 10/962,409 | 10/962,417 |
| 10/962,403 | 7,163,287 | 7,258,415 | 10/962,523 | 7,258,424 |
| 10/962,410 | 11/223,262 | 10/853,270 | 6,485,123 | 6,378,990 |
| 6,425,658 | 6,488,361 | 6,814,429 | 6,471,336 | 6,457,813 |

-continued

| | | | | |
|---|---|---|---|---|
| 6,540,331 | 6,454,396 | 6,464,325 | 6,443,559 | 6,435,664 |
| 6,412,914 | 6,488,360 | 6,550,896 | 6,439,695 | 6,447,100 |
| 09/900,160 | 6,488,359 | 7,044,589 | 6,416,154 | 6,547,364 |
| 6,644,771 | 6,565,181 | 6,857,719 | 6,702,417 | 6,918,654 |
| 6,652,078 | 6,623,108 | 6,625,874 | 6,921,153 | 6,536,874 |
| 6,425,651 | 6,435,667 | 6,527,374 | 6,582,059 | 6,513,908 |
| 6,540,332 | 6,547,368 | 6,679,584 | 6,857,724 | 6,652,052 |
| 6,672,706 | 6,588,886 | 7,207,654 | 6,935,724 | 6,927,786 |
| 6,916,082 | 6,978,990 | 7,285,170 | 7,066,580 | 6,984,023 |
| 7,059,706 | 7,185,971 | 7,090,335 | 6,739,701 | 7,008,503 |
| 10/636,274 | 6,792,754 | 6,860,107 | 6,786,043 | 6,866,369 |
| 6,886,918 | 6,827,427 | 6,918,542 | 7,007,852 | 6,988,840 |
| 6,984,080 | 6,863,365 | 7,524,016 | 12/014,772 | 11/246,687 |
| 12/062,514 | 12/062,517 | 12/062,518 | 7,819,515 | 7,891,794 |
| 12/062,522 | 7,891,788 | 12/062,524 | 7,878,635 | 12/062,526 |
| 7,874,662 | 12/062,528 | 7,878,639 | 7,891,795 | 7,878,640 |
| 12/192,116 | 7,883,189 | 12/192,118 | 12/192,119 | 7,887,148 |
| 7,887,170 | | | | |

BACKGROUND OF INVENTION

Most inkjet printers have a scanning printhead that reciprocates across the printing width as the media incrementally advances along the media feed path. This allows a compact and low cost printer arrangement. However, scanning printhead based printing systems are mechanically complex and slow in light of accurate control of the scanning motion and time delays from the incremental stopping and starting of the media with each scan. Media width printheads resolve this issue by providing a stationary printhead spanning the media.

Larger printheads help to increase print speeds regardless of whether the printhead is a conventional scanning type or a media width printhead. However, larger printheads require a higher ink supply flow rate and the pressure drop in the ink from the ink inlet on the printhead to nozzles remote from the inlet can change the drop ejection characteristics. Large supply flow rates necessitate large ink tanks which exhibit a large pressure drop when the ink level in low compared to the hydrostatic pressure generated when the ink tank is full. Individual pressure regulators integrated into each printhead is unwieldy and expensive for multi-color printheads, particularly those carrying four or more inks. For example, a system with five inks would require 25 regulators.

Inkjet printers that can prime, deprime and purge air bubbles from the printhead offer the user distinct advantages. Removing a depleted printhead can cause inadvertent spillage of residual ink if it has not been de-primed before decoupling from the printer.

Air bubbles trapped in printheads are a perennial problem and a common cause of print artifacts. Actively and rapidly removing air bubbles from the printhead allows the user to rectify print problems without replacing the printhead. Active priming, de-priming and air purging typically use a lot of ink, particularly if the ink is drawn through the nozzles by vacuum or the like. This is exacerbated by large arrays of nozzles as more ink is lost as the number of nozzles increases.

Thus, there is a need to have a fluid distribution solution that is simpler, more reliable and more effective for media wide printing systems.

SUMMARY OF INVENTION

In one aspect, the invention provides a fluid distribution system for a printhead, the system comprising:

a first fluid container;

a fluid connector for connection to a fluid input of the printhead; and a second fluid container connected between the first container and the connector for delivering fluid from the first container to the connector, wherein the second container is located relative to the first container and the connector so that a fluid pressure difference between fluid contained within the second container and fluid at the connector is independent of the amount of fluid contained within the first container.

Optionally, a fluid pressure at fluid ejection nozzles of the printhead is a negative fluid pressure.

Optionally, during fluid ejection at the nozzles of the printhead fluid is drawn from the second container to the printhead via the fluid connector.

Optionally, as fluid is drawn from the second container the second container draws fluid from the first container so as to maintain a predetermined fluid level in the second container.

Optionally, the second container comprises a valve connected between an inlet of the second container and a fluid path interconnecting the first and second containers, the valve being operated to allow fluid flow from the first to the second container when a fluid level in the second container is less than the predetermined fluid level.

Optionally, the first container is at a position higher than the second container and the printhead.

Optionally, the second container is positioned lower than the printhead.

In another aspect, the invention provides a method of controlling fluid pressure at a printhead with a fluid distribution arrangement, the method comprising:

providing the fluid distribution arrangement with a first fluid container, a fluid connector for connection to a fluid input of the printhead, and a second fluid container connected between the first container and the connector for delivering fluid from the first container to the connector; and locating the second container relative to the first container and the connector so that a fluid pressure difference between fluid contained within the second container and fluid at the connector is independent of the amount of fluid contained within the first container.

Optionally, a fluid pressure at fluid ejection nozzles of the printhead is a negative fluid pressure.

Optionally, during fluid ejection at the nozzles of the printhead fluid is drawn from the second container to the printhead via the fluid connector.

Optionally, as fluid is drawn from the second container the second container draws fluid from the first container so as to maintain a predetermined fluid level in the second container.

Optionally, the second container comprises a valve connected between an inlet of the second container and a fluid path interconnecting the first and second containers, the method comprising operating the valve to allow fluid flow from the first to the second container when a fluid level in the second container is less than the predetermined fluid level.

Optionally, the first container is at a position higher than the second container and the printhead.

Optionally, the second container is located so as to be lower than the printhead.

In another aspect, the invention provides a printing system comprising:

a first fluid container;

a printhead; and a second fluid container connected between the first container and the printhead for delivering fluid from the first container to the printhead, wherein the second container is located relative to the first container and the printhead so that a fluid pressure difference between fluid contained within the second container and fluid at the printhead is independent of the amount of fluid contained within the first container.

Optionally, a fluid pressure at fluid ejection nozzles of the printhead is a negative fluid pressure.

Optionally, during fluid ejection at the nozzles of the printhead fluid is drawn from the second container to the printhead.

Optionally, as fluid is drawn from the second container the second container draws fluid from the first container so as to maintain a predetermined fluid level in the second container.

Optionally, the second container comprises a valve connected between an inlet of the second container and a fluid path interconnecting the first and second containers, the valve being operated to allow fluid flow from the first to the second container when a fluid level in the second container is less than the predetermined fluid level.

Optionally, the first container is at a position higher than the second container and the printhead.

Optionally, the second container is positioned lower than the printhead.

In another aspect, the invention provides a method of distributing fluid pressure in a printing system, the method comprising:

providing the printing system with a first fluid container, a printhead having fluid ejection nozzles, and a second fluid container connected between the first container and the printhead for delivering fluid from the first container to the printhead; and locating the first container above the printhead and the second container and locating the second container below the printhead such that negative fluid pressure is provided at the nozzles of the printhead and positive fluid pressure is provided at the second container.

Optionally, during fluid ejection at the nozzles of the printhead, fluid is drawn from the second container to the printhead.

Optionally, as fluid is drawn from the second container, the second container draws fluid from the first container so as to maintain a predetermined fluid level in the second container.

Optionally, the second container comprises a valve connected between an inlet of the second container and a fluid path interconnecting the first and second containers, the method comprising operating the valve operated to allow fluid flow from the first to the second container when a fluid level in the second container is less that the predetermined fluid level.

Optionally, the printhead is a media width printhead.

In another aspect, the invention provides a fluid distribution system comprising:

a first fluid container having a fluid outlet;

a second fluid container having a fluid inlet;

a fluid line interconnecting the outlet of the first container and the inlet of the second container;

an inverted umbrella valve between the fluid line and the inlet, said valve arranged to allow fluid flow from the first container to the second container via the fluid line; and a restrictor for restricting said allowed fluid flow through the fluid line.

Optionally, the inlet is defined on a body of the second container, the umbrella valve comprises an umbrella-shaped disc mounted within the inlet so that the umbrella-shape is inverted and a connector connected to the fluid line and enclosing the disc relative to the body.

Optionally, the connector is sealingly mounted on the body.

Optionally, the second container comprises a valve actuator within the inlet, the disc being mounted on the valve actuator.

Optionally, the valve actuator causes the disc to move between positions where a periphery of the disc seals against the body and the disc is spaced from the body.

Optionally, the restrictor is mounted on the fluid line in proximity of the umbrella valve.

Optionally, the restrictor comprises a resilient member mounted on an exterior of the fluid line, the resilient member being configured to compress the fluid line.

Optionally, the connector incorporates the restrictor as an obstruction to fluid flow into the connector from the fluid line.

In another aspect, the invention provides an ink container for an inkjet printhead, the ink container comprising:

a body for containing ink to a predetermined capacity;

an ink inlet on the body;

a float member within the body for floating on ink contained in the body;

a valve at the inlet; and a valve actuator for selectively opening and closing the valve, wherein the float member is pivotally attached to the valve actuator so that the float member causes the valve actuator to close the valve when the body contains ink at said predetermined capacity and to open the valve otherwise.

Optionally, the valve comprises an umbrella-shaped disc mounted within the inlet so that the umbrella-shape is inverted and a connector connected to a fluid line and enclosing the disc relative to the body.

Optionally, the connector is sealingly mounted on the body.

Optionally, the disc is mounted on the valve actuator.

Optionally, the valve actuator causes the disc to move between positions where the disc is spaced from the body and a periphery of the disc seals against the body in order to open and close the valve.

Optionally, the float member is attached to the valve actuator with a pin about which the float member pivots.

Optionally, the container further comprises an air vent in the body, the float member being located between the air vent and the contained ink.

Optionally, the air vent comprises a filter.

Optionally, the filter comprises hydrophobic material.

Optionally, the hydrophobic material is expanded polytetrafluoroethylene.

Optionally, the air vent comprises a tortuous liquid path from the interior of the body to the exterior of the body.

Optionally, the tortuous liquid path is a serpentine path.

In another aspect, the invention provides a system for distributing fluid to a printhead, the system comprising:

a printhead;

a first fluid container; and a second fluid container for distributing fluid from the first container to the printhead, the second container having a body for containing the fluid to a predetermined capacity, an inlet connected to the first container, a valve at the inlet, and an outlet connected to the printhead, wherein the valve is operated so that the valve is closed when the body contains fluid at said predetermined capacity and is open when fluid is distributed to the printhead via the outlet.

Optionally, the second container further has a float member within the body for floating on the fluid contained in the body which is pivotally attached to the valve so that the float member causes the valve to close when the body contains fluid at said predetermined capacity and to open otherwise.

Optionally, the valve comprises:

an umbrella-shaped disc mounted within the inlet so that the umbrella-shape is inverted; and a connector which is connected to a fluid line connected to the first container and encloses the disc relative to the body.

Optionally, the connector is sealingly mounted on the body.

Optionally, the second container further has a valve actuator for selectively opening and closing valve via which the valve is pivotally attached to the float member, and the disc is mounted on the valve actuator.

Optionally, the valve actuator causes the disc to move between positions where the disc is spaced from the body and a periphery of the disc seals against the body in order to open and close the valve.

Optionally, the float member is attached to the valve actuator with a pin about which the float member pivots.

Optionally, the container further comprises an air vent in the body, the float being located between the air vent and the contained ink.

In another aspect, the invention provides an ink distribution system for a printhead, the system comprising:

a first ink container having an ink outlet;

a second ink container having an ink inlet;

an ink line interconnecting the outlet of the first container and the inlet of the second container; and a gas vent on the ink line.

Optionally, the ink inlet of the second container has a valve, ink from the first container being drawn into the second container when the valve is open.

Optionally, the gas vent is disposed on the ink line so that a first portion of the ink line is between the first container and the gas vent, and a second portion of the ink line is between the gas vent and the second container.

Optionally, the gas vent comprises a filter disposed at one end of a vent line, the opposed end of the vent line joining the ink line.

Optionally, the filter comprises expanded polytetrafluoroethylene.

In another aspect, the invention provides a fluid container comprising:

a body for containing fluid;

a fluid outlet on a first wall of the body at which said contained fluid exits the body; and a filter arranged within the body adjoining the first wall so that said contained fluid passes through the filter before exiting the outlet, wherein the filter is inclined relative to the first wall so that filtered fluid is contained in the body between the filter and the outlet.

Optionally, a second wall of the body beneath the filter adjoins the first wall and is substantially parallel to the filter.

Optionally, the outlet is higher than a lowest point of the second wall.

Optionally, the filter comprises a polyester mesh.

Optionally, the polyester mesh has a pore size of one micron.

Optionally, an angle between the filter and the first wall is about 10 degrees.

In another aspect, the invention provides a system for distributing filtered ink to an inkjet printhead, the system comprising:

an ink container having a body for containing the ink, am ink outlet on a first wall of the body at which said contained ink exits the body, and a filter arranged within the body adjoining the first wall so that said contained ink passes through the filter before exiting the outlet;

an inkjet printhead having an ink inlet; and an ink line connecting the outlet of the container to the inlet of the printhead, wherein the filter is inclined relative to the first wall so that filtered ink is contained in the body between the filter and the outlet which is distributed to the printhead.

Optionally, a second wall of the body of the container beneath the filter adjoins the first wall and is substantially parallel to the filter.

Optionally, the outlet of the container is higher than a lowest point of the second wall.

Optionally, the filter of the container comprises a polyester mesh.

Optionally, the polyester mesh has a pore size of one micron.

Optionally, an angle between the filter and the first wall is about 10 degrees.

In another aspect, the invention provides a fluid container comprising:

a body for containing fluid;

a fluid outlet on a first wall of the body at which said contained fluid exits the body; and a filter arranged within the body substantially parallel to, and spaced from, a second wall of the body, wherein the second wall adjoins the first wall with the outlet in the space between the filter and the second wall so that said contained fluid passes through the filter before exiting the outlet, and the second wall declines from the adjoined first wall when the container is disposed with the filter above the second wall.

Optionally, the container further comprises a fluid inlet on a third wall of the body at which fluid enters the body to be contained therein, the inlet being disposed higher than the filter when the container is disposed with the filter above the second wall.

Optionally, the second and third walls are interconnected by a fourth wall of the body, the second, third and fourth walls defining a floor of the body when the container is disposed with the filter above the second wall.

Optionally, the second wall inclines from the adjoined fourth wall to the adjoined first wall when the container is disposed with the filter above the second wall.

Optionally, the inlet is disposed in the third wall so that the entering fluid is caused to flow along the third wall, then pass through the filter, and then flow along the second wall up the incline from the third wall to the first wall when the container is disposed with the filter above the second wall.

In another aspect, the invention provides a printing system comprising:

a fluid source;

a first fluid path connecting the fluid source to a first fluid port of the printhead;

a second fluid path connecting the fluid source to a second fluid port of the printhead, wherein the first and second paths are configured so that fluid from the fluid source flows between the first and second paths via the printhead.

Optionally, the system further comprises a valve connecting the first path to the printhead.

Optionally, the fluid source has a first source port connected to the first path and a second source port connected to the second path.

Optionally, the first and second paths, printhead and fluid source form a closed fluid flow loop in which fluid flows to and from the fluid source in either direction of the loop.

Optionally, the system further comprises a bi-directional pump on the first or second paths for driving said fluid flows to and from the fluid source in either direction of the loop.

In another aspect, the invention provides a fluid distribution system for a printhead, the system comprising:

a first fluid path connected to a first fluid port of the printhead;

a second fluid path connected to a second fluid port of the printhead;

a third fluid path interconnecting the first and second paths, wherein the first, second and third paths are configured so that fluid flows between the first and second paths via the printhead and via the third fluid path.

Optionally, the system further comprises a multi-path valve connecting the first path to the printhead and the third path.

Optionally, the multi-path valve is operable to selectively provide fluid flow through the printhead and the third path.

Optionally, the system further comprises a fluid source having a first source port connected to the first path and a second source port connected to the second path.

Optionally, the first, second and third paths, printhead and fluid source form a closed fluid flow loop in which fluid flows to and from the fluid source in either direction of the loop.

In another aspect, the invention provides a printing system comprising:

a media width printhead having a first fluid port at one longitudinal end of the media width and a second fluid port at the other longitudinal end of the media width;

a first fluid path connected to the first fluid port of the printhead;

a second fluid path connected to the second fluid port of the printhead;

a third fluid path interconnecting the first and second paths, wherein the first, second and third paths are configured so that fluid flows between the first and second paths via the printhead and via the third fluid path.

Optionally, the system further comprises a multi-path valve connecting the first path to the printhead and the third path.

Optionally, the multi-path valve is operable to selectively provide fluid flow through the printhead and the third path.

Optionally, the system further comprises a fluid source having a first source port connected to the first path and a second source port connected to the second path.

Optionally, the first, second and third paths, printhead and fluid source form a closed fluid flow loop in which fluid flows to and from the fluid source in either direction of the loop.

In another aspect, the invention provides a fluid distribution system for a printhead, the system comprising:

a fluid container;

a first fluid path interconnecting the container and a first fluid port of the printhead;

a second fluid path interconnecting the container and a second fluid port of the printhead;

a third fluid path interconnecting the first and second paths, wherein the first, second and third paths are configured so that fluid from the container flows between the first and second paths via the printhead and via the third fluid path.

Optionally, the system further comprises a multi-path valve connecting the first path to the printhead and the third path.

Optionally, the multi-path valve is operable to selectively provide fluid flow through the printhead and the third path.

In another aspect, the invention provides a printing system comprising:

a fluid container;

a media width printhead having a first fluid port at one longitudinal end of the media width and a second fluid port at the other longitudinal end of the media width;

a first fluid path interconnecting the container and the first fluid port of the printhead;

a second fluid path interconnecting the container and the second fluid port of the printhead;

a third fluid path interconnecting the first and second paths, wherein the first, second and third paths are configured so that fluid from the container flows between the first and second paths via the printhead and via the third fluid path.

Optionally, the system further comprises a multi-path valve connecting the first path to the printhead and the third path.

Optionally, the multi-path valve is operable to selectively provide fluid flow through the printhead and the third path.

In another aspect, the invention provides a fluid distribution system for a printhead, the system comprising:

a fluid container fluidically interconnected with the printhead via a closed fluid flow loop;

a bypass fluid path bypassing the printhead on said closed loop; and a multi-path valve on said closed loop for selectively allowing fluid flow along said closed loop via the printhead and the bypass path.

Optionally, the printhead is an elongate printhead spanning a media width, said closed loop comprising a first path between the container and a first longitudinal end of the printhead and a second path between the container and a second longitudinal end of the printhead.

Optionally, the bypass path bridges across the printhead between the first and second paths.

Optionally, the valve is located on the first path.

Optionally, said closed loop and bypass path comprise fluid hoses.

In another aspect, the invention provides a printing system comprising:

a media width printhead;

a fluid container fluidically interconnected with the printhead via a closed fluid flow loop;

a bypass fluid path bypassing the printhead on said closed loop; and a multi-path valve on said closed loop for selectively allowing fluid flow along said closed loop via the printhead and the bypass path.

Optionally, said closed loop comprises a first path between the container and one longitudinal end of the media width of the printhead and a second path between the container and the other longitudinal end of the media width of the printhead.

Optionally, the bypass path bridges across the printhead between the first and second paths.

Optionally, the valve is located on the first path.

Optionally, said closed loop and bypass path comprise fluid hoses.

In another aspect, the invention provides a fluid distribution system for a printhead, the system comprising:

a plurality of fluid containers fluidically interconnected with the printhead via a respective plurality of closed fluid flow loops;

a plurality of bypass fluid paths bypassing the printhead, each bypass path being associated with a respective one of the closed loops; and a multi-path, multi-channel valve for selectively allowing fluid flow along each of the closed loops via the printhead and the respective bypass paths.

Optionally, the printhead is an elongate printhead spanning a media width, each of the closed loops comprising a first path between the respective container and a first longitudinal end of the printhead and a second path between the respective container and a second longitudinal end of the printhead.

Optionally, each bypass path bridges across the printhead between the respective first and second paths.

Optionally, the valve is located on the first path of each closed loop.

Optionally, each closed loop and bypass path comprises fluid hoses.

Optionally, five fluid flow loops are provided between five fluid containers and the printhead.

In another aspect, the invention provides a printing system comprising:

a media width printhead;

a plurality of fluid containers fluidically interconnected with the printhead via a respective plurality of closed fluid flow loops;

a plurality of bypass fluid paths bypassing the printhead, each bypass path being associated with a respective one of the closed loops; and a multi-path, multi-channel valve for selectively allowing fluid flow along each of the closed loops via the printhead and the respective bypass paths.

Optionally, each of the closed loops comprises a first path between the respective container and a first longitudinal end of the printhead and a second path between the respective container and a second longitudinal end of the printhead.

Optionally, each bypass path bridges across the printhead between the respective first and second paths.

Optionally, the valve is located on the first path of each closed loop.

Optionally, each closed loop and bypass path comprises fluid hoses.

Optionally, five fluid flow loops are provided between five fluid containers and the printhead.

In another aspect, the invention provides a fluid distribution system for a printhead, the system comprising:

a fluid container fluidically interconnected with the printhead via a closed fluid flow loop;

a gas vent on said closed loop; and a multi-path valve on said closed loop for selectively allowing venting of gas in said closed loop via the gas vent.

Optionally, the printhead is an elongate printhead spanning a media width, said closed loop comprising a first path between the container and a first longitudinal end of the printhead and a second path between the container and a second longitudinal end of the printhead.

Optionally, the gas vent and the valve are located on the first path.

Optionally, the gas vent comprises a filter disposed at one end of a vent line, the opposed end of the vent line joining the first path.

Optionally, the filter comprises expanded polytetrafluoroethylene

Optionally, said closed loop and vent line comprise fluid hoses.

In another aspect, the invention provides a printing system comprising:

a media width printhead;

a fluid container fluidically interconnected with the printhead via a closed fluid flow loop;

a gas vent on said closed loop; and a multi-path valve on said closed loop for selectively allowing venting of gas in said closed loop via the gas vent.

Optionally, said closed loop comprises a first path between the container and one longitudinal end of the media width of the printhead and a second path between the container and the other longitudinal end of the media width of the printhead.

Optionally, the gas vent and the valve are located on the first path.

Optionally, the gas vent comprises a filter disposed at one end of a vent line, the opposed end of the vent line joining the first path.

Optionally, the filter comprises expanded polytetrafluoroethylene

Optionally, said closed loop and vent line comprise fluid hoses.

In another aspect, the invention provides a fluid distribution system for a printhead, the system comprising:

a plurality of fluid containers fluidically interconnected with the printhead via a respective plurality of closed fluid flow loops;

a plurality of gas vents, each gas vent being associated with a respective one of the closed loops; and a multi-path, multi-channel valve for selectively allowing venting of gas in each of the closed loops via the gas vents.

Optionally, the printhead is an elongate printhead spanning a media width, each closed loop comprising a first path between the respective container and a first longitudinal end of the printhead and a second path between the respective container and a second longitudinal end of the printhead.

Optionally, the gas vents are located on the respective first paths.

Optionally, the valve is located on the first path.

Optionally, each gas vent comprises a filter disposed at one end of a vent line, the opposed end of the vent line joining the respective first path.

Optionally, the filters comprise expanded polytetrafluoroethylene

Optionally, each closed loop and vent line comprise fluid hoses.

Optionally, five fluid flow loops are provided between five fluid containers and the printhead.

In another aspect, the invention provides a printing system comprising:

a media width printhead;

a plurality of fluid containers fluidically interconnected with the printhead via a respective plurality of closed fluid flow loops;

a plurality of gas vents, each gas vent being associated with a respective one of the closed loops; and a multi-path, multi-channel valve for selectively allowing venting of gas in each of the closed loops via the gas vents.

Optionally, each closed loop comprises a first path between the respective container and a first longitudinal end of the printhead and a second path between the respective container and a second longitudinal end of the printhead.

Optionally, the gas vents are located on the respective first paths.

Optionally, the valve is located on the first path.

Optionally, each gas vent comprises a filter disposed at one end of a vent line, the opposed end of the vent line joining the respective first path.

Optionally, the filters comprise expanded polytetrafluoroethylene

Optionally, each closed loop and vent line comprise fluid hoses.

Optionally, five fluid flow loops are provided between five fluid containers and the printhead.

In another aspect, the invention provides a fluid distribution system for a printhead, the system comprising:

a fluid container fluidically interconnected with the printhead via a closed fluid flow loop;

a bypass fluid path bypassing the printhead on said closed loop;

a gas vent on said closed loop; and a four-way valve on said closed loop for selectively allowing fluid flow along said closed loop via the printhead and the bypass path and venting of gas in said closed loop via the gas vent.

Optionally, the printhead is an elongate printhead spanning a media width, said closed loop comprising a first path between the container and a first longitudinal end of the printhead and a second path between the container and a second longitudinal end of the printhead.

Optionally, the bypass path bridges across the printhead between the first and second paths.

Optionally, the gas vent and the valve are located on the first path.

Optionally, the gas vent comprises a filter disposed at one end of a vent line, the opposed end of the vent line joining the first path.

Optionally, the filter comprises expanded polytetrafluoroethylene

Optionally, said closed loop, bypass path and vent line comprise fluid hoses.

In another aspect, the invention provides a printing system comprising:

a media width printhead;

a fluid container fluidically interconnected with the printhead via a closed fluid flow loop;

a bypass fluid path bypassing the printhead on said closed loop;

a gas vent on said closed loop; and a four-way valve on said closed loop for selectively allowing fluid flow along said closed loop via the printhead and the bypass path and venting of gas in said closed loop via the gas vent.

Optionally, said closed loop comprises a first path between the container and one longitudinal end of the media width of the printhead and a second path between the container and the other longitudinal end of the media width of the printhead.

Optionally, the bypass path bridges across the printhead between the first and second paths.

Optionally, the gas vent and the valve are located on the first path.

Optionally, the gas vent comprises a filter disposed at one end of a vent line, the opposed end of the vent line joining the first path.

Optionally, the filter comprises expanded polytetrafluoroethylene

Optionally, said closed loop, bypass path and vent line comprise fluid hoses.

In another aspect, the invention provides a fluid distribution system for a printhead, the system comprising:

a plurality of fluid containers fluidically interconnected with the printhead via a respective plurality of closed fluid flow loops;

a plurality of bypass fluid paths bypassing the printhead, each bypass path being associated with a respective one of the closed loops; and a plurality of gas vents, each gas vent being associated with a respective one of the closed loops; and a multi-channel four-way valve for selectively allowing fluid flow along each closed loop via the printhead and the bypass paths and venting of gas in each closed loop via the gas vents.

Optionally, the printhead is an elongate printhead spanning a media width, each closed loop comprising a first path between the respective container and a first longitudinal end of the printhead and a second path between the respective container and a second longitudinal end of the printhead.

Optionally, each bypass path bridges across the printhead between the respective first and second paths.

Optionally, the gas vents are located on the respective first paths.

Optionally, the valve is located on the first path.

Optionally, each gas vent comprises a filter disposed at one end of a vent line, the opposed end of the vent line joining the respective first path.

Optionally, the filters comprise expanded polytetrafluoroethylene

Optionally, each closed loop, bypass path and vent line comprise fluid hoses.

Optionally, five fluid flow loops are provided between five fluid containers and the printhead.

In another aspect, the invention provides a printing system comprising:

a media width printhead;

a plurality of fluid containers fluidically interconnected with the printhead via a respective plurality of closed fluid flow loops;

a plurality of bypass fluid paths bypassing the printhead, each bypass path being associated with a respective one of the closed loops; and a plurality of gas vents, each gas vent being associated with a respective one of the closed loops; and a multi-channel four-way valve for selectively allowing fluid flow along each closed loop via the printhead and the bypass paths and venting of gas in each closed loop via the gas vents.

Optionally, the printhead is an elongate printhead spanning a media width, each closed loop comprising a first path between the respective container and a first longitudinal end of the printhead and a second path between the respective container and a second longitudinal end of the printhead.

Optionally, each bypass path bridges across the printhead between the respective first and second paths.

Optionally, the gas vents are located on the respective first paths.

Optionally, the valve is located on the first path.

Optionally, each gas vent comprises a filter disposed at one end of a vent line, the opposed end of the vent line joining the respective first path.

Optionally, the filters comprise expanded polytetrafluoroethylene

Optionally, each closed loop, bypass path and vent line comprise fluid hoses.

Optionally, five fluid flow loops are provided between five fluid containers and the printhead.

In another aspect, the invention provides a fluid distribution system for a printhead, the system comprising:

a fluid container fluidically interconnected with the printhead via a closed fluid flow loop, the fluid being drawn from the container in a first direction around the closed loop by the printhead during printing; and a pump on said closed loop, the pump being operational to draw fluid from the container in an opposite, second direction around said closed loop.

Optionally, the printhead is an elongate printhead spanning a media width, said closed loop comprising a first path between the container and a first longitudinal end of the printhead and a second path between the container and a second longitudinal end of the printhead.

Optionally, the pump is located on the second path.

Optionally, the second path connects with the container at a point higher than a point at which the first path connects with the container.

Optionally, the pump is a peristaltic pump.

In another aspect, the invention provides a method of priming a media width printhead, the method comprising:

controlling operation of the printhead, with a controller of a printing system comprising the printhead, to draw fluid in a first direction around a closed fluid flow loop from a fluid container to the printhead; and controlling operation of a pump on said closed loop, with the controller, to draw fluid from the container in an opposite, second direction around said closed loop.

Optionally, the printhead is an elongate printhead spanning a media width, said closed loop comprising a first path between the container and a first longitudinal end of the printhead and a second path between the container and a second longitudinal end of the printhead.

Optionally, the pump is located on the second path.

Optionally, the second path connects with the container at a point higher than a point at which the first path connects with the container.

Optionally, the pump is a peristaltic pump.

In another aspect, the invention provides a system for priming and de-priming a printhead, the system comprising:

a fluid container fluidically interconnected with the printhead via a closed fluid flow loop;

a gas inlet on said closed loop; and a valve on said closed loop for selectively allowing gas to enter said closed loop via the gas inlet; and a pump on said closed loop, wherein the pump is operational to draw fluid from the container in a first direction around said closed loop to prime the printhead with fluid from the container, and the vent is operational to cause fluid in said closed loop and the printhead to de-prime to the container in a second direction around said closed loop.

Optionally, the printhead is an elongate printhead spanning a media width, said closed loop comprising a first path between the container and a first longitudinal end of the printhead and a second path between the container and a second longitudinal end of the printhead.

Optionally, the pump is located on the second path.

Optionally, the second path connects with the container at a point higher than a point at which the first path connects with the container.

Optionally, the gas inlet and the valve are located on the first path.

Optionally, the gas inlet comprises a filter disposed at one end of a vent line, the opposed end of the vent line joining the first path.

Optionally, the filter comprises expanded polytetrafluoroethylene.

Optionally, said closed loop and vent line comprise fluid hoses.

Optionally, the pump is a peristaltic pump.

In another aspect, the invention provides a A method of priming and de-priming a media width printhead, the method comprising:

controlling operation, with a controller of a printing system comprising the printhead, of a pump on a closed fluid flow loop interconnecting a fluid container to the printhead to draw fluid from the container in a first direction around said closed loop to prime the printhead with fluid from the container; and controlling operation of a valve on said closed loop, with the controller, to allow gas to enter said closed loop via a gas inlet to cause fluid in said closed loop and the printhead to de-prime to the container in a second direction around said closed loop.

Optionally, the printhead is an elongate printhead spanning a media width, said closed loop comprising a first path between the container and a first longitudinal end of the printhead and a second path between the container and a second longitudinal end of the printhead.

Optionally, the pump is located on the second path.

Optionally, the second path connects with the container at a point higher than a point at which the first path connects with the container.

Optionally, the gas inlet and the valve are located on the first path.

Optionally, the gas inlet comprises a filter disposed at one end of a vent line, the opposed end of the vent line joining the first path.

Optionally, the pump is a peristaltic pump.

In another aspect, the invention provides a fluid distribution system for a media width printhead, the system comprising:

a fluid container having a gas vent;

a first fluid path interconnecting the container and a first fluid port at one longitudinal end of the media width of the printhead;

a second fluid path interconnecting the container and a second fluid port at the other longitudinal end of the media width of the printhead;

a third fluid path interconnecting the first and second paths, a pump on the second path, the pump being operational to draw fluid from the container through the first and second paths via the printhead and via the third fluid path to flush gas in said paths to the container for venting via the gas vent.

Optionally, the system further comprises a multi-path valve connecting the first path to the printhead and the third path.

Optionally, the multi-path valve is operable to selectively provide fluid flow through the printhead and the third path.

Optionally, the second path connects with the container at a point higher than a point at which the first path connects with the container.

Optionally, the pump is a peristaltic pump.

In another aspect, the invention provides a multi-path valve for a media width inkjet printhead, the printhead being connected to an ink source via a closed ink flow loop, the valve comprising:

a body;

a first port on the body for connection to the ink source;

a second port on the body for connection to the printhead;

a third port on the body for connection to a bypass ink path which bypasses the printhead on said closed loop;

a fourth port on the body for connection to a gas vent on said closed loop;

a chamber within the body via which the first, second, third and fourth ports are able to be interconnected; and a selection device for selectively establishing interconnection between the first, second, third and fourth ports to allow ink flow therebetween.

Optionally: said closed loop comprises a first path between the ink source and one longitudinal end of the media width of the printhead and a second path between the ink source and the other longitudinal end of the media width of the printhead; the bypass path bridges across the printhead between the first and second paths; and the valve is configured to be located on the first path.

Optionally, said closed loop and bypass path comprise fluid hoses, the first, second, third and fourth ports being configured to connect with the fluid hoses.

Optionally, the selection device comprises a driven shaft and selection members on the shaft, the selection members being rotated by driven rotation of the shaft so as to selectively establishing the interconnections between the first, second, third and fourth ports.

Optionally, the selection members define seals for respective ones of the first, second, third and fourth ports.

In another aspect, the invention provides a multi-channel valve for a media width inkjet printhead, the printhead being connected to a plurality of ink supplies via a plurality of ink flow channels, the valve comprising:

a body;

a plurality of sealed chambers within the body;

a plurality of groups of ports on the body, each port group being associated with a respective one of the chambers and having individual ports for respective connection to the printhead and a respective one of the ink supplies; and a selection device for selectively establishing interconnection between the ports of each port group to allow ink flow therebetween for each of the channels.

Optionally, the selection device comprises a driven shaft and selection members on the shaft, the selection members being rotated by driven rotation of the shaft so as to selectively establishing the interconnections between the ports.

Optionally, the selection members define seals for respective ones of the ports.

Optionally, five ink channels are provided between five ink supplies and the printhead, the valve comprising five of the sealed chambers and five associated port groups.

In another aspect, the invention provides a diaphragm valve for distributing ink from an ink source to a media width inkjet printhead, the valve comprising:

a body;

a plurality of ports on the body for connection to the ink source and printhead;

a chamber within the body via which the ports are able to be interconnected;

a diaphragm pad having seals for sealing respective ones of the ports; and a selection device for manipulating the diaphragm pad to selectively seal and un-seal the ports to establish interconnection between the ports thereby allowing ink flow therebetween.

Optionally, the selection device comprises a driven shaft and selection members on the shaft, the selection members being rotated by driven rotation of the shaft so as to manipulate the diaphragm pad.

Optionally, the selection members comprise eccentric cams mounted on the shaft.

Optionally, the selection members comprises cantilevered fingers mounted within the body so that each finger is aligned with a respective one of the eccentric cams.

Optionally, the diaphragm pad is arranged so that rotation of the eccentric cams selectively presses the fingers into and out of contact with the diaphragm pad thereby discretely deforming the diaphragm pad to seal and un-seal the ports.

Optionally, the valve further comprises a sealing film sealingly located between the diaphragm pad and the fingers.

Optionally, the plurality of ports comprises a first port for connection to the ink source, a second port for connection to the printhead, a third port for connection to a bypass ink path which bypasses the printhead on a closed ink flow loop interconnecting the printhead and ink source, and a fourth port for connection to a gas vent on said closed loop.

Optionally: said closed loop comprises a first path between the ink source and one longitudinal end of the media width of the printhead and a second path between the ink source and the other longitudinal end of the media width of the printhead; the bypass path bridges across the printhead between the first and second paths; and the valve is configured to be located on the first path.

Optionally, said closed loop and bypass path comprise fluid hoses, the first, second, third and fourth ports being configured to connect with the fluid hoses.

In another aspect, the invention provides a multi-channel diaphragm valve for distributing ink from a plurality of ink supplies to a media width inkjet printhead via a plurality of ink flow channels, the valve comprising:

a body;

a plurality of sealed chambers within the body;

a plurality of groups of ports on the body, each port group being associated with a respective one of the chambers and having individual ports for respective connection to the printhead and a respective one of the ink supplies; and a plurality of diaphragm pads having seals for sealing respective ones of the ports; and a selection device for manipulating the diaphragm pad to selectively seal and un-seal the ports to establish interconnection between the ports of each port group to allow ink flow therebetween for each of the channels.

Optionally, five ink channels are provided between five ink supplies and the printhead, the valve comprising five of the sealed chambers and five associated port groups.

Optionally, the selection device comprises a driven shaft and selection members on the shaft, the selection members being rotated by driven rotation of the shaft so as to manipulate the diaphragm pads.

Optionally, the selection members comprise eccentric cams mounted on the shaft.

Optionally, the selection members comprises cantilevered fingers mounted within the body so that each finger is aligned with a respective one of the eccentric cams.

Optionally, the diaphragm pads are arranged so that rotation of the eccentric cams selectively presses the fingers into and out of contact with the diaphragm pads thereby discretely deforming the diaphragm pads to seal and un-seal the ports.

Optionally, the valve further comprises sealing films sealingly located between the respective diaphragm pads and fingers.

Optionally, a plurality of groups of the eccentric cams are arranged so that each cam group corresponds to a port group, the cams of each group being arranged so that eccentric features of the cams are offset relative to each other cam in that group and are aligned to a corresponding cam in each other cam group.

Optionally, each port group comprises a first port for connection to the ink source, a second port for connection to the printhead, a third port for connection to a bypass ink path which bypasses the printhead on the respective ink flow channel, and a fourth port for connection to a gas vent on said ink flow channel.

Optionally: each ink flow channel comprises a first path between the ink source and one longitudinal end of the media width of the printhead and a second path between the ink source and the other longitudinal end of the media width of the printhead; each bypass path bridges across the printhead between the first and second paths of the respective ink flow channel; and the valve is configured to be located on the first path of each ink flow channel.

Optionally, each ink flow channel and bypass path comprise fluid hoses, the first, second, third and fourth ports being configured to connect with the fluid hoses.

In another aspect, the invention provides a rotary valve for distributing ink from an ink source to a media width inkjet printhead, the valve comprising:

a body;

a shaft rotatably mounted to the body;

a channel cylinder arranged on the shaft to be rotatable therewith, the channel cylinder having a channel defined along its circumference;

a port cylinder fixed to the body relative to the shaft so as to concentrically and sealingly enclose the channel cylinder, the port cylinder having a plurality of ports defined therethrough along its circumference for respective connection to the printhead and ink source, each port being aligned with a portion of the channel; and a selection device for selectively rotating the shaft to establish interconnection between the ports and the channel thereby allowing ink flow between the ports via the channel.

Optionally, the channel has a serpentine form.

Optionally, the ports are aligned relative to the channel of the channel cylinder so that alignment of the ports with a straight portion of the serpentine form of the channel provides interconnection between those ports.

Optionally, the plurality of ports comprises a first port for connection to the ink source, a second port for connection to the printhead, a third port for connection to a bypass ink path which bypasses the printhead on a closed ink flow loop interconnecting the printhead and ink source, and a fourth port for connection to a gas vent on said closed loop.

Optionally: said closed loop comprises a first path between the ink source and one longitudinal end of the media width of the printhead and a second path between the ink source and the other longitudinal end of the media width of the printhead; the bypass path bridges across the printhead between the first and second paths; and the valve is configured to be located on the first path.

Optionally, said closed loop and bypass path comprise fluid hoses, the first, second, third and fourth ports being configured to connect with the fluid hoses.

In another aspect, the invention provides a multi-channel rotary valve for distributing ink from a plurality of ink supplies to a media width inkjet printhead via a plurality of ink flow channels, the valve comprising:

a body;

a shaft rotatably mounted to the body;

a cylindrical channel arrangement mounted on the shaft to be rotatable therewith, the channel arrangement having a plurality of individual channels defined along its circumference;

a cylindrical port arrangement fixed to the body relative to the shaft so as to concentrically and sealingly enclose the channel arrangement, the port arrangement having a plurality of groups of ports defined therethrough along its circumference for respective connection to the printhead and a respective one of the ink supplies, each port groups being aligned with a portion of a respective one of the channels in the channel arrangement; and a selection device for selectively rotating the shaft to establish interconnection between the ports of each port group via the respective channels to allow ink flow therebetween for each of the ink flow channels.

Optionally, five ink flow channels are provided between five ink supplies and the printhead, the valve comprising five of the channels and five associated port groups.

Optionally, each channel has a serpentine form.

Optionally, the ports are aligned relative to the respective channels of the channel arrangement so that alignment of the ports with a straight portion of the serpentine form of the respective channel provides interconnection between those ports.

Optionally, each port group comprises a first port for connection to the ink source, a second port for connection to the printhead, a third port for connection to a bypass ink path which bypasses the printhead on the respective ink flow channel, and a fourth port for connection to a gas vent on said ink flow channel.

Optionally: each ink flow channel comprises a first path between the ink source and one longitudinal end of the media width of the printhead and a second path between the ink source and the other longitudinal end of the media width of the printhead; each bypass path bridges across the printhead between the first and second paths of the respective ink flow channel; and the valve is configured to be located on the first path of each ink flow channel.

Optionally, each ink flow channel and bypass path comprise fluid hoses, the first, second, third and fourth ports being configured to connect with the fluid hoses.

In another aspect, the invention provides a multi-channel valve arrangement for distributing ink from a plurality of ink supplies to a media width inkjet printhead via a plurality of ink tubes each defining an individual ink flow channel, the valve comprising:

a body;

a plurality of ports defined through the body, each port being configured to receive a respective one of the ink tubes therethrough;

a movable pinch element extending across the ports; and a pinch drive arrangement for selectively moving the pinch element into and out of pinching contact with the ink tubes so as to respectively block and allow ink flow through the ink tubes.

Optionally, the valve further comprises a plate fixedly mounted to the body Optionally, the pinch element is mounted to the plate by springs.

Optionally, the springs are configured to bias the pinch element away from the fixed plate.

Optionally, the springs are compression springs.

Optionally, four springs are symmetrically arranged about the pinch element and plate.

Optionally, the pinch drive arrangement comprises a shaft rotatably mounted to the body and eccentric cams fixedly mounted on the shaft, the eccentric cams being configured so that rotation of the shaft causes selective contact between the cams and the pinch element thereby selectively forcing the pinch element towards the plate.

Optionally, the pinch element comprises roller bearings arranged to selectively contact the cams.

Optionally, five ink flow channels are provided between five ink supplies and the printhead, the valve comprising five of the ports.

Optionally, each ink flow channel comprises a first path between the ink source and one longitudinal end of the media width of the printhead and a second path between the ink source and the other longitudinal end of the media width of the printhead, and the valve is configured to be located on the first path of each ink flow channel.

In another aspect, the invention provides a printing system comprising:

a media width printhead;

a plurality of fluid containers fluidically interconnected with the printhead via a respective plurality of fluid tubes each defining an individual closed fluid flow loop;

a first multi-channel valve arrangement for selectively allowing fluid flow along each closed loop via the printhead by selectively moving a pinch element into and out of pinching contact with the fluid tubes so as to respectively block and allow fluid flow through the fluid tubes;

a plurality of gas vents, each gas vent being associated with a respective one of the closed loops; and a second multi-channel valve arrangement for selectively allowing venting of gas in each closed loop via the gas vents.

Optionally, the first multi-channel valve arrangement comprises:

a body;

a plurality of ports defined through the body, each port being configured to receive a respective one of the ink tubes therethrough; and a pinch drive arrangement for selectively moving the pinch element.

Optionally, the first multi-channel valve arrangement comprises a plate fixedly mounted to the body Optionally, the pinch element is mounted to the plate by springs.

Optionally, the springs are configured to bias the pinch element away from the fixed plate.

Optionally, the springs are compression springs.

Optionally, four springs are symmetrically arranged about the pinch element and plate.

Optionally, the pinch drive arrangement comprises a shaft rotatably mounted to the body and eccentric cams fixedly mounted on the shaft, the eccentric cams being configured so that rotation of the shaft causes selective contact between the cams and the pinch element thereby selectively forcing the pinch element towards the plate.

Optionally, the pinch element comprises roller bearings arranged to selectively contact the cams.

Optionally: each gas vent comprises a filter disposed at one end of a vent line, the opposed end of the vent line joining the respective first path; and the second multi-channel valve arrangement comprises a plurality of check valves, each check valve being located on a respective one of the vent lines.

Optionally, the filters comprise expanded polytetrafluoroethylene

Optionally, five fluid flow loops are provided between five containers and the printhead.

In another aspect, the invention provides a liquid container for supplying liquid to a printer, the liquid container comprising:

a body having an interior space for containing liquid to a predetermined capacity;

a port through the body for delivery of liquid into the body to said predetermined capacity;

an aperture through the body at which the interior space of the body is in communication with atmosphere external to the fluid container; and a fluid pressure changing member between the aperture and the interior space of the body, the member being configured so that contact with the liquid being delivered via the port causes a change in the fluid pressure at the port.

Optionally, the port and aperture are located through an upper surface of the body so that the liquid being delivered into the interior space of the body fills said interior space from a lower surface of the body to said upper surface.

Optionally, the member comprises a hydrophobic film located between the interior space and the aperture.

Optionally, the member comprises a protrusion within an opening of the aperture in an interior surface of the body.

Optionally, the aperture has a gas vent on an exterior surface of the body, the gas vent being configured to be closed to atmosphere until the container is installed in the printer.

Optionally the container comprises a valve within the aperture, the valve being biased closed and having an engagement portion which engages with the printer so as to open valve against said bias when the container is installed in the printer.

In another aspect, the invention provides a system for sensing a predetermined pressure change at a port of a liquid container for supplying liquid to a printer, the system comprising a liquid delivery apparatus connected to a liquid container via a fluid line and a sensing arrangement connected to the fluid line, wherein the liquid container comprises an internal fluid pressure changing member configured so that contact with liquid being delivered by the liquid delivery apparatus causes said predetermined pressure change in the fluid line, and the sensing arrangement is configured to sense said predetermined pressure change in the fluid line.

Optionally, the liquid container further comprises:

a body having an interior space for containing liquid to a predetermined capacity;

a port through the body connected to the fluid line for delivery of the liquid from the liquid delivery apparatus into the body to said predetermined capacity; and an aperture through the body at which the interior space of the body is in communication with atmosphere external to the fluid container, wherein the fluid pressure changing member is arranged between the aperture and the interior space of the body.

Optionally, the port and aperture are located through an upper surface of the body so that the liquid being delivered into the interior space of the body fills said interior space from a lower surface of the body to said upper surface.

Optionally, the member comprises a hydrophobic film located between the interior space and the aperture.

Optionally, the member comprises a protrusion within an opening of the aperture in an interior surface of the body.

Optionally, the aperture has a gas vent on an exterior surface of the body, the gas vent being configured to be closed to atmosphere until the container is installed in the printer.

Optionally, the container comprises a valve within the aperture, the valve being biased closed and having an engagement portion which engages with the printer so as to open valve against said bias when the container is installed in the printer.

In another aspect, the invention provides a liquid container for supplying liquid to a printer, the liquid container comprising:

a body having an interior space for containing liquid to a predetermined capacity;

a port through the body for delivery of liquid into the body to said predetermined capacity;

an aperture through the body at which the interior space of the body is in communication with atmosphere external to the fluid container; and a hydrophobic film between the aperture and the interior space of the body, the film being configured so that contact with the liquid being delivered via the port causes a change in the fluid pressure at the port.

Optionally, a material of the hydrophobic film is expanded polytetrafluoroethylene.

Optionally, the aperture comprises a tortuous path to liquid.

Optionally, the tortuous path is a serpentine channel formed through the body.

Optionally, the tortuous path has a gas vent on an exterior surface of the body, the gas vent being covered by a piercable air impervious film. Optionally, the port and aperture are located through an upper surface of the body so that the liquid being delivered into the interior space of the body fills said interior space from a lower surface of the body to said upper surface.

In another aspect, the invention provides a coupling for distributing fluid to a printhead, the coupling comprising:

a housing;

a port plate movably mounted on the housing by a shaft, the port plate having a plurality of ports for receiving respective fluid spouts of the printhead;

a seal member mounted on the housing between the housing and the port plate, the seal member having a plurality of seals which align with respective ones of the ports of the port plate; and a compression spring mounted on the shaft by a washer so as to be compressed between the washer and the port plate.

Optionally, the seal member is received in a recess of the housing.

Optionally, the seal member has linking portions which link the seals together.

Optionally, the seals are circular and the linking portions define an arc between each seal, and the recess comprises circular recesses into which the circular seals are received and curved recesses between the circular recesses into which the linking portions are received.

Optionally, the recess has slots across the curved recesses which serve to capture and wick away any fluid present in the recess.

Optionally, the port plate has rims about the ports for compressing the respective seals of the seal member when pressed thereagainst.

Optionally, the washer is a groove-less ring press-on fitted on a reduced section of a cylindrical portion of the shaft.

In another aspect, the invention provides a method of assembling a coupling for distributing fluid to a printhead, the method comprising:

mounting a seal member on a housing;

inserting a shaft through a hole in the housing and the seal member;

positioning a compression spring on the shaft; and mounting a port plate on the shaft using a washer about the shaft so that the spring is compressed between the port plate and the housing and a plurality of ports in the port plate align with respective ones of a plurality of seals of the seal member for receiving respective fluid spouts of the printhead.

Optionally, the seal member is mounted into a recess of the housing.

Optionally, the seal member has linking portions which link the seals together.

Optionally, the seals are circular and the linking portions define an arc between each seal, and the recess comprises circular recesses into which the circular seals are received and curved recesses between the circular recesses into which the linking portions are received.

Optionally, the recess has slots across the curved recesses which serve to capture and wick away any fluid present in the recess.

Optionally, the port plate has rims about the ports for compressing the respective seals of the seal member when pressed thereagainst.

Optionally, the washer is a groove-less ring which is press-on fitted on a reduced section of a cylindrical portion of the shaft.

In another aspect, the invention provides a coupling assembly for distributing fluid to a printhead, the coupling assembly comprising:

a housing;

a seal member received in a recess of the housing;

a port plate movably mounted on the housing by a washer which is press-on mounted to a shaft through the port plate and housing; and a tube retainer mounted within a groove of the housing for retaining fluid distribution tubes, the retainer having a plurality of holes aligned with respective ones of a plurality of ports in the port plate and a plurality of seals of the seal member for fluidically connecting the retained fluid distribution tubes with respective fluid spouts of the printhead, wherein mounting of each of the seal member, port plate and retainer to the housing is achieved in a non-fastened manner.

Optionally, the seal member has linking portions which link the seals together.

Optionally, the seals are circular and the linking portions define an arc between each seal, and the recess comprises circular recesses into which the circular seals are received and curved recesses between the circular recesses into which the linking portions are received.

Optionally, the recess has slots across the curved recesses which serve to capture and wick away any fluid present in the recess.

Optionally, the port plate has rims about the ports for compressing the respective seals of the seal member when pressed thereagainst by the spring.

Optionally, the washer is a groove-less ring press-on mounted on a reduced section of a cylindrical portion of the shaft.

Optionally, the retainer is formed from resiliently flexible material.

Optionally, the retainer has a rim about its circumferential edge having details, the rim being resiliently received within the groove of the housing and the details engaging with slots formed across the groove.

In another aspect, the invention provides a method of assembling a coupling for distributing fluid to a printhead, the method comprising:

mounting a seal member in a recess of a housing;

inserting a shaft through a hole in the housing and the seal member;

mounting a port plate on the shaft using a washer which is press-on mounted to the shaft; and mounting a tube retainer for retaining fluid distribution tubes within a groove of the housing, the retainer having a plurality of holes aligned with respective ones of a plurality of ports in the port plate and a plurality of seals of the seal member for fluidically connecting the retained fluid distribution tubes with respective fluid spouts of the printhead, wherein the mounting of each of the seal member, port plate and retainer to the housing is achieved in a non-fastened manner.

Optionally, the seal member has linking portions which link the seals together.

Optionally, the seals are circular and the linking portions define an arc between each seal, and the recess comprises circular recesses into which the circular seals are received and curved recesses between the circular recesses into which the linking portions are received.

Optionally, the recess has slots across the curved recesses which serve to capture and wick away any fluid present in the recess.

Optionally, the port plate has rims about the ports for compressing the respective seals of the seal member when pressed thereagainst by the spring.

Optionally, the washer is a groove-less ring which is press-on fitted on a reduced section of a cylindrical portion of the shaft.

Optionally, the retainer is formed from resiliently flexible material.

Optionally, the retainer has a rim about its circumferential edge having details, the rim being resiliently received within the groove of the housing and the details engaging with slots formed across the groove.

In another aspect, the invention provides a system for coupling a media width printhead to a fluid supply, the system comprising:

a printhead having a fluid inlet printhead coupling at one longitudinal end of the media width and a fluid outlet printhead coupling at the other longitudinal end of the media width, the printhead couplings each having a plurality of fluid ports;

an inlet supply coupling having a plurality of fluid ports defined in a port plate for engagement with the fluid ports of the inlet printhead coupling;

an outlet supply coupling having a plurality of fluid ports defined in a port plate for engagement with the fluid ports of the outlet printhead coupling; and a coupling drive mechanism connected to the port plates of the supply couplings via pre-compressed compression springs, the coupling drive mechanism being operational to move the port plates relative to the printhead so as to drive the ports of the supply couplings into engagement with the respective ports of the printhead couplings.

Optionally, the coupling drive mechanism has a housing in which the supply couplings are housed.

Optionally, the housing has generally cylindrical sockets in which the generally cylindrical supply couplings are positioned so that the port plates are exposed for engagement with the respective printhead couplings.

Optionally, the sockets have slots which receive wings on two, opposite sides of the respective supply coupling.

Optionally, the wings are formed as cantilevered leaf springs which flex within the slots.

Optionally, each supply coupling comprises a movable shaft which passes through an apertured projection in the respective port plate, each compression spring being mounted on the shaft by a washer so as to be compressed between washer and the projection of the port plate.

Optionally, the coupling drive arrangement is connected to the shafts and drives movement of the shafts relative to each supply coupling body.

Optionally, arms are pivotally connected between each shaft and the coupling drive arrangement.

Optionally, the coupling drive arrangement has cam arms which are rotationally driven by a cam mechanism, each arm being connected to the respective cam arm so that rotation of the cam arms moves the supply couplings within the sockets.

In another aspect, the invention provides a coupling assembly for distributing fluid to a printhead, the coupling assembly comprising:

a housing;

a port plate movably mounted to a shaft which passes through the port plate and housing;

a compression spring mounted on the shaft by a washer so as to be compressed between the washer and the port plate; and an arm pivotally connected to the shaft at one of its longitudinal ends and pivotally connected to a coupling drive mechanism at its other longitudinal end Optionally, the arm has first and second pairs of beams interconnected by a bridge portion, the first beam pair being pivotally connected to the shaft and the second beam pair being pivotally connected to the coupling drive mechanism.

Optionally, the first beam pair are tapered in the vicinity of the bridge portion.

Optionally, the distal ends of the first beam pair relative to the bridge have a wall thickness greater than a wall thickness of the rest of the first beam pair.

BRIEF DESCRIPTION OF DRAWINGS

The exemplary features, best mode and advantages of the invention will be understood by the description herein with reference to accompanying drawings, in which:

FIG. 4 is an exploded view of the printhead;

One of ordinary skill in the art will appreciate that the invention is not limited in its application to the details of construction, the arrangements of components, and the arrangement of steps set forth in the description herein and/or illustrated in the accompanying drawings. The invention is capable of other embodiments and of being practiced or being carried out in various other ways. Also, it is to be understood that the phraseology and terminology used herein is for the purpose of description and should not be regarded as limiting.

DETAILED DESCRIPTION OF EMBODIMENTS

Figure 1:
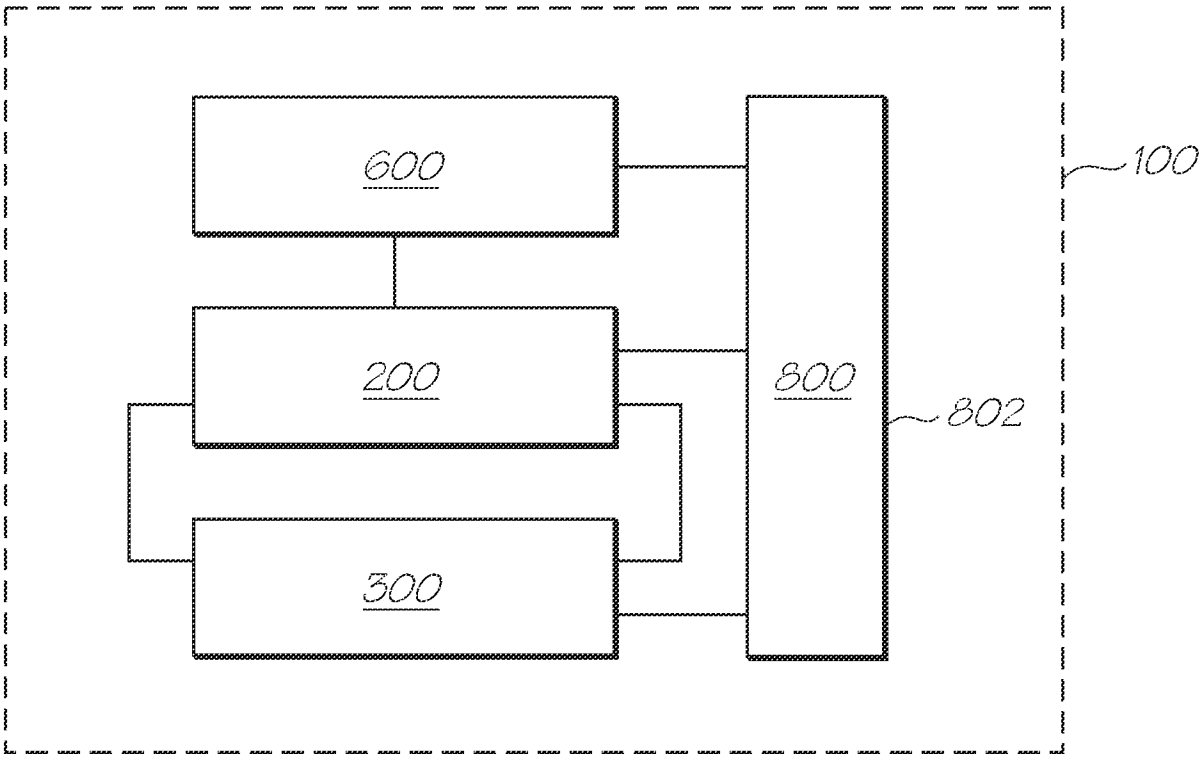
FIG. 1 is a block diagram of the main system components of a printer.
Figure 2:
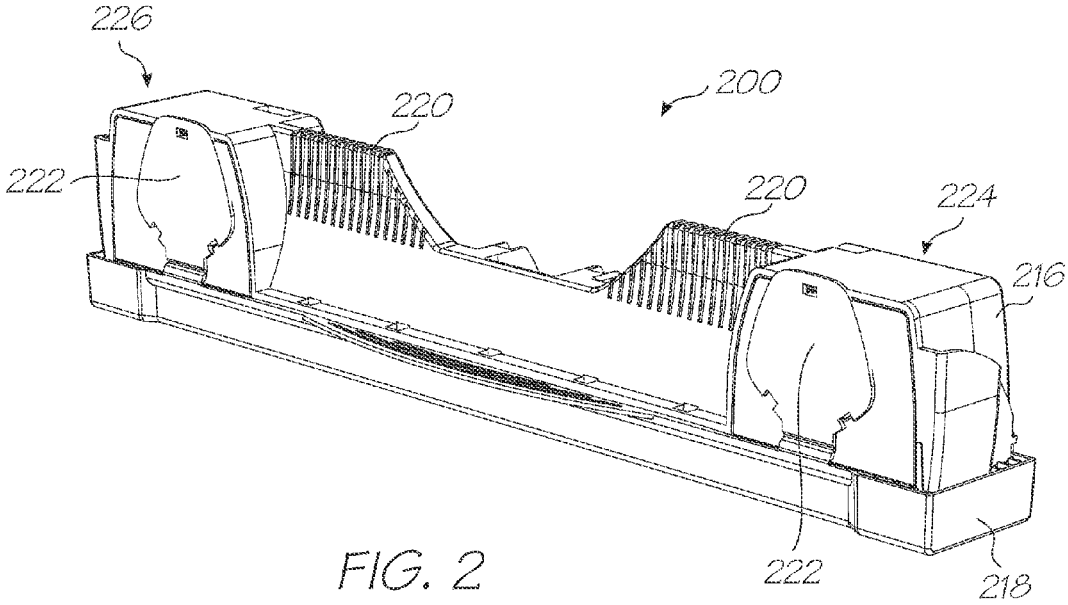
FIG. 2 is a perspective view of a printhead of the printer.

An exemplary block diagram of the main system components of a printer 100 is illustrated in FIG. 1. The printer 100 has a printhead 200, fluid distribution system 300, maintenance system 600 and electronics 800.

The printhead 200 has fluid ejection nozzles for ejecting printing fluid, such as ink, onto passing print media. The fluid distribution system 300 distributes ink and other fluids for ejection by the nozzles of the printhead 200. The maintenance system 600 maintains the nozzles of the printhead 200 so that reliable and accurate fluid ejection is provided.

The electronics 800 operatively interconnects the electrical components of the printer 100 to one another and to external components/systems. The electronics 800 has control electronics 802 for controlling operation of the connected components. An exemplary configuration of the control electronics 802 is described in US Patent Application Publication No. 20050157040, the contents of which are hereby incorporated by reference.

The printhead 200 may be provided as a media width printhead cartridge removable from the printer 100, as described in US Patent Application Publication No. 20090179940, the contents of which are hereby incorporated by reference. This exemplary printhead cartridge includes a liquid crystal polymer (LCP) molding 202 supporting a series of printhead ICs 204, as illustrated in FIGS. 2-5, which extends the width of media substrate to be printed. When mounted to the printer 100, the printhead 200 therefore constitutes a stationary, full media width printhead.

The printhead ICs 204 each comprise ejection nozzles for ejecting drops of ink and other printing fluids onto the passing media substrate. The nozzles may be MEMS (micro electromechanical) structures printing at true 1600 dpi resolution (that is, a nozzle pitch of 1600 nozzles per inch), or greater. The fabrication and structure of suitable printhead ICs 204 are described in detail in US Patent Application Publication No. 20070081032, the contents of which are hereby incorporated by reference.

The LCP molding 202 has main channels 206 extending the length of the LCP molding 202 between associated inlet ports 208 and outlet ports 210. Each main channel 206 feeds a series of fine channels (not shown) extending to the other side of the LCP molding 202. The fine channels supply ink to the printhead ICs 204 through laser ablated holes in the die attach film via which the printhead ICs are mounted to the LCP molding, as discussed below.

Above the main channel 206 is a series of non-priming air cavities 214. These cavities 214 are designed to trap a pocket of air during printhead priming. The air pockets give the system some compliance to absorb and damp pressure spikes or hydraulic shocks in the printing fluid. The printers are high speed pagewidth or media width printers with a large number of nozzles firing rapidly. This consumes ink at a fast rate and suddenly ending a print job, or even just the end of a page, means that a column of ink moving towards (and through) the printhead 200 must be brought to rest almost instantaneously. Without the compliance provided by the air cavities 214, the momentum of the ink would flood the nozzles in the printhead ICs 204. Furthermore, the subsequent 'reflected wave' could otherwise generate sufficient negative pressure to erroneously deprime the nozzles.

The printhead cartridge has a top molding 216 and a removable protective cover 218. The top molding 216 has a central web for structural stiffness and to provide textured grip surfaces 220 for manipulating the printhead cartridge during insertion and removal with respect to the printer 100. Movable caps 222 are provided at a base of the cover and are movable to cover an inlet printhead coupling 224 and an outlet printhead coupling 226 of the printhead 200 prior to installation in the printer. The terms "inlet" and "outlet" are used to specify the usual direction of fluid flow through the printhead 200 during printing. However, the printhead 200 is configured so that fluid entry and exit can be achieved in either direction along the printhead 200.

Figure 3:
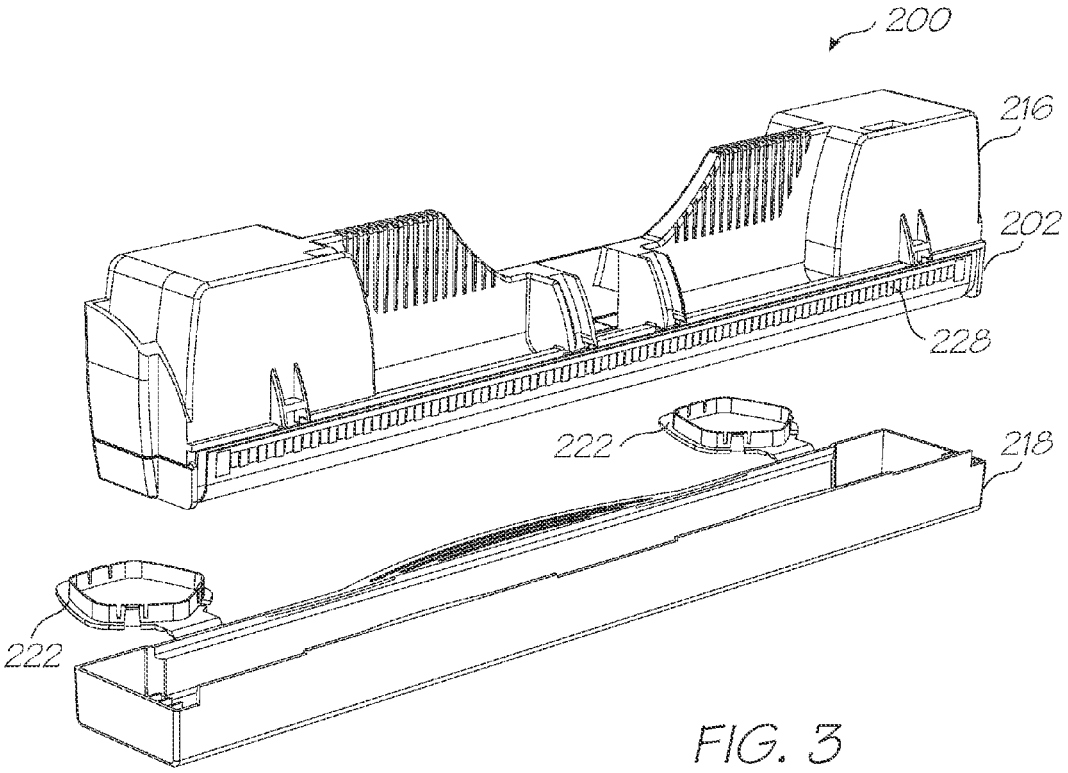
FIG. 3 illustrates the printhead with a cover removed.

The base of the cover 218 protects the printhead ICs 204 and electrical contacts 228 of the printhead prior to installation in the printer and is removable, as illustrated in FIG. 3, to expose the printhead ICs 204 and the contacts 228 for installation. The protective cover may be discarded or fitted to a printhead cartridge being replaced to contain leakage from residual ink therein.

The top molding 216 covers an inlet manifold 230 of the inlet coupling 224 and an outlet manifold 232 of the outlet coupling 226 together with shrouds 234, as illustrated in FIG. 4. The inlet and outlet manifolds 230,232 respectively have inlet and outlet spouts 236,238. Five each of the inlet and outlet ports or spouts 236,238 are shown in the illustrated embodiment of the printhead 200, which provide for five ink channels, e.g., CYMKK or CYMKIR. Other arrangements and numbers of the spouts are possible to provide different printing fluid channel configurations. For example, instead of a multi-channel printhead printing multiple ink colors, several printheads could be provided each printing one or more ink colors.

Each inlet spout 236 is fluidically connected to a corresponding one of the inlet ports 208 of the LCP molding 202. Each outlet spout 238 is fluidically connected to a corresponding one of the outlet ports 210 of the LCP molding 202. Thus, for each ink color, supplied ink is distributed between one of the inlet spouts 236 and a corresponding one of the outlet spouts 238 via a corresponding one of the main channels 206.

Figure 5:
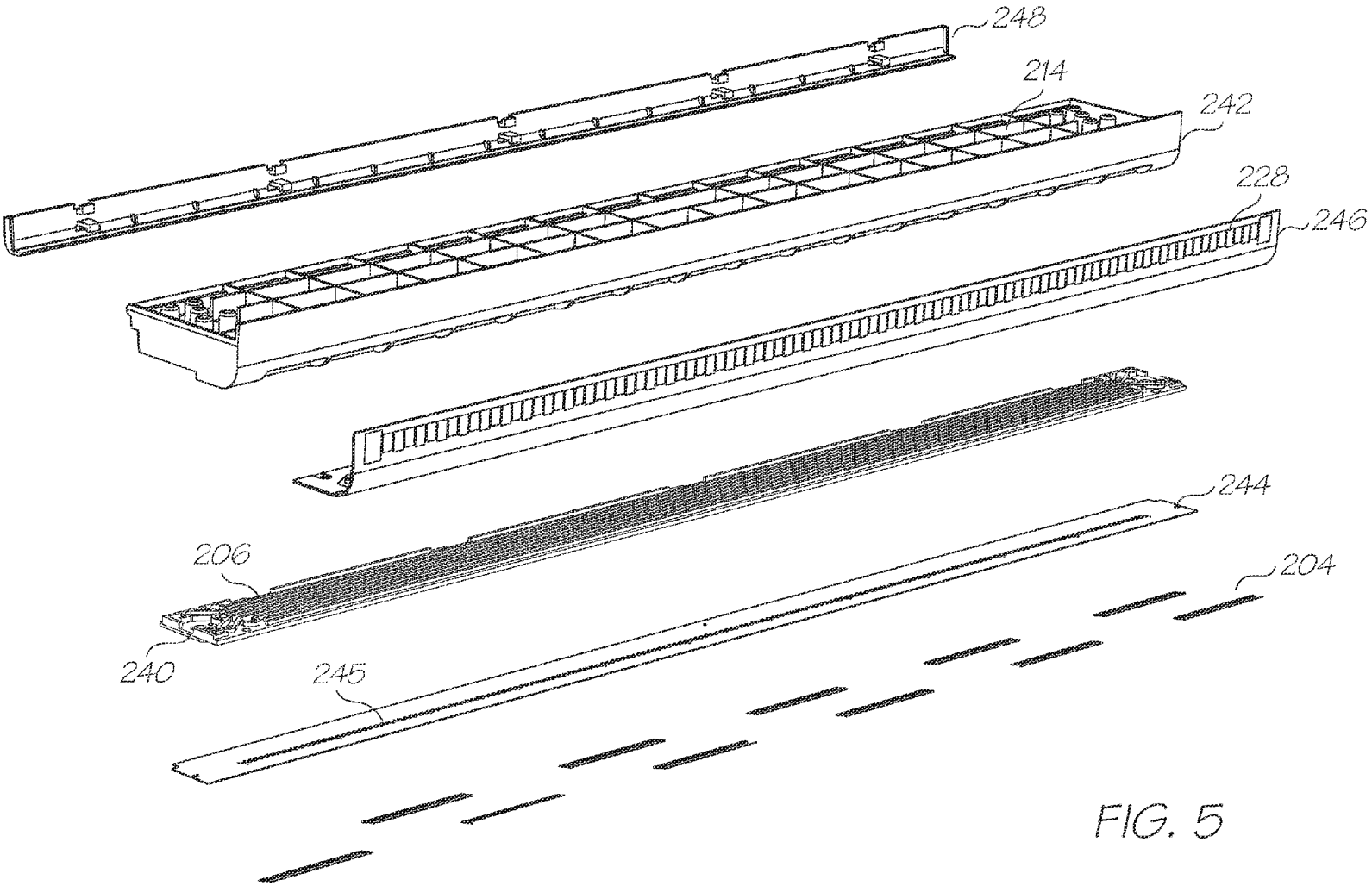
FIG. 5 is an exploded view of the printhead without inlet or outlet couplings.

From FIG. 5 it can be seen that the main channels 206 are formed in a channel molding 240 and the associated air cavities 214 are formed in a cavity molding 242. Adhered to the channel molding 240 is a die attach film 244. The die attach film 244 mounts the printhead ICs 204 to the channel molding 240 such that the fine channels, which are formed within the channel molding 240, are in fluid communication with the printhead ICs 204 via small laser ablated holes 245 through the film 244.

The channel and cavity moldings 240,244 are mounted together with a contact molding 246 containing the electrical contacts 228 for the printhead ICs and a clip molding 248 in order to form the LCP molding 202. The clip molding 248 is used to securely clip the LCP molding 202 to the top molding 216.

LCP is the preferred material of the molding 202 because of its stiffness, which retains structural integrity along the media width length of the molding, and its coefficient of thermal expansion which closely matches that of silicon used in the printhead ICs, which ensures good registration between the fine channels of the LCP molding 202 and the nozzles of the printhead ICs 204 throughout operation of the printhead 200. However, other materials are possible so long as these criteria are met.

Figure 6:
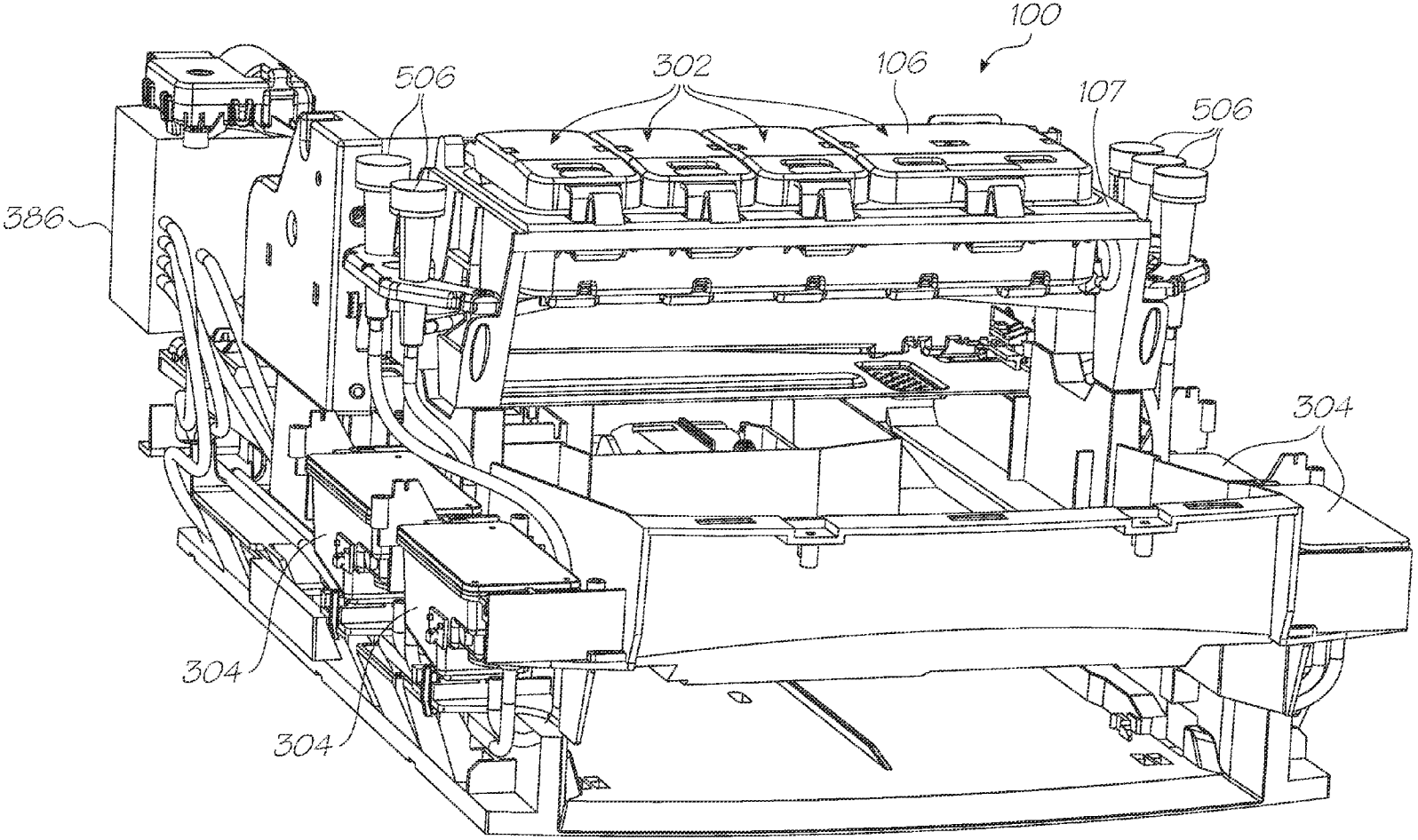
FIG. 6 illustrates an isometric view of the printer with most components other than those of a fluid distribution system for the printer omitted.
Figure 7:
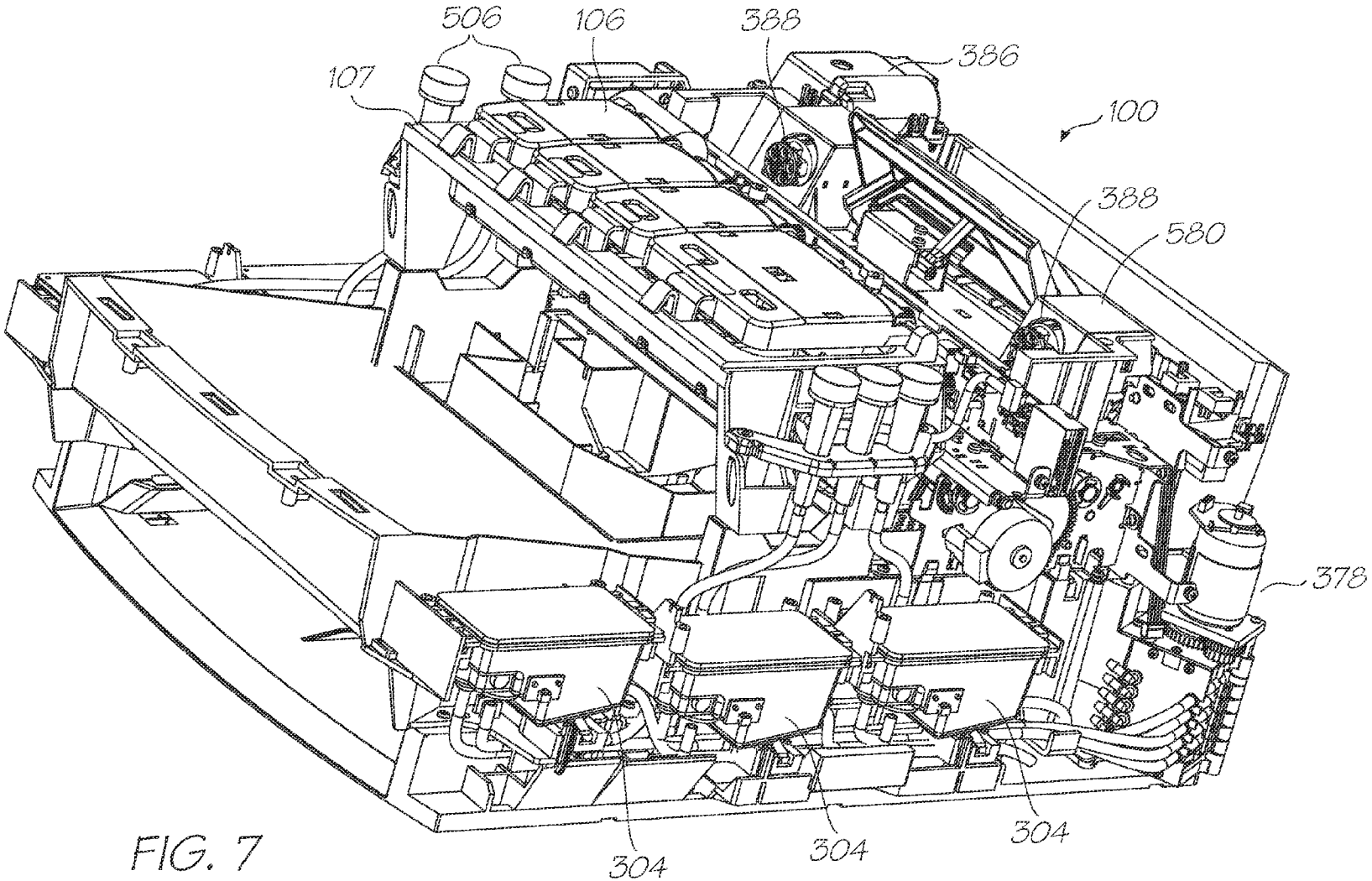
FIG. 7 illustrates an opposite isometric view of the printer as illustrated in FIG. 6.

The fluid distribution system 300 may be arranged as illustrated in FIGS. 6 and 7, which show the printer 100 with most components other than those of the fluid distribution system 300 omitted for clarity. The fluid distribution system 300 is described in detail below.

The maintenance system 600 may be configured as described in US Provisional Patent Application No. 61/345,559.

Figure 8:
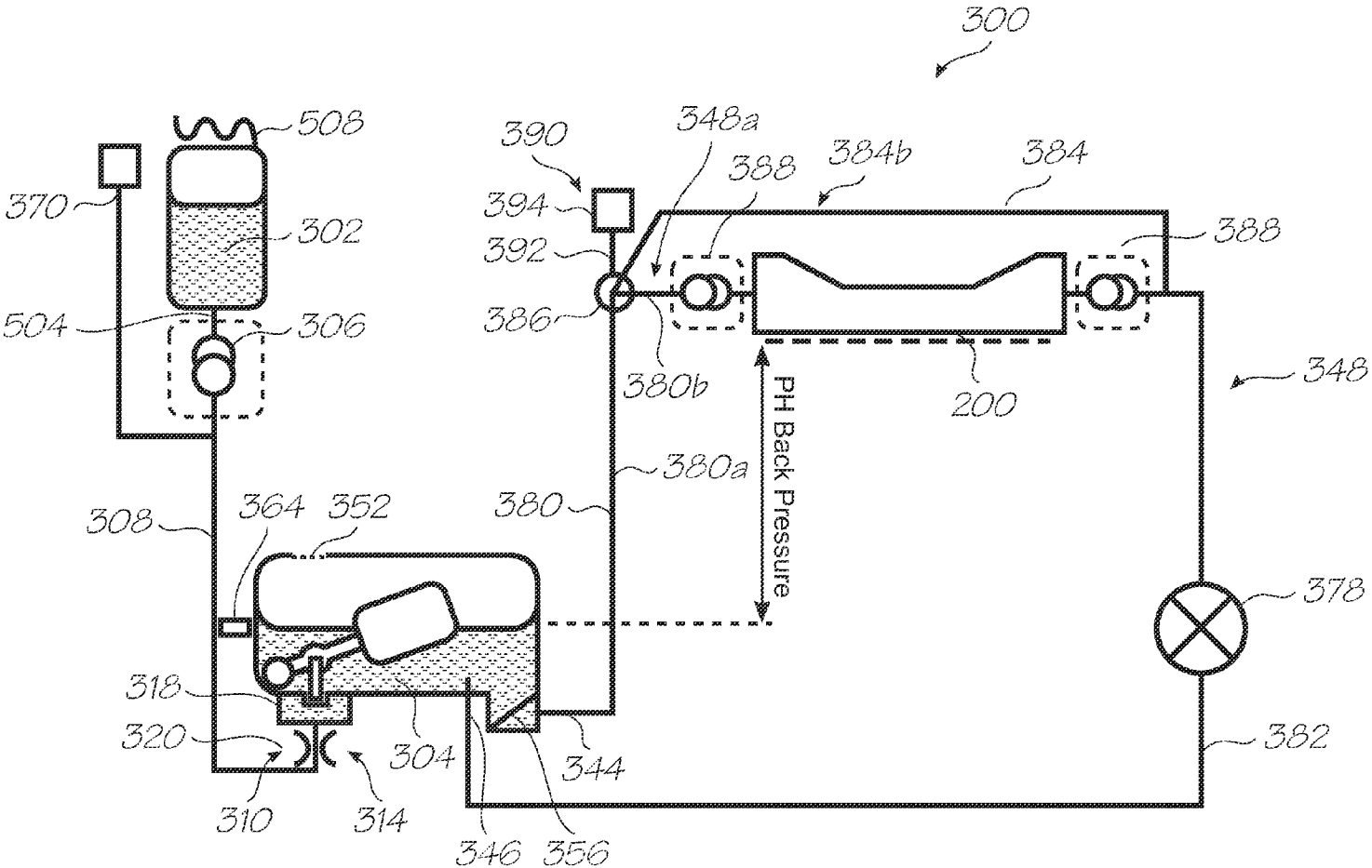
FIG. 8 schematically illustrates one embodiment of the fluid distribution system.
Figure 9:
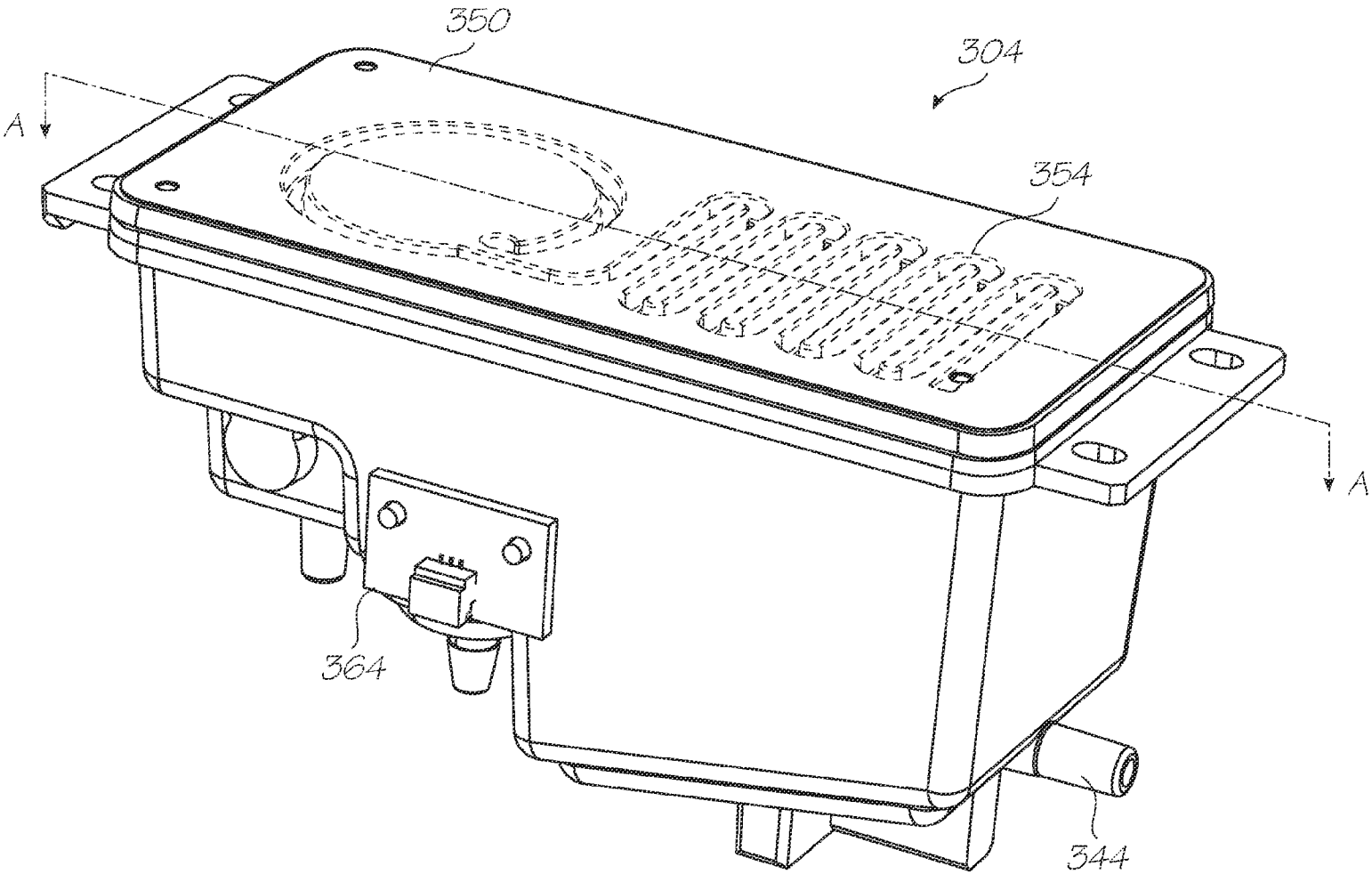
FIG. 9 illustrates an accumulator tank of the fluid distribution system.

One embodiment of the system 300 for distributing ink and other fluids for ejection by the printhead 200 is schematically illustrated in FIG. 8 for a single fluid channel, e.g., a single colored ink or other printing fluid, such as ink fixing agent (fixative). The fluid distribution system 300 of FIG. 8 and its various components are now described in detail.

A first sealed container 302 (herein termed a supply tank) which contains ink or other fluid/liquid for supply to the printhead 200 is coupled to a second sealed container 304 (herein termed an accumulator tank) by a coupling 306 and associated fluid line 308. The fluid line is in the form of tubing, and is preferably tubing which exhibits low shedding and spallation in an ink environment. Thermoplastic elastomer tubing is therefore suitable, such as Tygoprene® XL-60.

The coupling allows releasable engagement of the supply tank 302 in a manner understood by one of ordinary skill in the art. For example, the coupling may be provided in two engageable parts with one part connected to, or part of, the supply tank ('supply side') and the other part connected to the fluid line ('delivery side').

Figure 11:
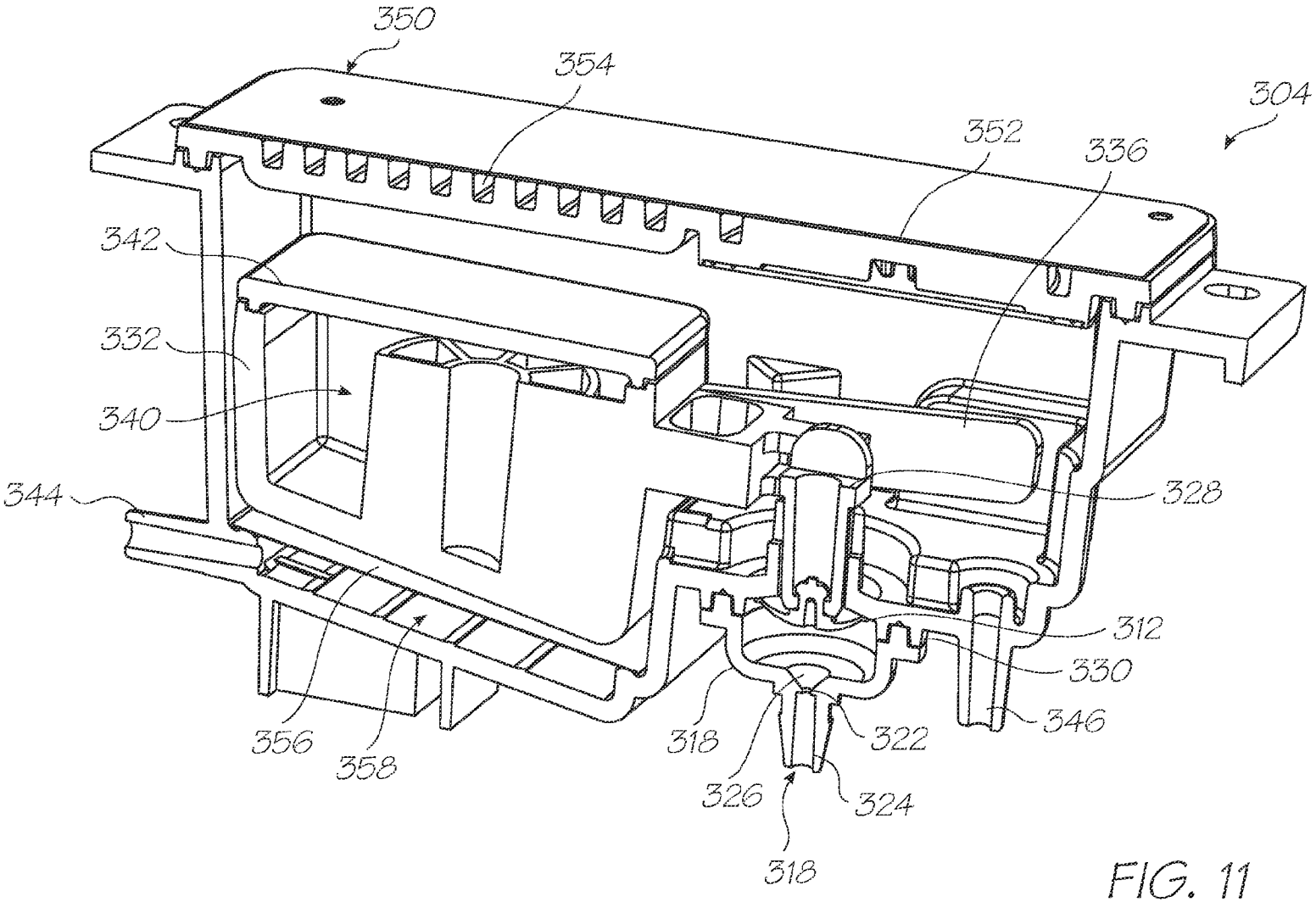
FIG. 11 illustrates a cross-sectional view of the accumulator tank taken through line A-A in FIG. 9.

The fluid line is connected to the accumulator tank 304 via a valve 310. The valve 310 is in the form of an inverted umbrella valve (relative to the orientation illustrated in FIG. 8) which has an umbrella-shaped disc 312 mounted within an inlet 314 on the body 316 of the accumulator tank 304 so that the umbrella-shape is inverted and seals against the inlet. The disc 312 is preferably formed of a resilient material which is inert in an ink environment, such as ethylene propylene diene monomer (EPDM). The disc 312 is enclosed relative to the accumulator tank body by a connector 318 which connects to the fluid line and seals against the accumulator tank body. This arrangement is illustrated in FIG. 11.

Ink is supplied from the supply tank to the accumulator tank through the fluid line in accordance with a position of the umbrella disc relative to the inlet 314. In particular, when the umbrella disc is not sealed against the inlet fluid flows from the supply tank to the accumulator tank. This fluid flow is provided under gravitational pressure by locating the supply tank above the printhead and the accumulator tank so that a positive fluid pressure is present at the inlet 314. On the other hand, when the umbrella disc is sealed against the inlet such fluid flow is prevented.

In order to control the level of positive fluid pressure present at the inlet 314, a restrictor 320 is disposed on the fluid line proximate the inlet 314, as schematically illustrated in FIG. 8. In one example, the restrictor 320 can be provided as a resilient member mounted on the exterior of the fluid line configured to compress the fluid line by an amount which restricts fluid flow therethrough but does not prevent fluid flow.

Alternatively, the connector 318 can incorporate the restrictor by forming an obstruction 322 in a fluid passage 324 of the connector through which fluid from the connected fluid line flows into the connector. In the example illustrated in FIG. 11, the obstruction 322 is a portion of the fluid passage which has an inner diameter less than the inner diameter of the rest of the fluid passage and which opens into a funnel 326.

Figure 12:
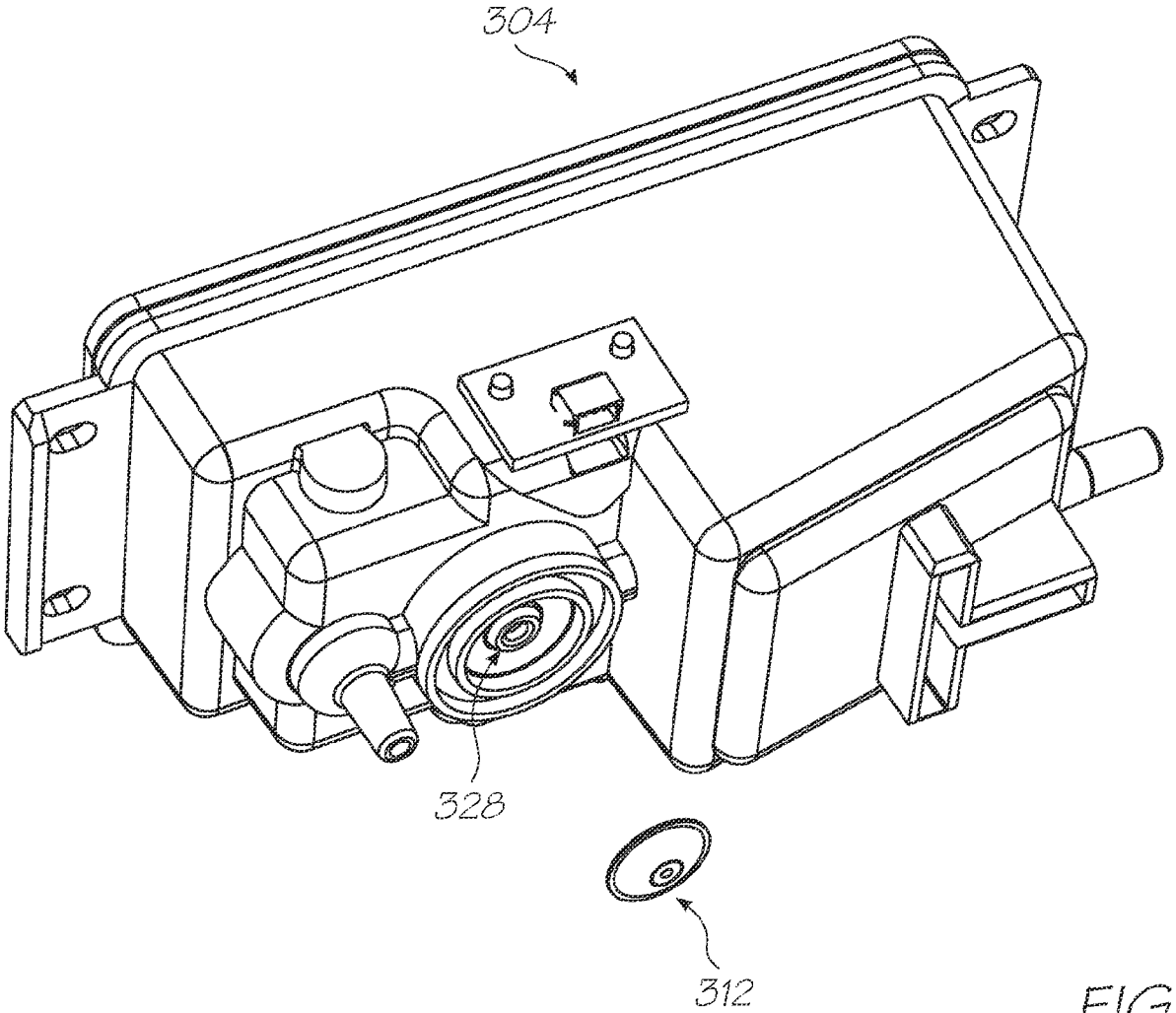
FIGS. 12-14 illustrates an assembly view of a disc and connector components of a valve of the accumulator tank.
Figure 13:
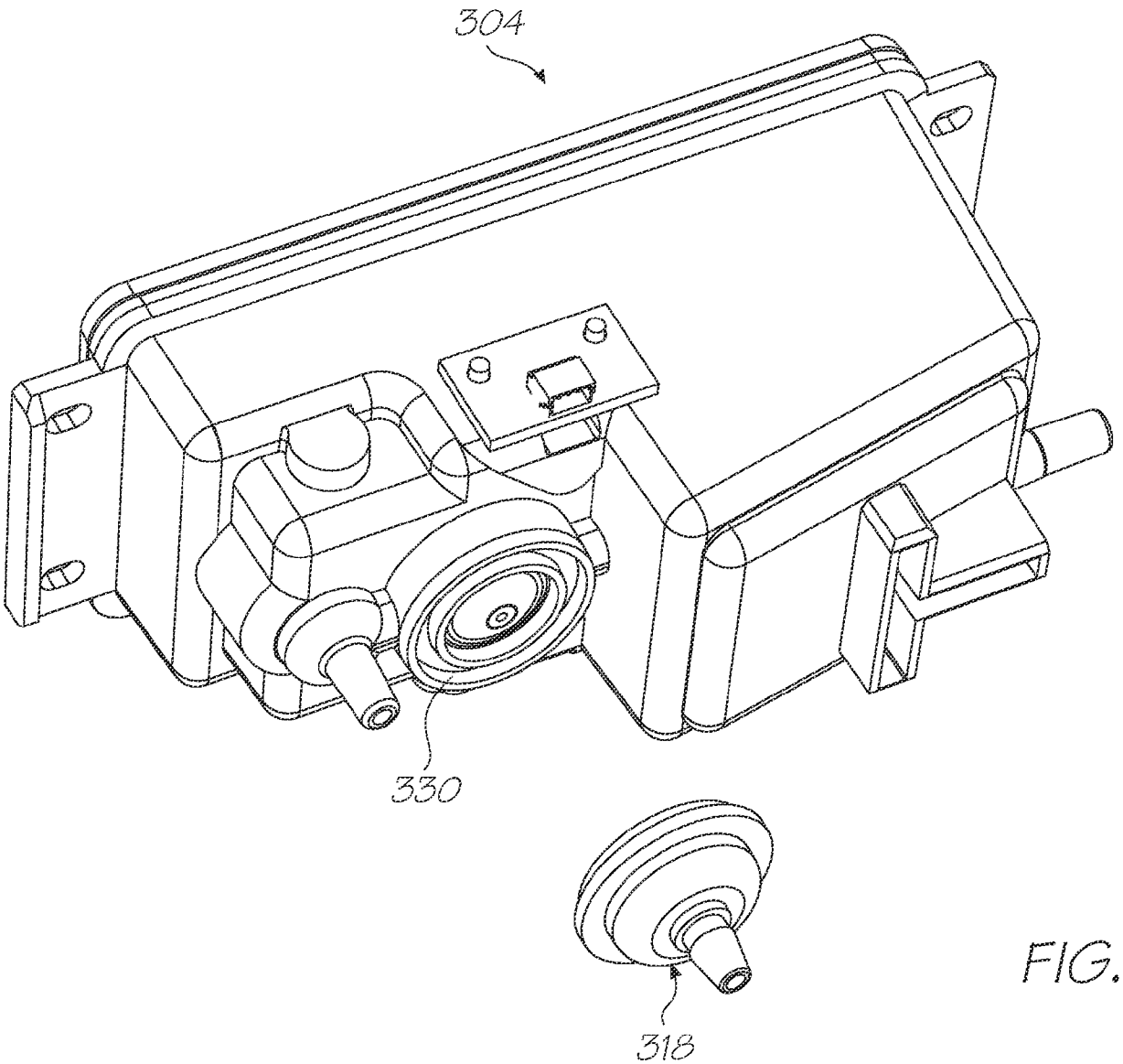
Figure 14:
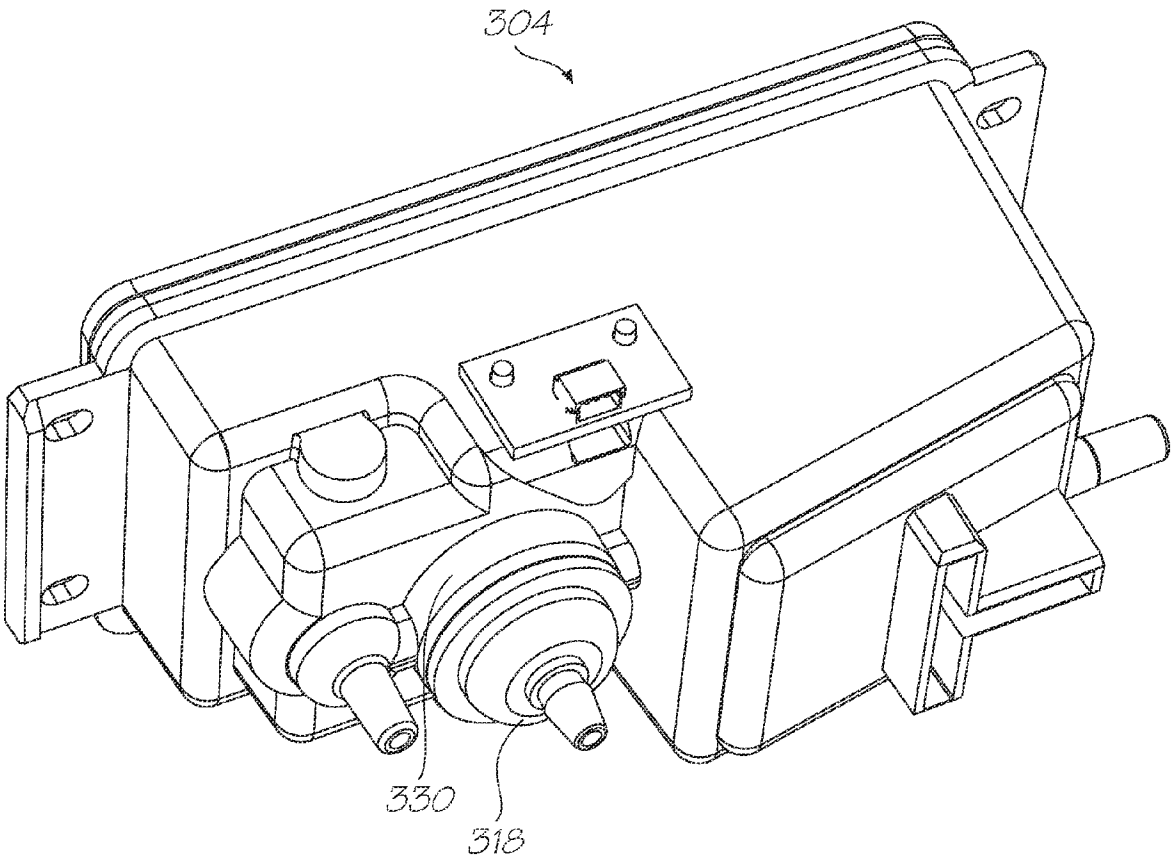

The umbrella valve is operated by means of a valve actuator 328 mounted within the inlet 314. As shown in FIGS. 12-14, the valve actuator is a hollow valve pin 328 which protrudes from the inlet and the umbrella disc 312 is pressed into the valve pin (see also FIG. 11). To complete this assembly, the connector 318 is mounted to a mounting ring 330 on the accumulator tank body. In order to provide a reliable seal, the connector can be ultrasonically welded to the mounting ring.

Figure 15:
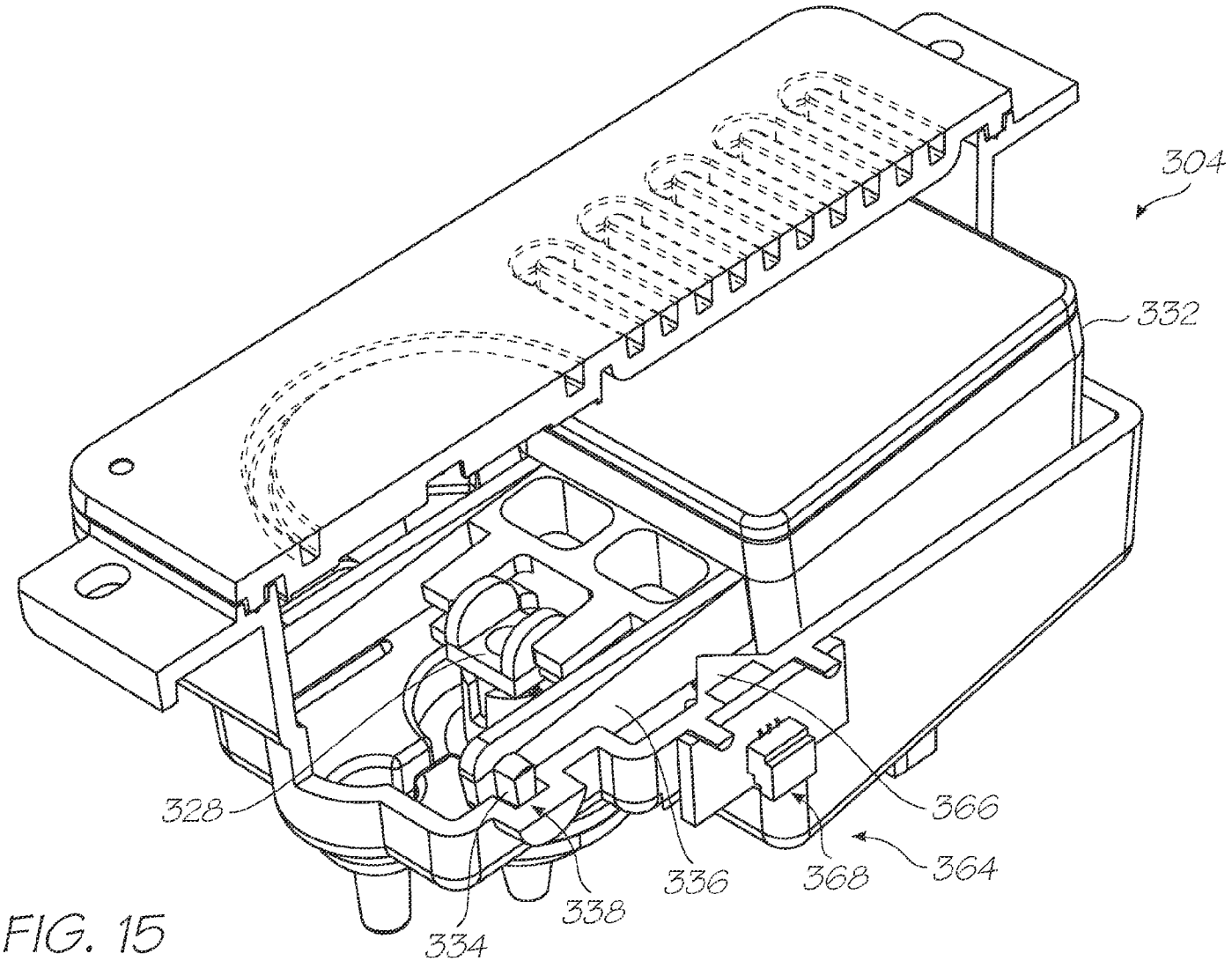
FIG. 15 illustrates a partial sectional view of the accumulator tank.

The valve pin 328 is pivotally mounted to a float member 332 located within the accumulator tank 304. The float in turn has pins 334 on arms 336 which locate within recesses 338 formed in the interior of the accumulator tank body to pivot thereabout. This arrangement for one of the pins 334 is shown in FIG. 15.

Figure 16A:
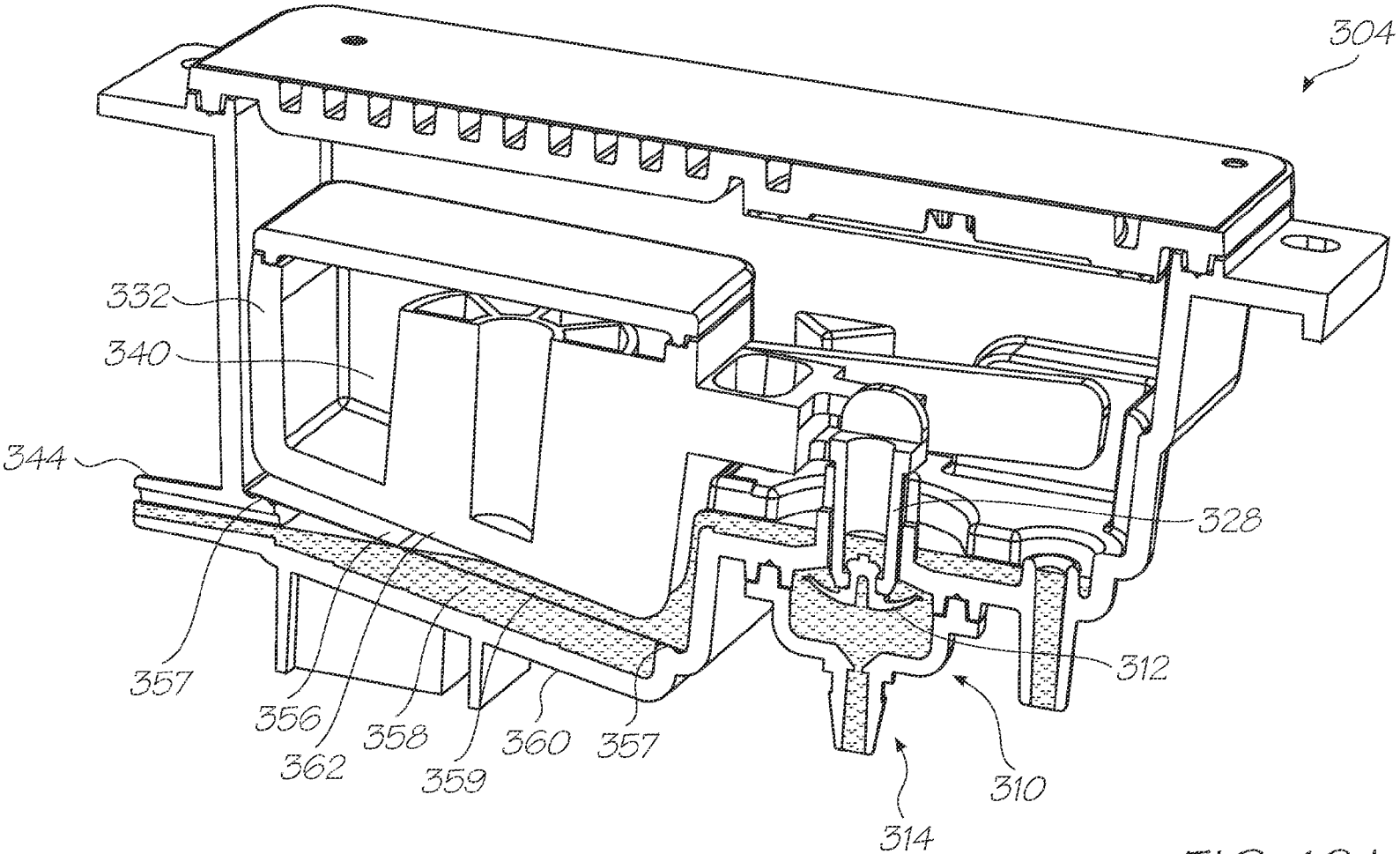
FIGS. 16A to 16C illustrate operation stages of the valve.

By this structure, pivoting of the float relative to the accumulator tank body causes sliding movement of the valve pin within the inlet, which in turn causes the opening and closing of the umbrella valve through movement of the umbrella disc. This operation is shown in FIGS. 16A to 16C.

The pivoting of the float is caused by ink entering the interior of the accumulator tank. In particular, the float is arranged so that when the accumulator tank is empty the umbrella valve is open, as shown in FIG. 12. As ink enters the accumulator through the umbrella valve the ink begins the fill the accumulator tank, as shown in FIG. 16A.

Figure 10:
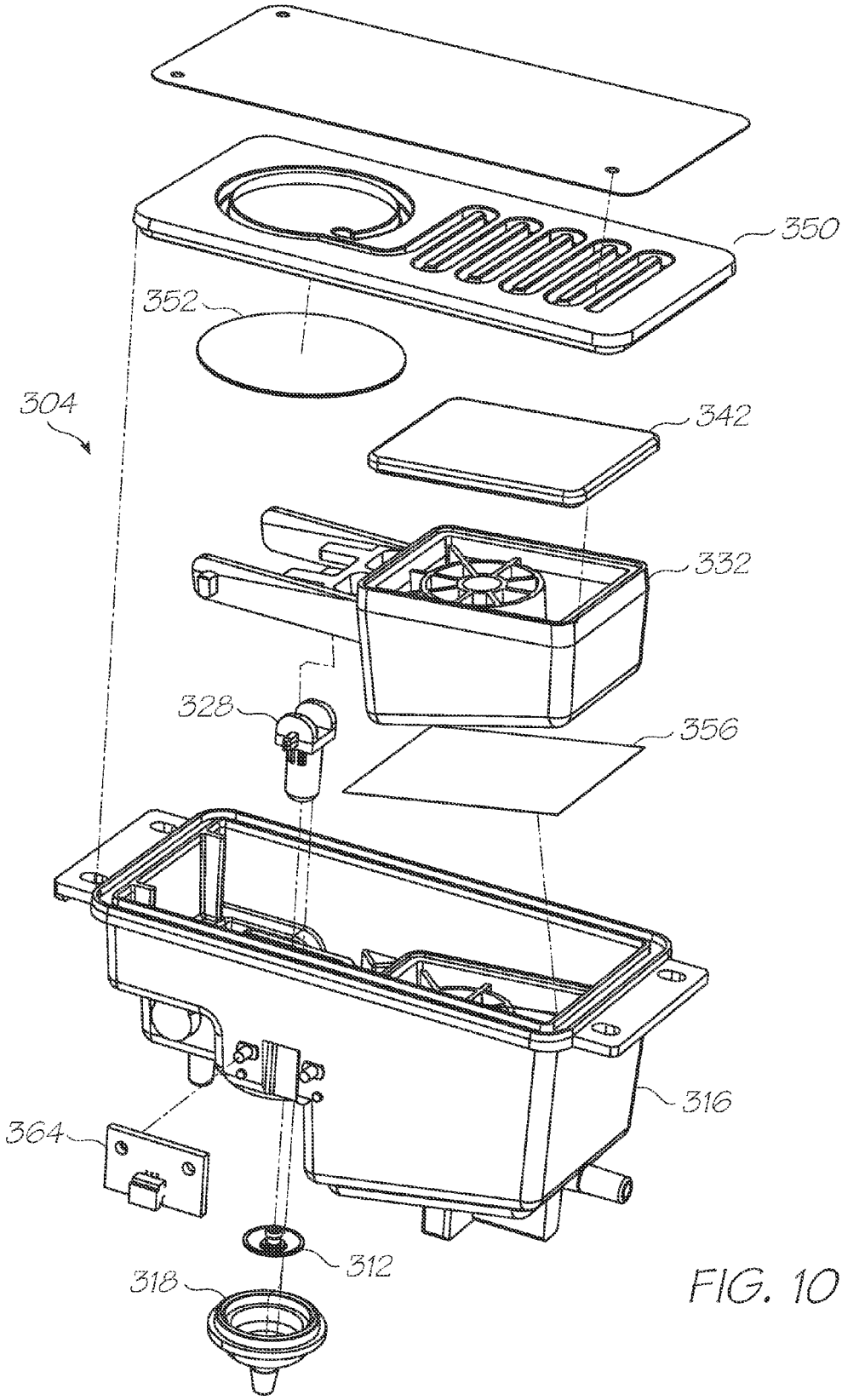
FIG. 10 illustrates an exploded view of the accumulator tank.
Figure 16B:
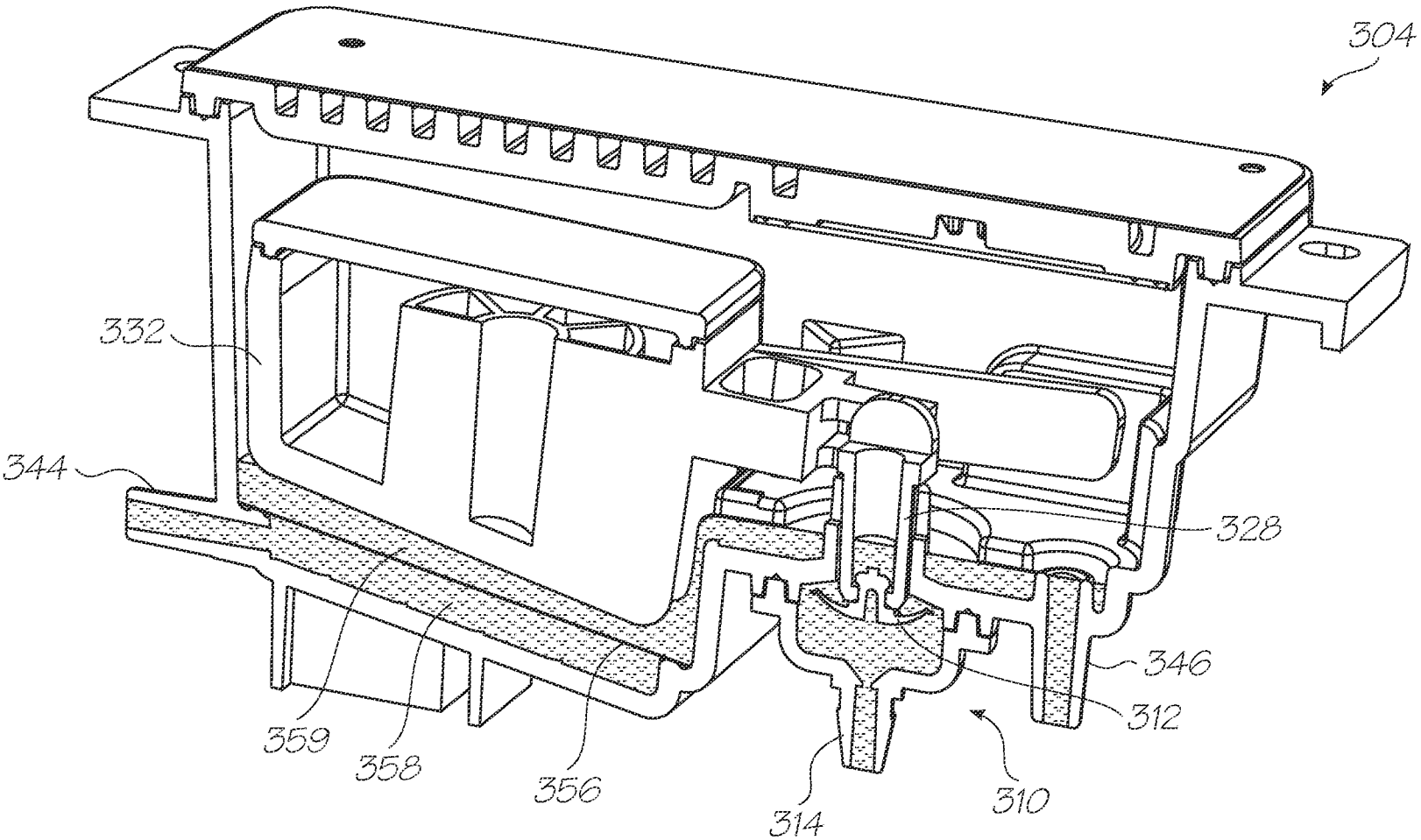

As more ink enters the float begins to pivot upward due to buoyancy of the float, as shown in FIG. 16B. The buoyancy of the float is provided by configuring the float with a hollow interior 340 which is enclosed by a lid 342 so as to contain air within the float (see FIG. 10). One of ordinary skill in the art understands that other configurations of the float are possible to provide buoyancy however.

Figure 16C:
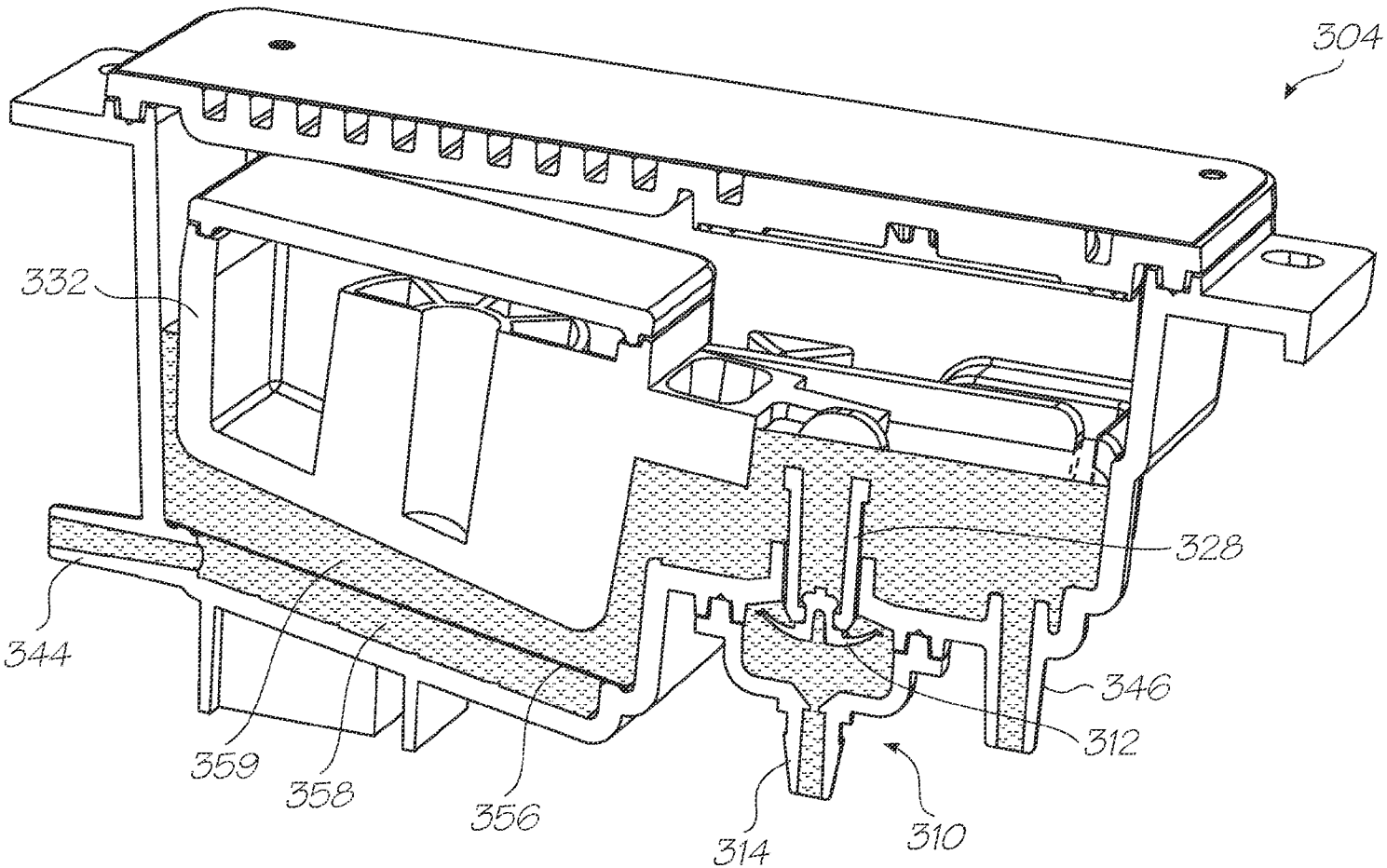

As ink continues to enter the accumulator tank, this upward pivoting of the float continues until the umbrella valve is closed preventing further ink entry, as shown in FIG. 16C. The interior of the accumulator tank and the relative size of the float are configured so that the accumulator tank has a predetermined fluid containing capacity. The use of the float actuated valve in the accumulator tank ensures that whilst sufficient fluid is available at the inlet of the accumulator tank, the accumulator tank contains fluid at a level which consistently fills this predetermined capacity.

The accumulator tank has an outlet 344 and a port 346 through which the fluid contained in the accumulator tank can be drawn in a controlled manner through a closed fluid loop 348 (see FIG. 8) which enables the fluid to be contained in the accumulator tank in a stable manner. This operation is discussed in detail later.

The interior of the accumulator tank is sealed with respect to liquids by a lid 350. The lid 350 incorporates a gas vent 352 and a tortuous liquid path 354 for allowing gases, such as ambient air and internal vapours, to pass into and out of the accumulator tank. This arrangement allows the internal gas pressure of the accumulator tank to be equalized to external ambient conditions.

The gas vent 352 is formed with a hydrophobic material which ensures that liquid is retained in the interior whilst allowing gas transit. Preferably, the hydrophobic material of the gas vent 352 is expanded polytetrafluoroethylene (ePTFE, known as Gore-Tex® fabric) which has these gas transit properties. The use of the term "hydrophobic" is to be understood as meaning that any liquid, not only water, is repelled by the material which is said to be "hydrophobic".

The accumulator tank, including the lid 350, is preferably formed of a material which is inert in ink environments, has a low water vapor transmission rate (WVTR) and can allow ultrasonic welding of connected components, such as the connector 318 and the lid 350. Such a material is polyethylene terephthalate (PET). The float 332, including the lid 342, is preferably formed of a material which is inert in ink, can be ultrasonically welded, and is not susceptible to sympathetic ultrasonic welding when the lid 350 is ultrasonically welded to the body 316 of the accumulator tank. Such a material is a combination of polyphenylene ether and polystyrene, such as Noryl 731.

A filter 356 is located at the outlet 344 of the accumulator tank so that the ink contained in the accumulator tank passes through the filter before exiting through the outlet 344 and ultimately to the printhead 200 through the closed loop 348. The filter 356 is used to filter contaminants from the ink so that the ink reaching the printhead 200 is substantially contaminant-free. The filter is formed of a material which allows fluid transfer through the filter but prevents particulate transfer and is compatible with ink. Preferably, the filter is a polyester mesh having a pore size of one micron. Such a mesh filter 356 is preferably mounted on a flange 357 within the accumulator tank by heat staking or the like.

Providing the accumulator tank with an internal filter obviates the need for filtration within the closed fluid path loop 348 which incorporates the printhead 200, as will be discussed later.

As illustrated schematically in FIG. 8, the filter 356 is preferably arranged in the accumulator tank to be below the inlet 314 and to be at an angle relative to the outlet 344 with the lower side of the filter 356 at the inlet 314 side (i.e., at the right in FIG. 16A) and the higher side of the filter 356 at the outlet 344 side (i.e., at the left in FIG. 16A). This arrangement forms a filter compartment 358 comprising the walls of the accumulator tank below the filter 356 and the inclined angle assists in removing air locks within the accumulator tank for reliable and efficient delivery of fluid to the printhead 200.

That is, when the accumulator tank is empty, as ink 359 begins to enter the accumulator tank the filter 356 is wetted from lower side to the higher side so that any air in the filter compartment 358 is trapped beneath the wetted filter 356 and is purged from the filter compartment 358 through the outlet 344 and into the closed loop 348. This air in the closed loop 348 is purged from the fluid distribution system 300 in a number of ways which are discussed in detail later.

This gas purging through the outlet 344 is enhanced by forming the lower wall 360 of the accumulator tank to be substantially parallel to the filter 356 with the outlet 344 at the higher side of the angled lower wall 360. This allows ink to fill the filter compartment 358 from the lower side to the higher side thereby pushing air up the inclined slope of the lower wall 360 and along the underside of the wetted filter 356 to be purged from the outlet 344.

The angle of the filter 356, and lower wall 360, is preferably about 10 degrees from the horizontal. As seen in FIGS. 16A to 16C, the lower wall 362 of the float 332 is also angled to conform with the angle of the filter 356, which assists in the floating operation of the float 332.

Providing the filter compartment 358 below the filter 356 and the inlet 314 of the accumulator tank keeps fluid within this filter compartment 358 during normal use, which assists in preventing air re-entering this space and causing air locks. Further, the skewed profile of the filter compartment 358 assists in purging air from this space which may enter due to movement of the printer 100 and therefore the accumulator tank.

The amount of fluid within the accumulator tank is monitored by a sensing arrangement 364. The sensing arrangement 364 senses the level of fluid contained within the accumulator tank and outputs the sensing result to the control electronics 802 of the printer 100. For example, the sensing result can be stored in a quality assurance (QA) device of the accumulator tank which interconnects with a QA device of the control electronics 802, as described in previously referenced and incorporated US Patent Application Publication No. 20050157040.

Figure 17:
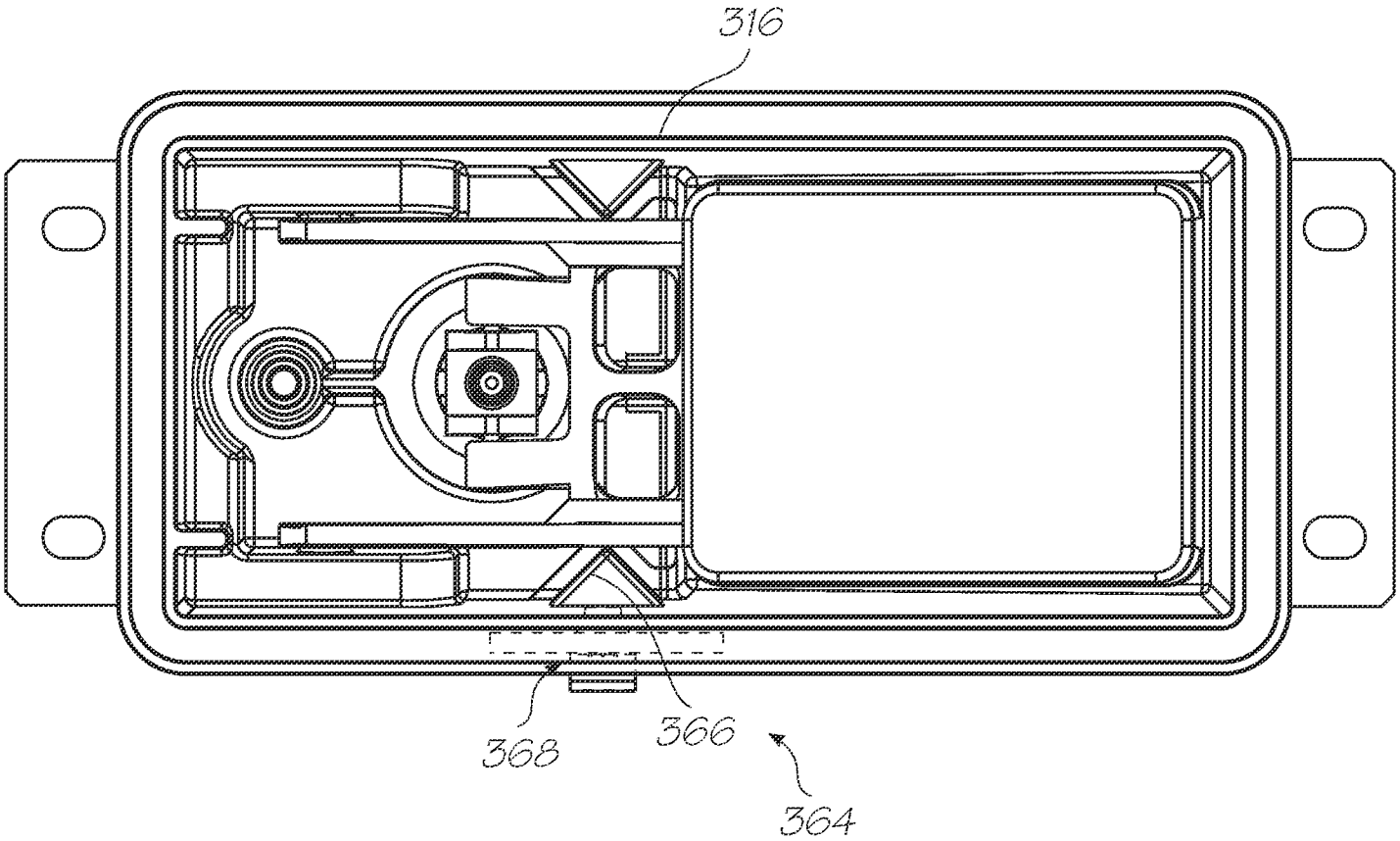
FIG. 17 illustrates a sensing arrangement of the accumulator tank.

An exemplary configuration of the sensing arrangement 364 is illustrated in FIGS. 15 and 17. In this example, the sensing arrangement 364 has a prism 366 incorporated within the body 316 of the accumulator tank at a position which accords to a fluid level providing the predetermined fluid containing capacity of the accumulator tank. The sensing arrangement 364 further has a sensor 368 mounted on the body 316 adjacent the prism 366. The sensor 368 emits light of a certain wavelength into the prism 366 and detects returning light and the wavelength of the returning light.

When fluid is present in the accumulator tank at the level providing the predetermined fluid containing capacity (herein termed "full level"), the light emitted by the sensor 368 is refracted by the prism 366 back to the sensor 368 as returning light at a first wavelength. In this case, the sensor 368 provides a signal which indicates a "full" fluid level to the control electronics 802.

When fluid is present in the accumulator tank at a first level less than the full level (herein termed the "low level"), the light emitted by the sensor 368 is refracted by the prism 366 back to the sensor 368 as returning light at a second wavelength different than the first wavelength. In this case, the sensor 368 provides a signal which indicates a "low" fluid level to the control electronics 802.

When fluid is present in the accumulator tank at a second level less than the first level (herein termed the "out level"), the light emitted by the sensor 368 passes through the prism 366 such that no returning light is sensed by the sensor 368. In this case, the sensor 368 provides a signal which indicates an "out" fluid level to the control electronics 802.

As discussed above, whilst ink is available for supply from the supply tank to the accumulator tank, the level of ink in the accumulator tank is maintained at a substantially constant level by the float activated valve, i.e., the full level, which also serves to effectively isolate the supply tank from the printhead. That is, as schematically illustrated in FIG. 8 and diagrammatically illustrated in FIGS. 6 and 7, the supply tank is positioned above the printhead and the accumulator tank, which results in positive fluid pressure at the inlet 314 of the accumulator tank, as discussed above. Further, as illustrated, the accumulator tank is positioned below the printhead. By this arrangement, the fluid pressure difference between the accumulator tank and the printhead is independent of the fluid pressure difference between the supply tank and accumulator tank. Negative fluid pressure at the nozzles of the printhead, which prevents ink leakage from the nozzles, is also provided by this arrangement. Furthermore, this negative fluid pressure is maintained during ordinary operation of the printer by maintaining the substantially constant level of ink in the accumulator tanks.

When the supply tank is depleted of ink, the drawing of ink from the accumulator tank into the closed loop 348 reduces the level of ink within the accumulator tank from the full level to the low level and then the out level. Relaying of this ink level reduction to the control electronics 802 allows printing by the printhead 200 to be controlled to eliminate low quality prints, such as partially printed pages and the like.

For example, at the full indicator, the control electronics 802 allows normal printing to be carried out. At the low ink level indicator, the control electronics 802 allows reduced capacity printing to be carried out, such as subsequent printing of only a certain number of pages of certain ink quantity requirements. And at the out level indicator, the control electronics 802 prevents further printing until the supply tank is refilled or replaced with a full tank, such as through prompting of a user of the printer 100.

The out fluid level is set to be an amount below the full fluid level which retains fluid within the accumulator tank, rather than letting the accumulator tank empty completely. For example, the full level is set at about 19 to 22 milliliters, the low level is set at about 13 milliliters, and the out level is set at about 11 milliliters. This lower fluid level causes the umbrella valve 310 to open slightly but since the supply tank and the fluid line 308 are higher than the accumulator tank positive fluid pressure is retained at the umbrella valve 310 and ink does not leak from the fluid line 308.

This ensures that the closed fluid path loop 348 and the printhead 200 remains primed with ink, which eliminates the re-introduction of air into the system. The priming and de-priming of the fluid distribution system 300 is described in detail later. This also allows the fluid pressure difference between the accumulator tank and the printhead to be constrained within a tolerable range for maintaining the necessary negative fluid pressure at the nozzles of the printhead discussed above.

When the out fluid level is reached, replacement or refilling of the supply tank is necessary to re-establish ink supply. In the example shown in the drawings, the supply tank is replaced by de-coupling the supply tank from the coupling 306 and then coupling either a new supply tank at full ink capacity or the same supply tank which has been refilled to full ink capacity. Alternatively, the coupling 306 may be provided as a valve which is closed during refilling of the supply tank, such that the supply tank is not physically removed from the system 300 and can be refilled in situ.

This process is assisted by maintaining ink within coupling 306 when the supply tank is emptied and then removed so that air locks are not present when the supply tank is re-coupled, which would hamper re-priming of the fluid line 308. Ink is maintained in the coupling 306 by locating a gas vent 370 (termed herein as "air chimney") on the fluid line 308 between the coupling 306 and the accumulator tank 304.

Figure 18:
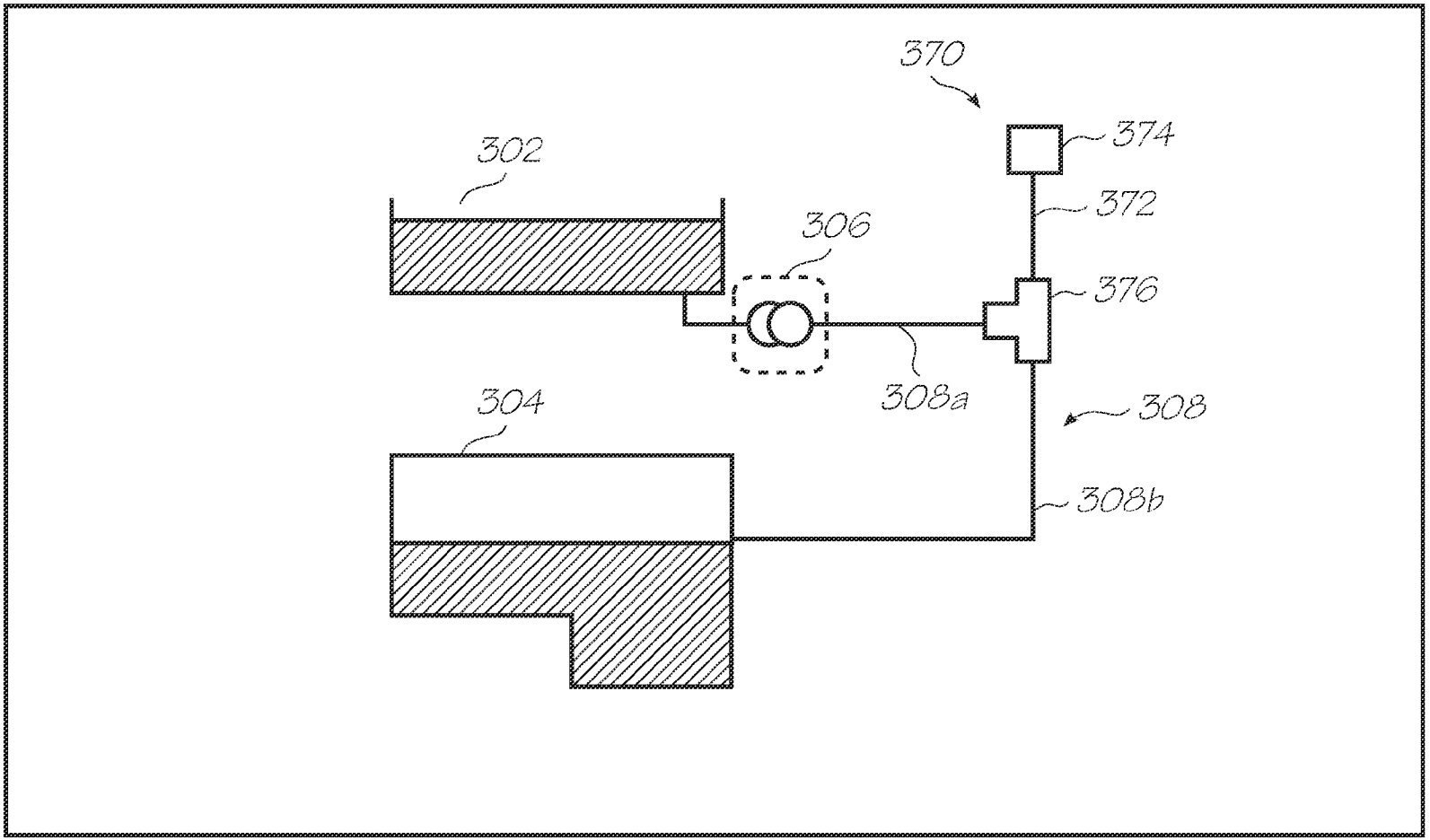
FIG. 18 illustrates an air chimney arrangement of the accumulator tank.

The air chimney 370 incorporates a vent line 372 and a filter 374. The vent line 372 has one end connected to the fluid line 308 by a connector 376 and has the filter 374 disposed at the other end. As such the fluid line 308 has a portion 308*a* between the coupling 306 and the connector 376 and a portion 308*b* between the connector 376 and the accumulator tank 304, as schematically illustrated in FIG. 18.

The vent line 372 is preferably vertically disposed, as is the portion 308*b* of the fluid line 308, and the portion 308*a* of the fluid line 308 is preferably horizontally disposed so that fluid within the fluid line 308 is discouraged from entering the vent line 372 and so that when the supply tank empties of ink reduced ink pressure occurs in the fluid line 308 at the connector 376 which causes air to rush into the portion 308*b* of the fluid line 308 from the air chimney 370. This in-rush of air leaves the portion 308*a* of the fluid line 308 primed with ink when the supply tank is de-coupled.

When the supply tank is re-coupled or refilled in situ, the ink pressure at the connector 376 increases causing ink to be drawn into the portion 308*b* of the fluid line 308 and a predetermined amount of ink is drawn from the outlet 344 of the accumulator tank by operation of a pump 378 on the closed loop 348 (see FIG. 8) so as to draw the ink in the fluid line 308 into the accumulator tank through the open umbrella valve 310 pushing the air into the accumulator tank which is vented through the gas vent 352 of the accumulator tank. This operation ensures that the fluid line 308 is fully primed with ink so that no air is present in the fluid line during printing. Operation of the pump 378 is further discussed later.

By disposing the air chimney 370 at the intersection of the fluid line 308 where the horizontal portion 308*b* becomes the vertical portion 308*a* air bubbles induced at the coupling 306 are able to vent out of the fluid line 308, which prevents air locks in the system 300.

The filter 374 of the air chimney 370 is preferably formed of a hydrophobic material, such as ePTFE, so that air exclusive of water vapor and the like is able to enter the vent line 372 from the ambient environment.

The closed loop 348 provides a fluid path between the accumulator tank and the printhead 200. This fluid path is provided as a closed loop so that fluid can be primed into the fluid path and the printhead from the accumulator tank, the primed fluid can be printed by the printhead and the fluid can be de-primed from the printhead and the fluid path back to the accumulator tank so that de-primed fluid is not wasted, which is a problem with conventional fluid distribution systems for printers. The closed loop 348 also allows periodic recirculation of fluid within the fluid distribution system 300 to be carried out so that the viscosity of the fluid, such as ink, is retained within specified tolerances for printing.

In the embodiment of FIG. 8, the closed loop 348 is comprised of plural fluid lines. A print fluid line 380 is provided between the accumulator tank outlet 344 and the printhead 200. A pump fluid line 382 is provided between the printhead 200 and the accumulator tank priming port 346. A bypass fluid line 384 is provided connecting the print and pump lines independent of the printhead 200. By the arrangement of these fluid lines, the closed loop 348 actually constitutes two interconnected closed loops: a printhead loop 348*a*; and a bypass loop 348*b*.

The fluid lines of the closed loop 348 are in the form of tubing, and are preferably tubing which exhibits low shedding and spallation in an ink environment. Thermoplastic elastomer tubing is therefore suitable, such as Norprene® A-60-G. The combined length of the fluid lines is preferably about 1600 to about 2200 millimeters and the internal diameter of the tubing is preferably about 3 millimeters, providing a combined fluid volume of about 14 to 19 millimeters. The pump 378 is preferably a peristaltic pump so that contamination of the pumped ink is prevented and so that pumping amounts of about 0.26 milliliters per revolution of the pump are possible. However, one of ordinary skill in the art understands that other fluid lines dimensions and types of pumps can be used.

On one side of the printhead 200 (i.e., at the right side in FIG. 8, herein termed "pump side") the pump and bypass lines are interconnected by a connector (not shown). At the other side of the printhead 200, the print and bypass lines are interconnected by a multi-path valve 386 on the print line. The valve 386 also interconnects portions 380*a* and 380*b* of the print line with the portion 380*a* being between the accumulator tank 304 and valve 386, and the portion 380*b* being between the accumulator tank 304 and a fluid supply coupling 388, as illustrated in FIG. 8. Another supply coupling 388 is disposed on the pump side of printhead 200 at which the pump line terminates.

In the example shown in FIG. 8, the valve 386 further interconnects a gas vent 390 (herein termed "de-prime vent") to the print and bypass lines. The de-prime vent 390 incorporates a vent line 392 and a filter 394. The vent line 392 has one end connected to the valve 386 and has the filter 394 disposed at the other end.

The valve 386 is a 4-way valve having four ports, termed herein as the "air", "printhead", "bypass" and "ink" ports. The air port is connected to the vent line 392, the printhead port is connected to the print line portion 380*b*, the bypass port is connected to the bypass line 384, and the ink port is connected to the print line portion 380*a*. These ports of the 4-way valve 386 are selectively opened and closed to provide selective interconnection of, and fluid flow between, the multiple fluid paths for priming, printing and de-priming procedures for the fluid distribution system 300.

The states of the ports of the valve 386 are shown in Table 1. In Table 1, an "O" indicates that the associated port is open and a blank indicates that the associated port is closed.

TABLE 1

| 4-way valve states | | | | |
|---|---|---|---|---|
| STATE | AIR | PRINTHEAD | BYPASS | INK |
| PRIME 1 | | | ○ | ○ |
| PRIME 2 | | ○ | | ○ |
| PRINT | | ○ | ○ | ○ |
| STANDBY | | ○ | ○ | ○ |
| PULSE | | ○ | ○ | |
| DEPRIME 1 | ○ | | ○ | |
| NULL | | | | |
| DEPRIME 2 | ○ | ○ | | |

The manner in which these state settings of the valve 386 are used is now discussed with respect to the schematic outlay illustrated in FIG. 8.

Figure 19:
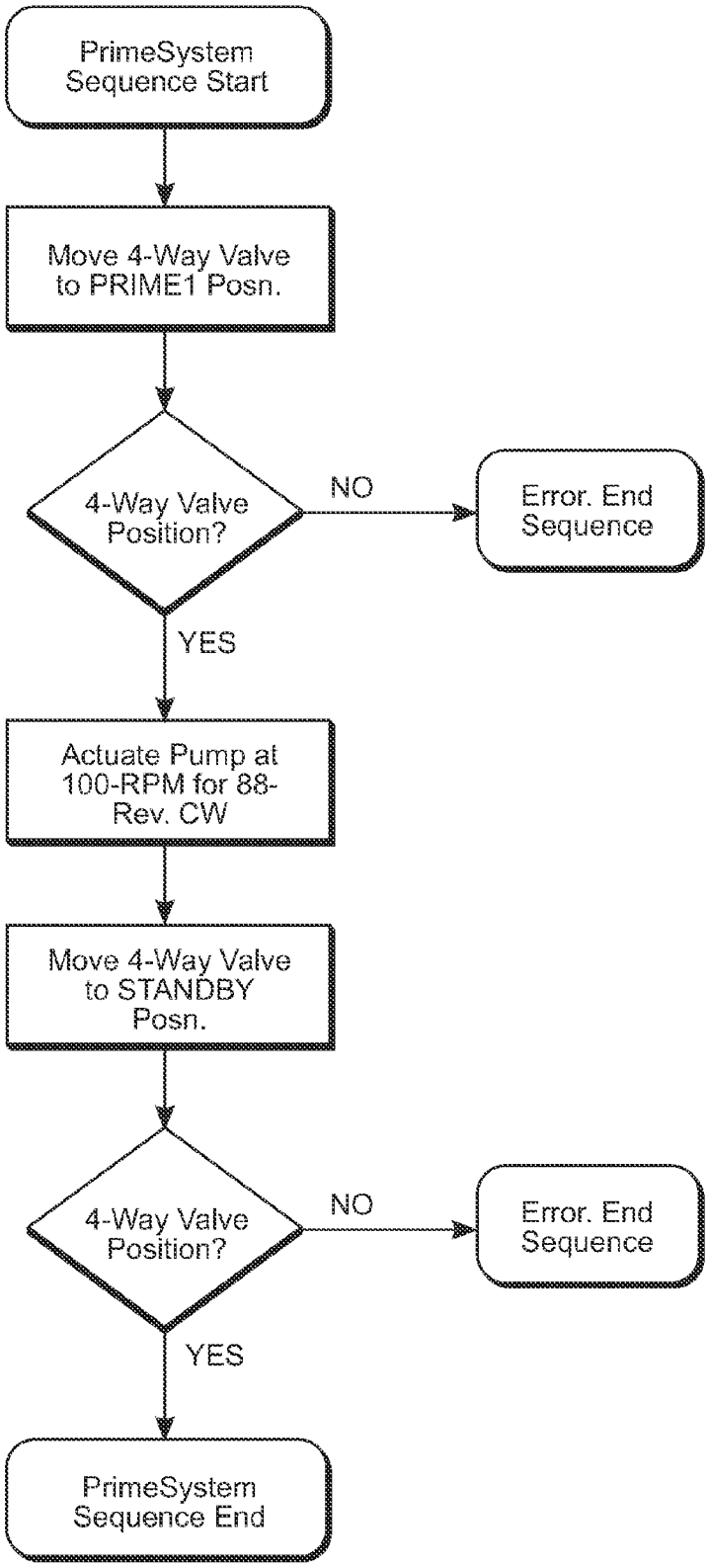
FIG. 19 illustrates a power up priming procedure of the fluid distribution system.

At the first power up of the printer 100, the fluid distribution system 300, excluding the printhead 200, is primed and it is ensured that the pump 378 is fully wetted prior to beginning any further volumetric pumping procedures. As is illustrated in FIG. 19, in this power up priming procedure the valve 386 is set to PRIME 1 and the pump is operated in the clockwise direction for 88 revolutions at 100 rpm so that ink is moved from the accumulator tank outlet 344 to the accumulator tank priming port 346 via the print line portion 380*a*, bypass line 384 and pump line 382 priming the bypass loop 384*b*. Then, the valve 386 is set to STANDBY.

Figure 20:
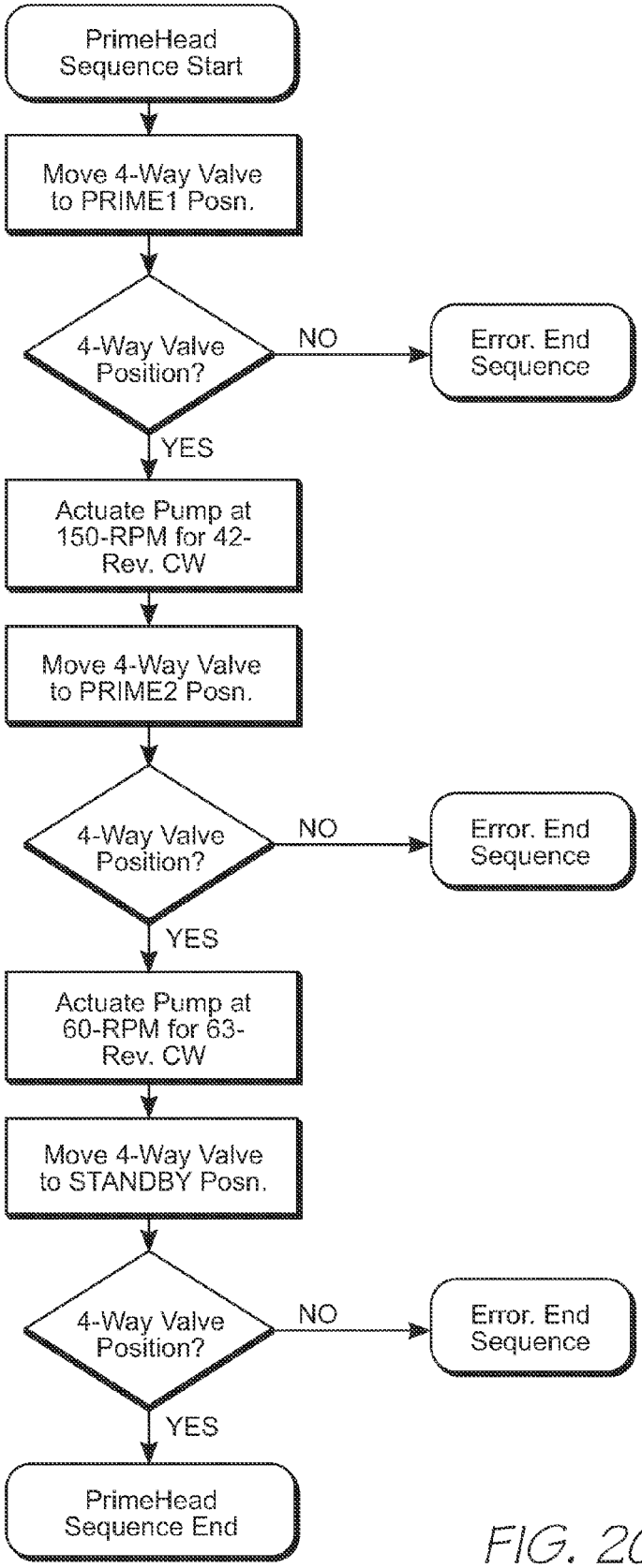
FIG. 20 illustrates a priming procedure of the fluid distribution system.

At times subsequent to first power up of the printer 100 when priming is required, the bypass line 384 and the printhead are primed in sequence. As is illustrated in FIG. 20, in this priming procedure the valve 386 is first set to PRIME 1 and the pump is operated in the clockwise direction for 42 revolutions at 150 rpm so that ink is moved from the accumulator tank outlet 344 to the end of the bypass line 384. Then, the valve 386 is set to PRIME 2 and the pump is operated in clockwise direction for the 63 revolutions at 60 rpm so that the printhead is primed with ink and air that was in the printhead is displaced to the accumulator tank 304 via the priming port 346. Then, the valve 386 is set to STANDBY.

When printing is to be carried out, the valve 386 is set to PRINT and ejection of ink from the nozzles causes ink flow from the accumulator tank to the printhead via the print line 380. After printing, the valve 386 is set to STANDBY. Allowing fluid flow through the bypass line 384 and through the printhead 200 from the side of the printhead connected to the print line 380 (i.e., at the left side in FIG. 8, herein termed "supply side") to the pump side, provides uniform fluid pressure across the printhead during printing. This uniform fluid pressure ensures that fluid is delivered to each nozzle of the printhead at substantially the same fluid pressure which enables substantially constant print quality across the media width of the printhead.

Figure 21:
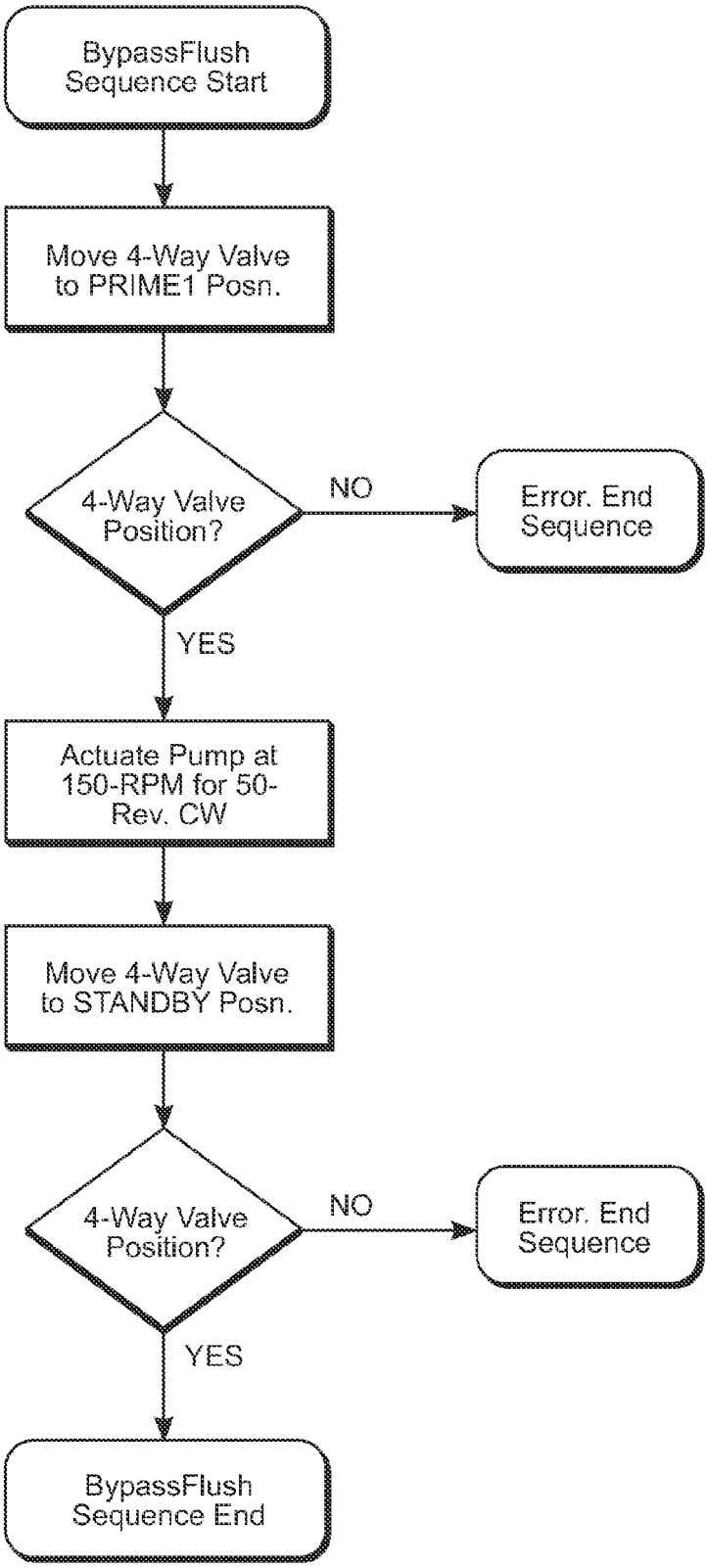
FIG. 21 illustrates a bypass flush procedure of the fluid distribution system.

At times it is necessary to flush gas bubbles that might form in the bypass line 384 over time. As is illustrated in FIG. 21, in this bypass flush procedure the valve 386 is first set to PRIME 1 and the pump is operated in the clockwise direction for 50 revolutions at 150 rpm to move any gas bubbles to the accumulator tank via the priming port 346. Then, the valve 386 is set to STANDBY.

Figure 22:
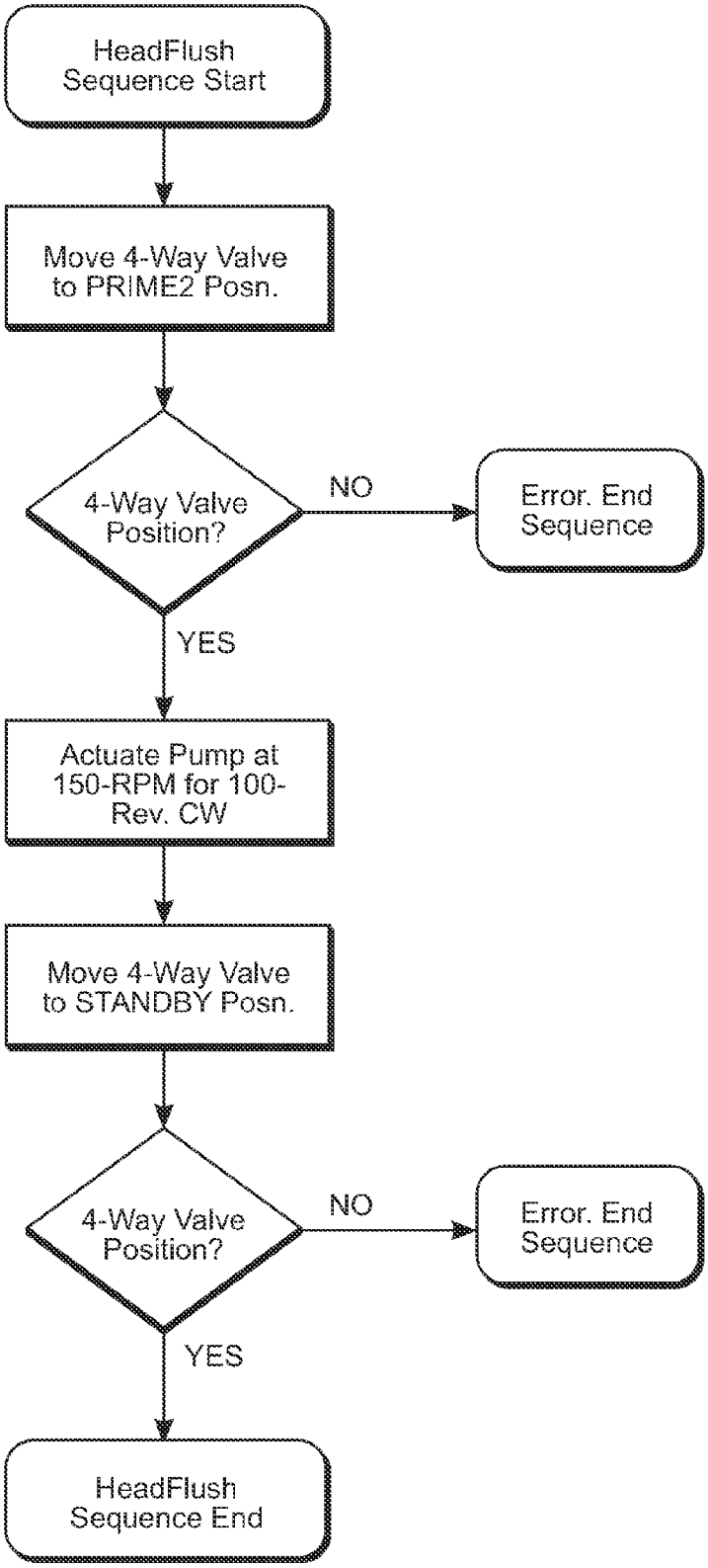
FIG. 22 illustrates a printhead flush procedure of the fluid distribution system.

At times it is necessary to recover the printhead from mild dehydration of ink at the nozzles as well to flush back channel gas bubbles from the printhead. As is illustrated in FIG. 22, in this printhead flush procedure the valve 386 is set to PRIME 2 and the pump is operated in the clockwise direction for 100 revolutions at 150 rpm to move fresh ink into the printhead and to move any gas bubbles to the accumulator tank via the priming port 346. Then, the valve 386 is set to STANDBY.

The Applicant has found that printhead flushing can result in mixing of the different colored inks of the printhead, which if not cleared could result in cross-contamination of the separate ink color nozzles of the printhead. This color mixing is due to the flushed ink causing the menisci of the nozzles to pulsate from the action of the pump. Clearing of this color mixing can be achieved by setting the valve 386 to PRINT, prior to setting the valve 386 to STANDBY in the printhead flush procedure, and operating the printhead so that each nozzle ejects 500 drops. This "spitting" operation of the printhead is carried out in relation to an absorber or wick element of the maintenance system 600, described in incorporated description of US Provisional Patent Application No. 61/345,559. This spitting procedure equates to about 0.03 milliliters of ink being spat out by the entire printhead when the ejection drop size of each nozzle is about one picoliter.

Figure 23:
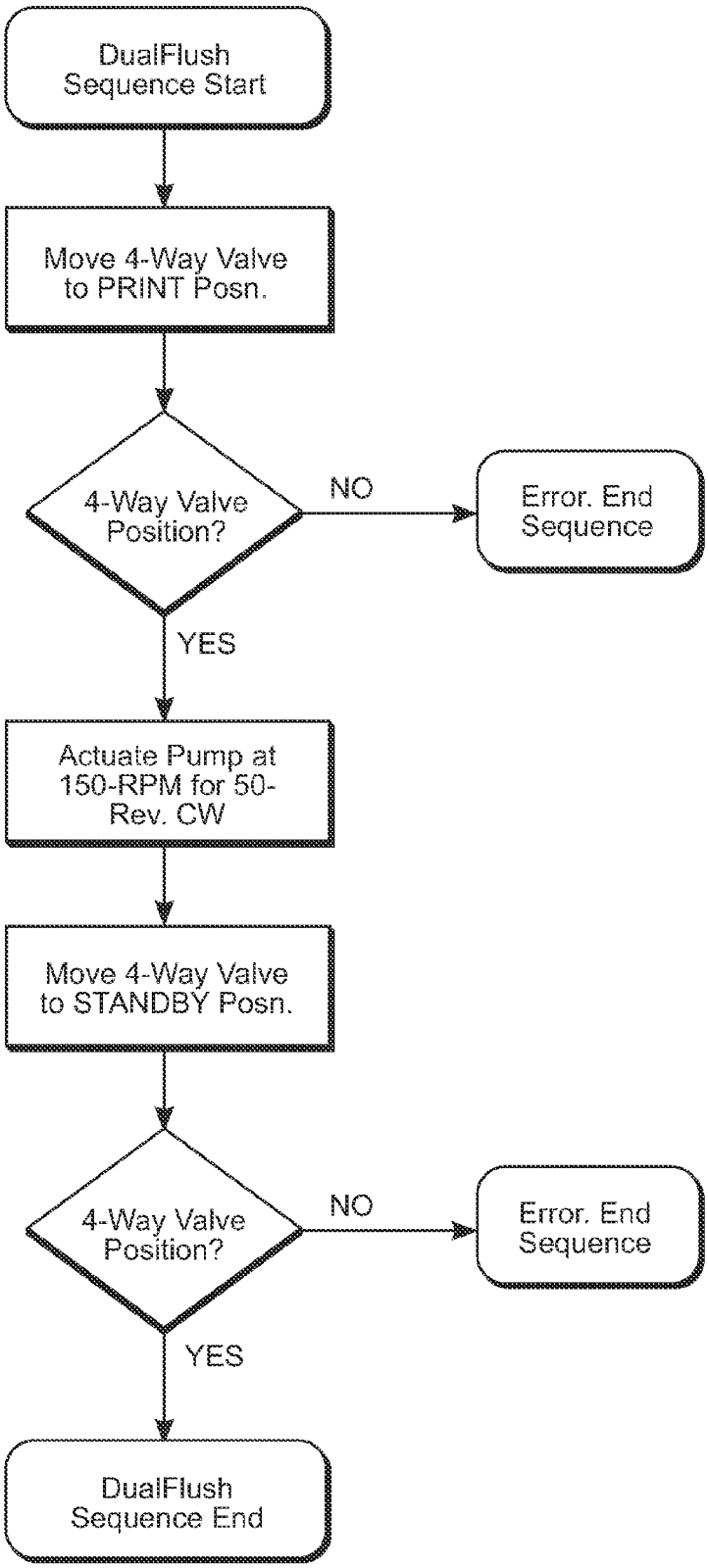
FIG. 23 illustrates a dual flush procedure of the fluid distribution system.

As an alternative to the printhead flush procedure, it is possible to recover the printhead from mild dehydration by flushing the bypass line 384 and the printhead simultaneously. As illustrated in FIG. 23, in this dual flush procedure the valve 386 is set to PRINT and the pump is operated in the clockwise direction for 50 revolutions at 150 rpm to move fresh ink into the bypass line 384 and the printhead, and to move any gas bubbles to the accumulator tank via the priming port 346. Then, the valve 386 is set to STANDBY.

Figure 24:
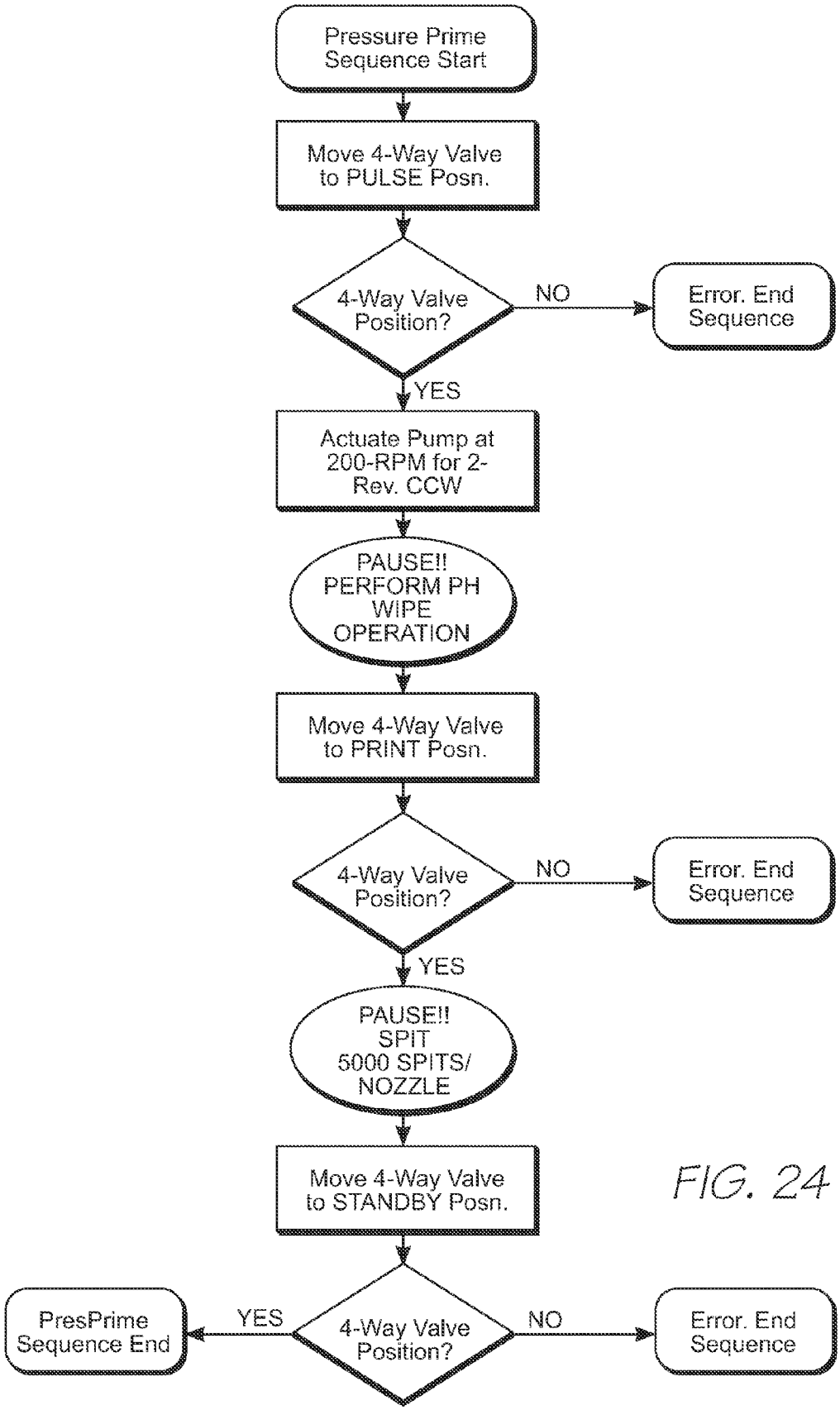
FIG. 24 illustrates a pressure prime procedure of the fluid distribution system.

At times it is necessary to recover the printhead from heavy dehydration and/or remove air bubbles trapped within the fine ink delivery structure of the printhead 200 by priming the printhead at increased fluid pressure. As illustrated in FIG. 24, in this pressure prime procedure the valve 386 is first set to PULSE and the pump is operated in the anticlockwise direction for 2 revolutions at 200 rpm to cause ink to be egested from the nozzles of the printhead. Then, the maintenance system 600 is operated to wipe the ejection face of the printhead so as to remove the egested ink, as described in the incorporated description of US Provisional Patent Application No. 61/345,559. Then, the valve 386 is set to PRINT and the printhead is operated so that each nozzle ejects 5000 drops. This "spitting" operation of the printhead is carried out in relation to an absorber or wick element of the maintenance system 600, described in the incorporated description of US Provisional Patent Application No. 61/345,559. Then, the valve 386 is set to STANDBY.

It is important to note in this pressure prime procedure that the printhead wipe is performed before moving the valve 386 from the PULSE setting to the PRINT setting. This is to prevent the ink on the ejection face of the printhead being sucked into the nozzles due to the negative fluid pressure at the nozzles which is established when the accumulator tank is reconnected to the printhead via the print line portion 308*a* when the ink port of the valve 386 is opened.

The Applicant has found that the pressure priming can result in color mixing. The spitting of 5000 drops from each nozzle of the printhead has been found by the Applicant to sufficiently clear this color mixing. This spitting procedure equates to about 0.35 milliliters of ink being spat out by the entire printhead when the ejection drop size of each nozzle is about one picoliter.

Figure 25:
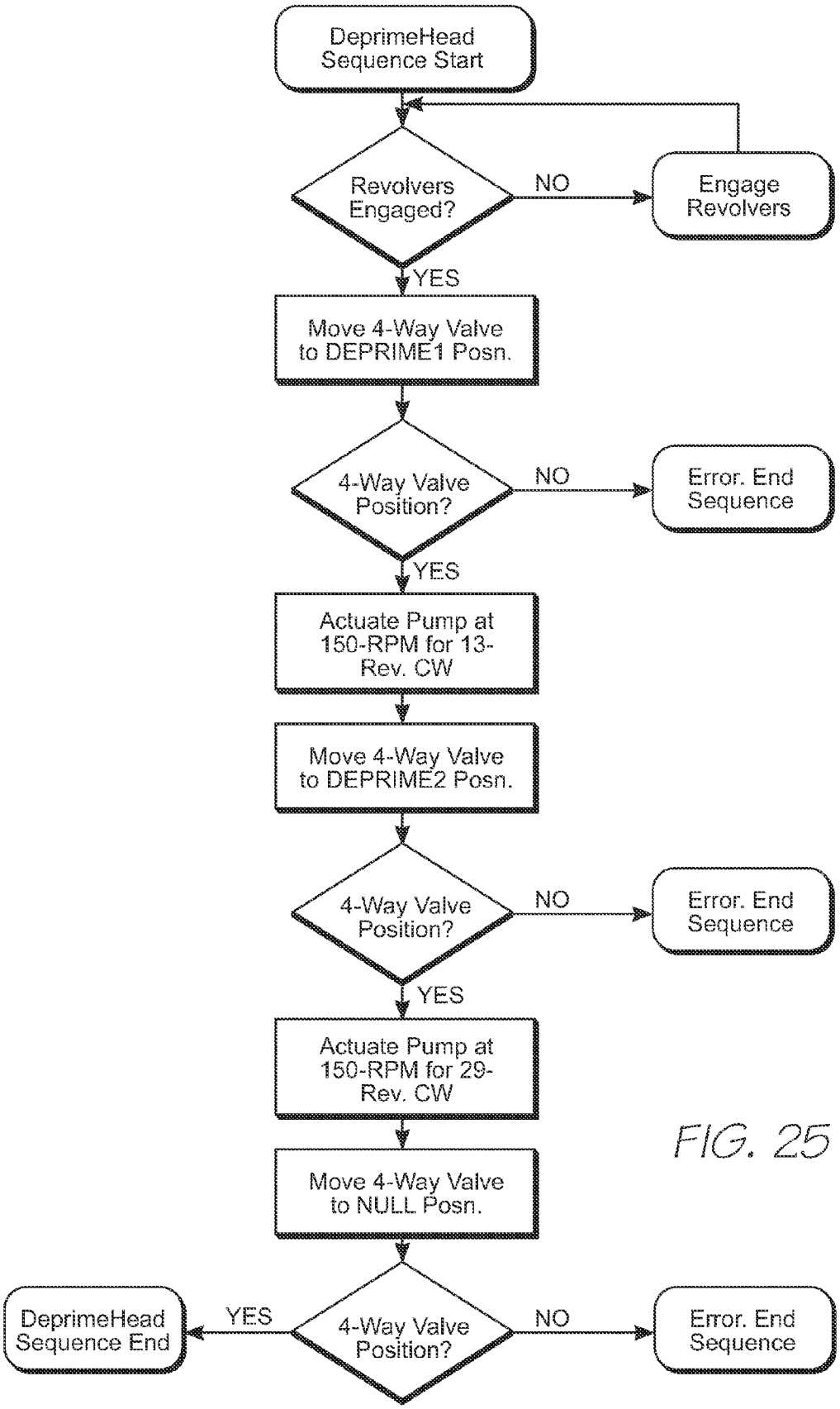
FIG. 25 illustrates a de-prime procedure of the fluid distribution system.
Figure 26A:
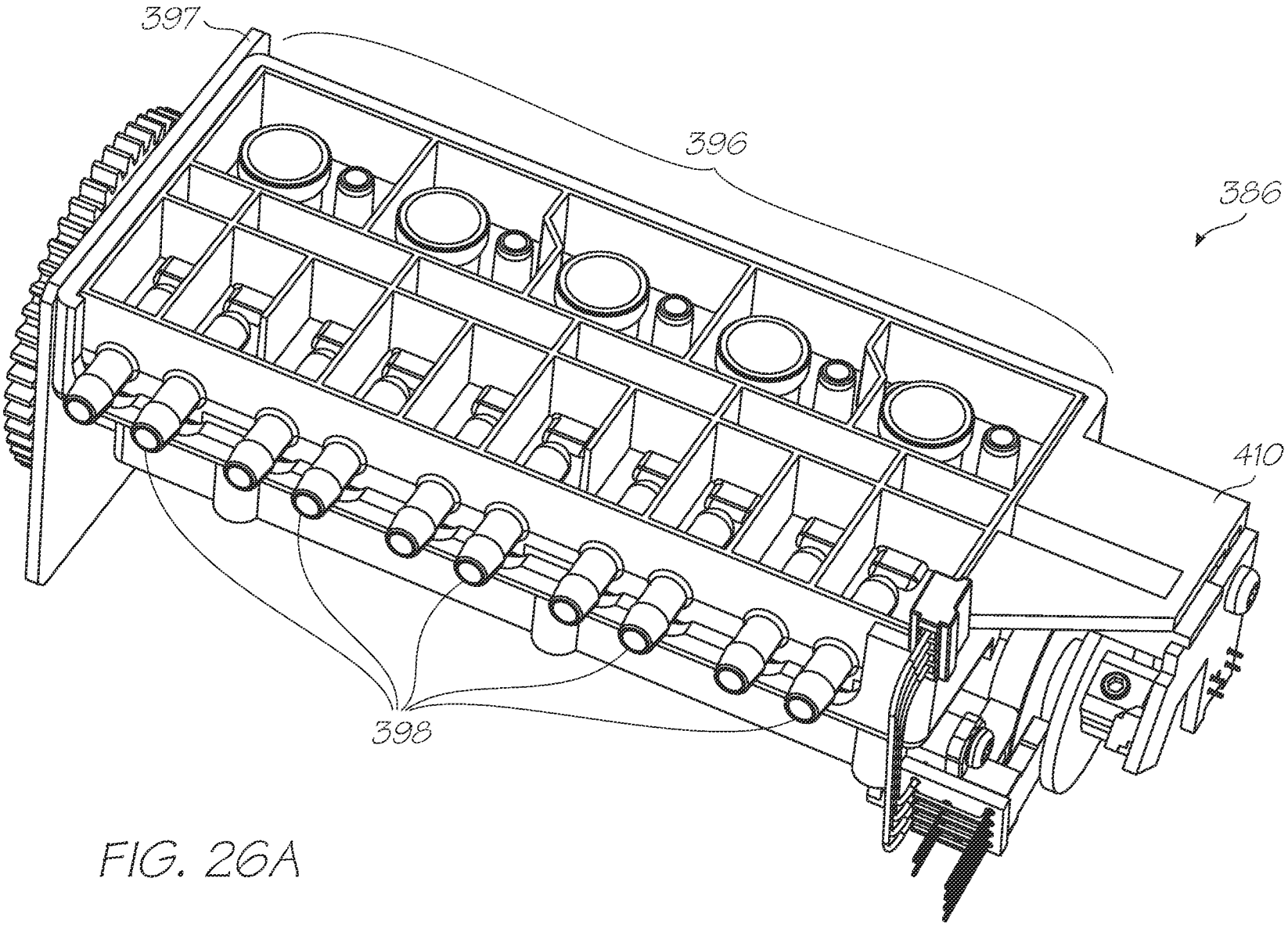
FIG. 26A illustrates an isometric view of an exemplary diaphragm multi-channel valve of the fluid distribution system.
Figure 26B:
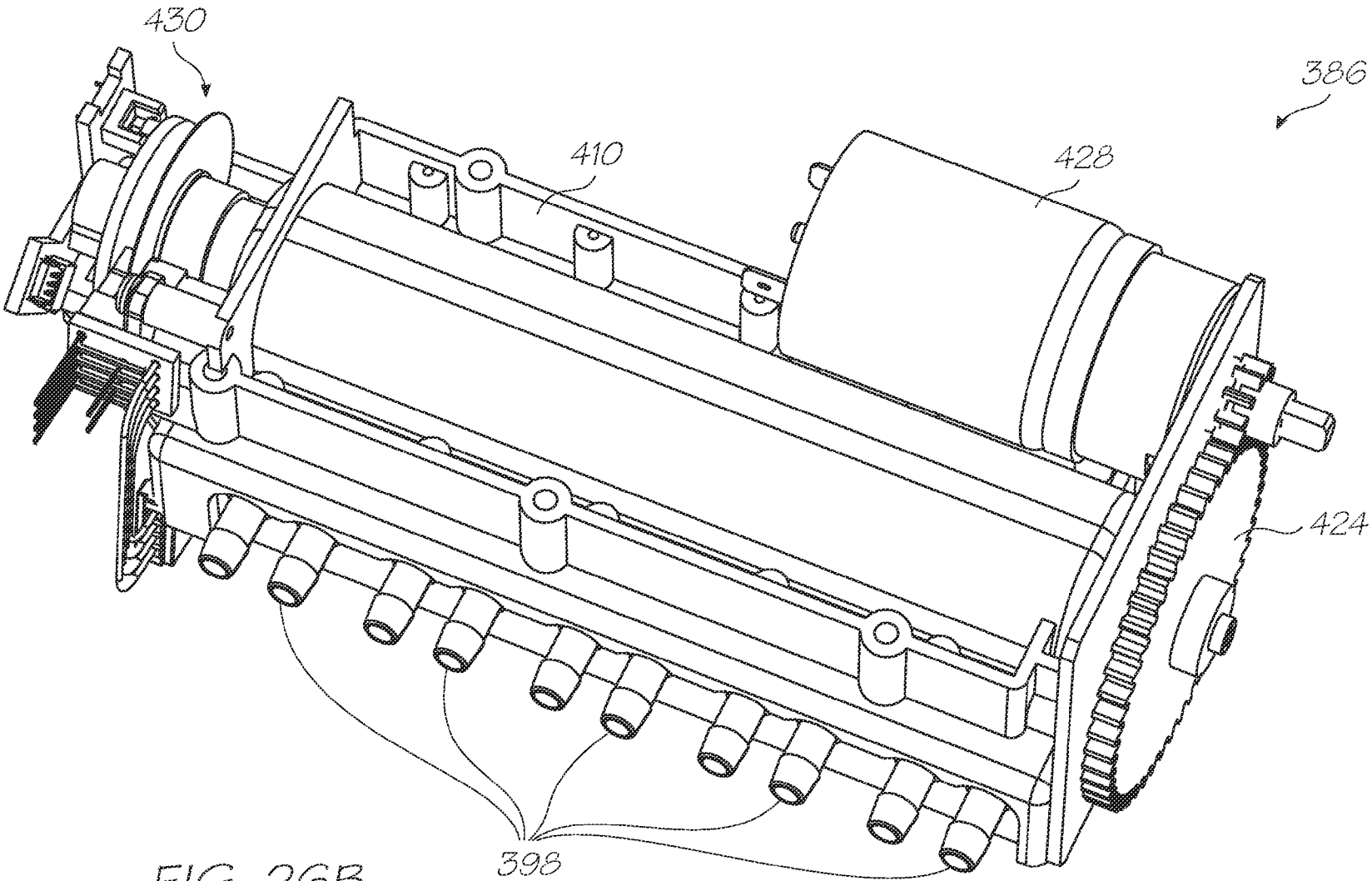
FIG. 26B illustrates another isometric view of the diaphragm valve.
Figure 26C:
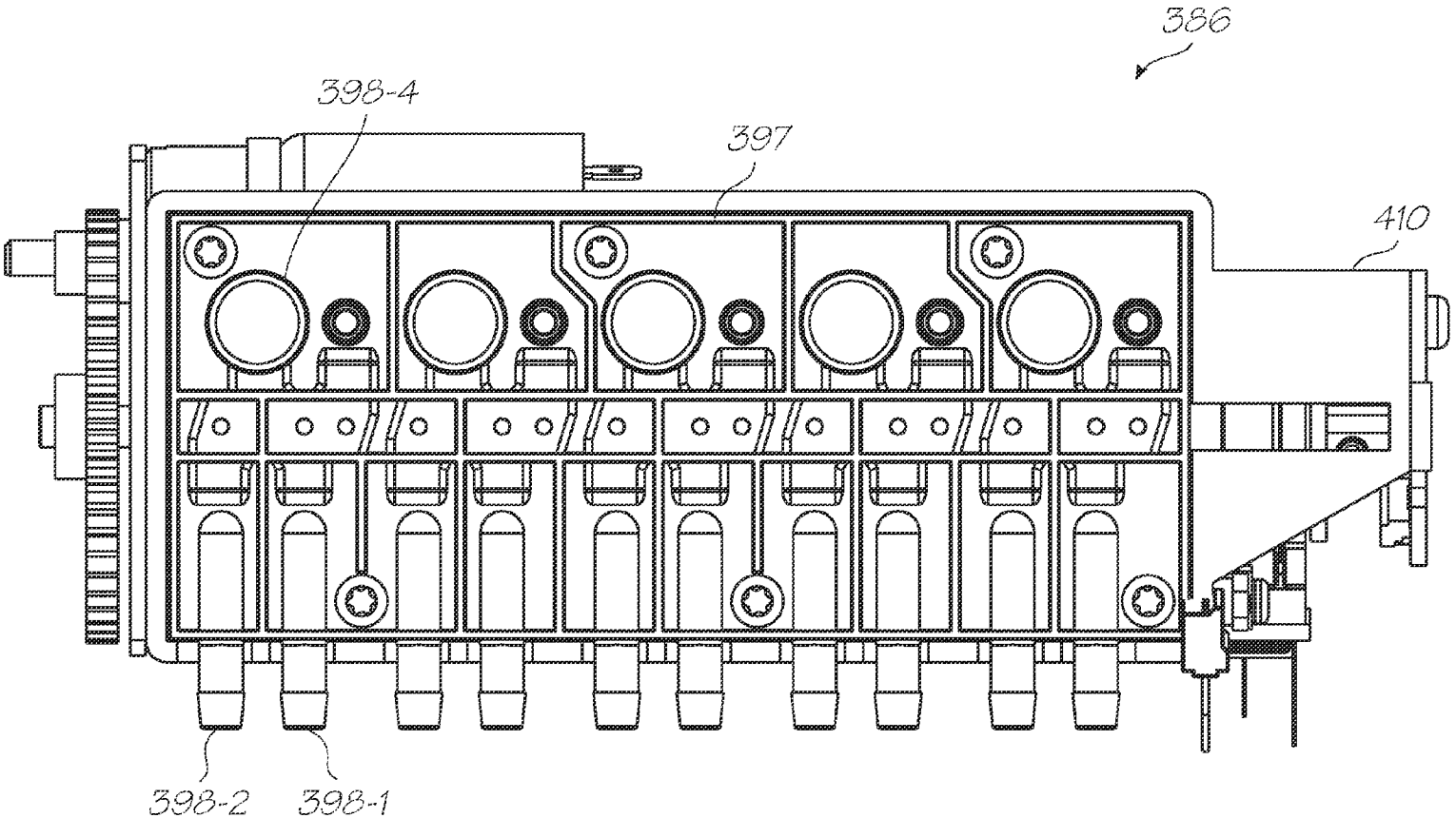
FIG. 26C illustrates a top view of the diaphragm valve.
Figure 27:
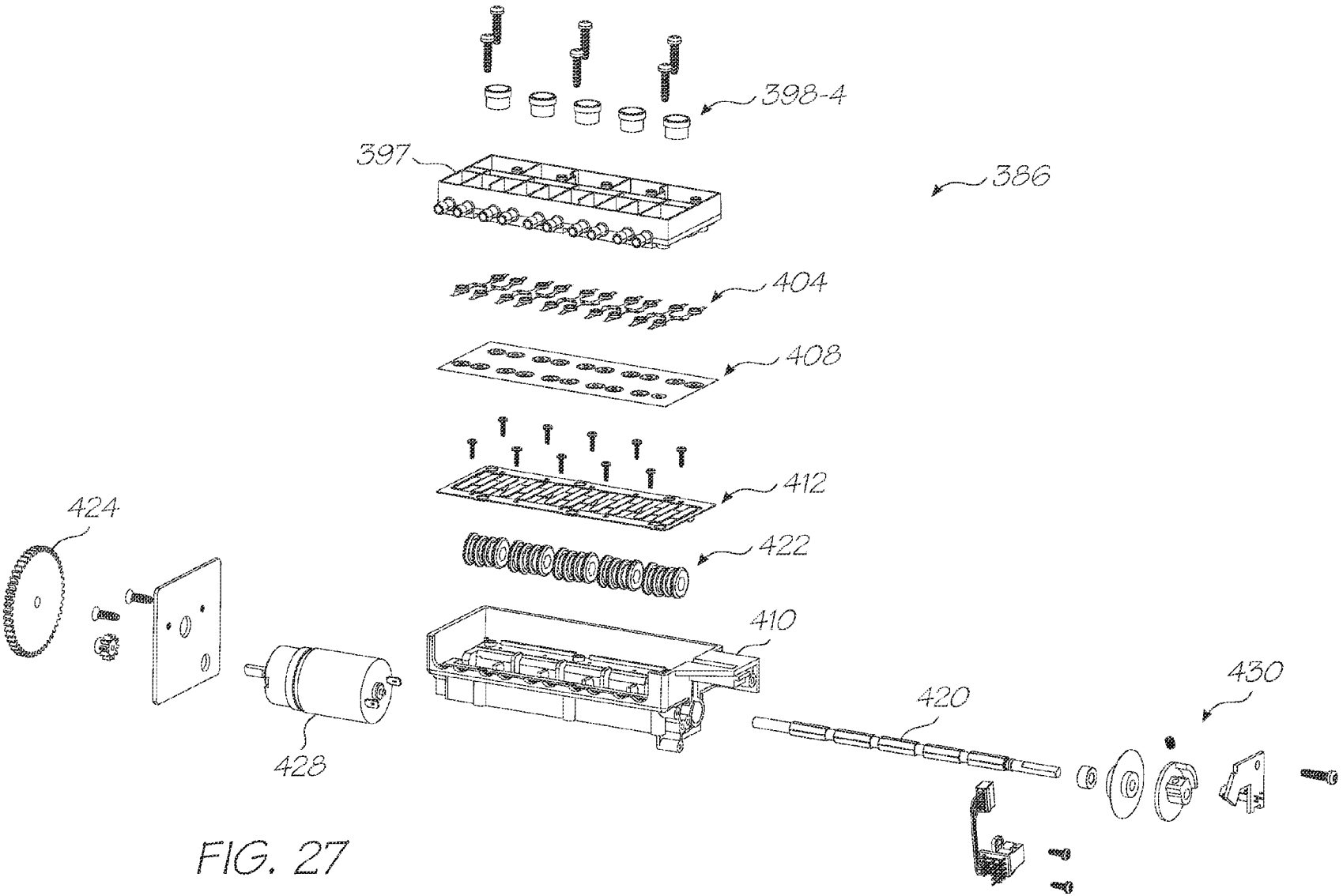
FIG. 27 illustrates an exploded view of the diaphragm valve.

When the printhead 200 is to be removed from the fluid distribution system 300, long term storage of the printer 100 is desired or an empty supply tank is not replaced or refilled within a certain period (e.g., 24 hours), it is necessary to de-prime the printhead and the bypass line 384. As illustrated in FIG. 25, in this de-prime procedure the valve 386 is first set to DEPRIME 1 and the pump is operated in the clockwise direction for 13 revolutions at 150 rpm to de-prime the bypass line 384 by allowing air to enter the bypass line 384 from the de-prime vent 390 which pushes the ink from the bypass line 384 into the accumulator tank via the pump line 382.

Then, the valve 386 is set to DEPRIME 2 and the pump is operated in the clockwise direction for 29 revolutions at 150 rpm to de-prime the printhead, the print line portion 380*b* and the pump line 382 by allowing air to pass through the printhead from the de-prime vent 390 which pushes the ink from the print line portion 380*b*, the printhead 200 and the pump line 382 into the accumulator tank so that the ink is moved into the pump line 382 to at least a leak safe location downstream of the pump relative to the printhead. Then, the valve 386 is set to NULL, which closes all ports of the valve 386 and thereby allows leak safe removal of the printhead or the like.

The above-described values for the pump operation in the various priming and de-priming procedures are approximate and other values are possible for carrying out the described procedures. Further, other procedures are possible and those described are exemplary. The levels of uncertainty in the described values, where appropriate, are shown in Table 2.

TABLE 2 pump operation value ranges

| Procedure | Pump Action | RPM | No. of Revs. | Time |
|---|---|---|---|---|
| Power up prime | prime bypass loop | 100 +/− 20 | 88 +/− 8 | 52.8 s |
| Prime | prime bypass line | 150 +/− 50 | 42 +/− 4 | 16.8 s |
| | prime printhead | 60 +/− 50 | 63 +/− 6 | 25.2 s |
| Bypass flush | bubble flush bypass line | 150 +/− 50 | 50 | 20 s |
| Printhead flush | bubble flush the printhead | 150 +/− 50 | 100 +/− 50 | 40 s |
| Dual flush | bubble flush printhead and bypass line | 150 +/− 50 | 50 + 50/−25 | 20 s |
| Pressure prime | push ink out through nozzles | 200 +/− 50 | 2 + 2/−0 | 0.8 s |

TABLE 2-continued

| pump operation value ranges | | | | |
|---|---|---|---|---|
| Procedure | Pump Action | RPM | No. of Revs. | Time |
| De-prime | de-prime bypass line | 150 +/− 50 | 13 +/− 2 | 5.2 s |
| | de-prime printhead | 150 +/− 50 | 29 +/− 3 | 11.6 s |

The above discussion has been made in relation to a fluid distribution system for a single fluid channel, e.g., an ink of one color, arranged as shown in FIG. 8. In order to deliver more than one fluid to the printhead 200 or multiple printheads each printing one or more ink colors, the fluid distribution system 300 is replicated for each fluid. That is, separate supply tanks 302 and accumulator tanks 304 for each fluid are provided which are interconnected by an associated fluid line 308 with an air chimney 370 and are connected to the printhead 200 via an associated closed fluid path loop 348.

Certain components of these separate systems can be configured to be shared. For example, the supply couplings 388, the 4-way valve 386 and the pump 378 can each be configured as multiple fluid channel components, and a single or separate de-prime vents 390 can be used for the multi-channel 4-way valve 386. An exemplary arrangement of these multiple fluid paths is illustrated in FIGS. 6 and 7.

For an exemplary printhead 200 having five ink flow channels, e.g., CYMKK or CYMKIR, as discussed above, the pump 378 is a five channel pump which independently pumps the ink in each channel. The structure and operation of such a multi-channel pump is understood by one of ordinary skill in the art.

Using the multi-channel 4-way valve 386 facilitates efficient manufacture and operation of this component. Exemplary structures of the multi-channel valve 386 are now described.

FIGS. 26A to 29C illustrate an exemplary diaphragm multi-channel 4-way valve 386 (herein termed "diaphragm valve") for use with the multi-channel fluid distribution system.

The diaphragm valve 386 has five port arrangements 396 in series along a frame 397 providing five fluid channels. Each port arrangement 396 has four ports 398, respectively labelled 398-1, 398-2, 398-3 and 398-4, associated with a corresponding chamber 400 defined in the frame. Each port 398 has opposite, connected ends, with an external end projecting from the chamber 400 and an internal end projecting into the chamber 400. By this arrangement, the four ports 398 of each port arrangement 396 are in selective fluid communication (as detailed below) with one another via the corresponding chamber 400.

The external ends of the ports 398-1, 398-2 and 398-3 are formed as tubing connectors for connection to the tubing of the closed loop 348. In particular, the portion 380*a* of each print line 380 connects to the external end of the port 398-1 of the corresponding port arrangement 396, the portion 380*b* of each print line 380 connects to the external end of the port 398-2 of the corresponding port arrangement 396, and the bypass line 384 connects to the external end of the port 398-3 of the corresponding port arrangement 396.

The vent line 392 of each (or a single) de-prime vent 390 connects to the external end of the port 398-4 of the corresponding port arrangement 396. In the example illustrated in the drawings, five de-prime vents 390 are incorporated into the structure of the diaphragm valve itself, with each port arrangement 396 having an associated de-prime vent 390.

Accordingly, the ports 398-1, 398-2, 398-3 and 398-4 respectively correspond to the previously described "ink", "printhead", "bypass" and "air" ports.

Figure 28A:
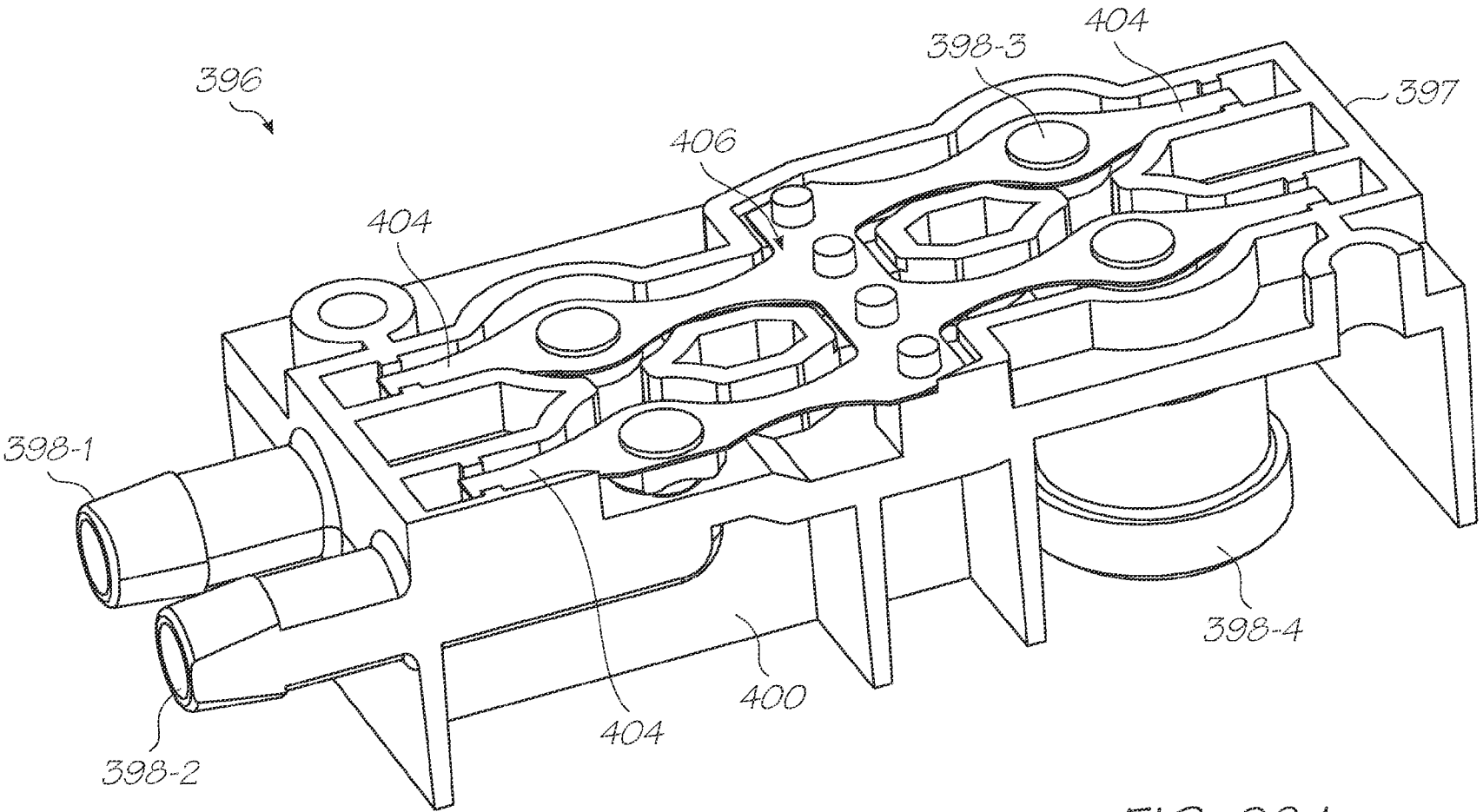
FIG. 28 illustrates a diaphragm port arrangement for one fluid channel of the diaphragm valve.
Figure 28B:
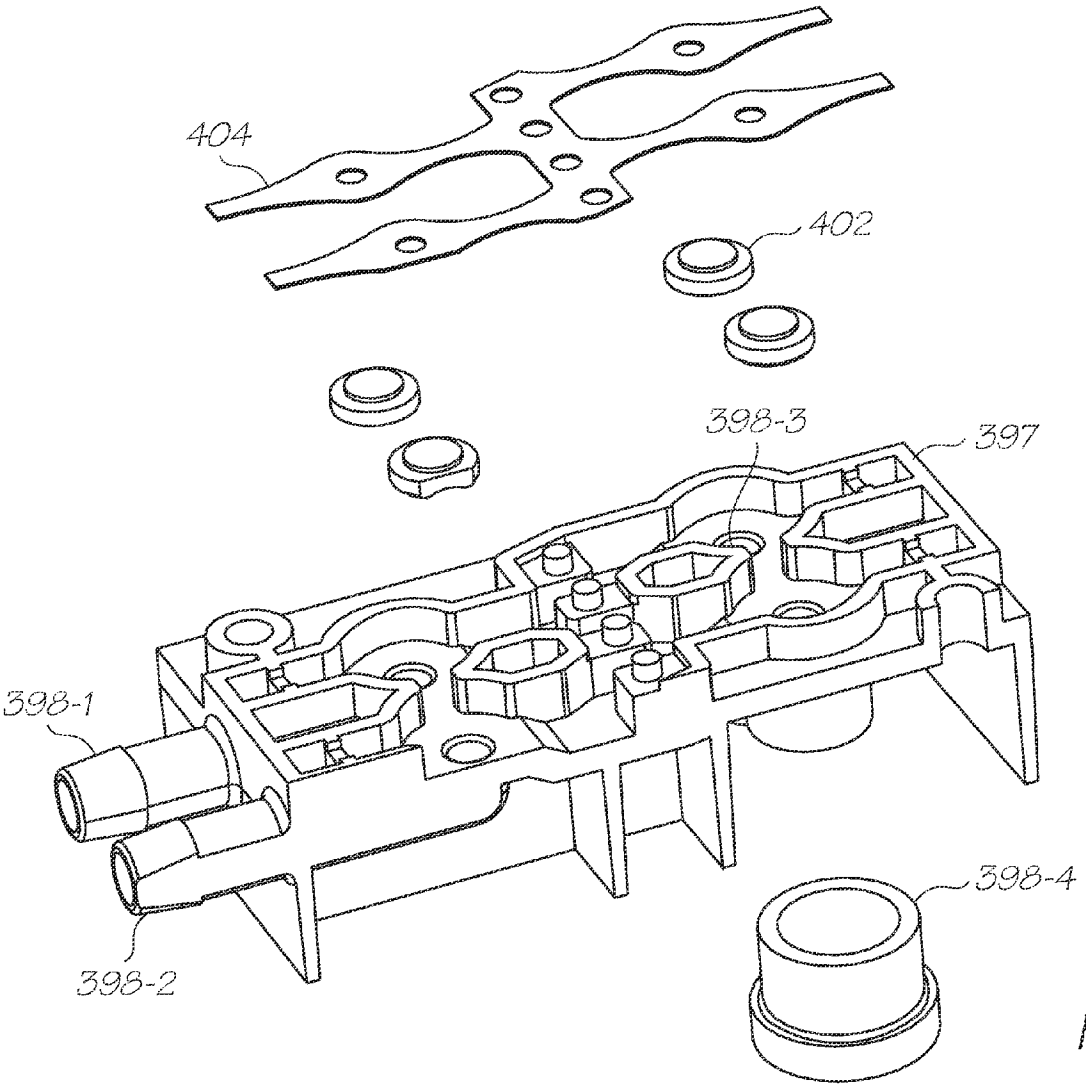

A single of the port arrangement 396 as sectioned from the other port arrangement 396 is illustrated in FIG. 28. The internal end of each port 398 cooperates with an associated seal 402. The seals 402 are provided on corresponding resiliently flexible flaps 404 of a diaphragm pad 406. The diaphragm pad 406 is mounted to the chamber 400 and a sealing film 408 is mounted thereon to fluidically seal the chamber 400. The sealing film 308 is preferably a thin laminated film which is resiliently flexible.

The assembled frame 397 is supported within a body 410 of the diaphragm valve. A finger plate 410 is mounted within the diaphragm valve body to be located over the sealing film. The finger plate has cantilevered fingers 412 which each align with a corresponding one of the flaps 404 of each diaphragm pad through the sealing film.

This assembly therefore has the seals 402 spaced from the internal ends of the ports 398 and the fingers 412 spaced from the seals 402. A cam member 416 is mounted within the diaphragm valve body to selectively act on protrusions 418 of each of the fingers 412 of the finger plate so as to cause relative movement of the fingers and flaps thereby closing these spaces and selectively sealing the ports 398. The fluid flow between the ports 398 in each port arrangement depends upon which of the ports 398 are un-sealed and/or sealed.

The flaps 404 are preferably formed of titanium. However, other materials may be used provided they are inert to ink and able to allow the flaps to be either resiliently planar so as to be moved out of plane to seal and then spring back into plane to unseal or resiliently bent out of plane so as to be moved into plane to seal and then spring back out of plane to un-seal.

The fingers 412 are preferably formed of stainless steel and the seal 402 is preferably formed of rubber. The sealing film 408 preferably has four layers laminated together. The four layers in sequence are preferably formed of: polyethylene terephthalate (PET) for the outer layer facing the finger plate; vacuum deposited aluminium for the first inner layer; polypropylene for the next inner layer; and polypropylene for the outer layer facing the flaps.

Figure 29A:
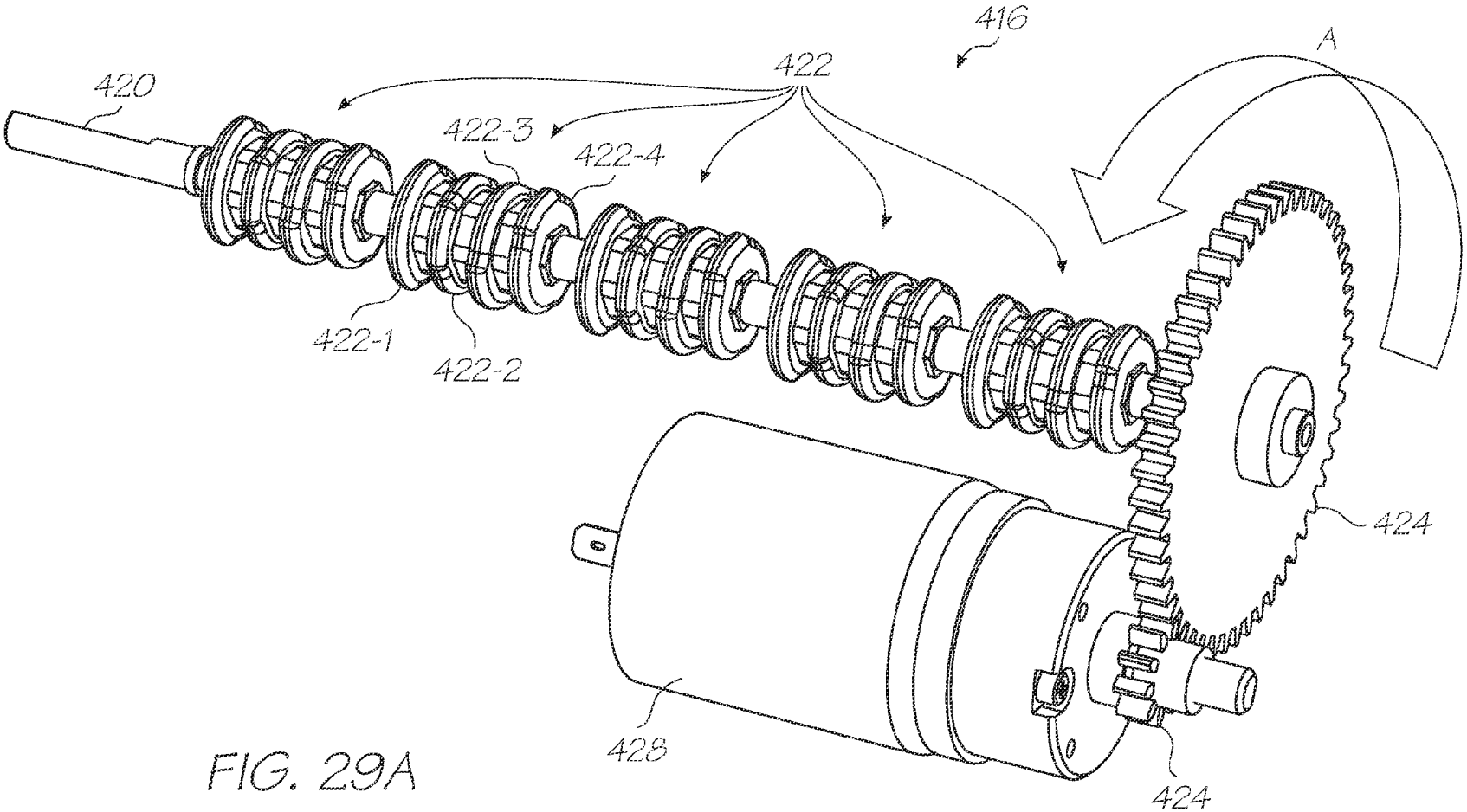
FIG. 29A illustrates operation of a cam drive arrangement of the diaphragm valve.

The cam member 416 has a shaft 420 rotatably mounted to the diaphragm valve body and five cams 422 mounted on the cam shaft 420. Each cam 422 has selection members in the form of four cams or discs 422-1, 422-2, 422-3 and 422-4 which have eccentric cam profiles whose eccentricity is offset from one another but aligned with the eccentric cam profiles of the corresponding discs of the other cams 422 for each ink flow channel, as illustrated in FIG. 29A. The cams 422 may be molded with the discs integrally formed. The cam shaft 420 has a motor gear 424 mounted at one end and an encoder gear 426 mounted at the other end. The motor gear 424 couples with a motor 428 to be rotated in the direction of arrow A in FIG. 29A, and the encoder gear 426 is part of an encoder 430 for sensing a rotated position of the cam shaft 420. However, other sensing or operational arrangements for controlling the rotated position of the cam shaft 420 are possible.

The associated seals 402, diaphragm pad 406, sealing film 408, finger plate 410, cam member 416, motor 428 and encoder 430 form a selection device for selecting the valve states detailed above by selectively sealing and unsealing the ink, printhead, bypass and air ports 398-1, 398-2, 398-3 and 398-4 through manipulation of the diaphragm pad 406.

The encoder 430 has a structure well understood by one of ordinary skill in the art and outputs the sensing result to the control electronics 802 of the printer 100 so that operation of the motor 428 can be controlled by the control electronics 802 to select the necessary cam profiles of the cam member 416 for establishing a selected valve state.

The motor 428 is preferably a stepper motor with uni-directional operation so that the cam shaft 420 and the cams 422 are rotated in the one direction to effect the various port state changes. However, other arrangements are possible, such as a bi-directional motor which allows both clockwise and anti-clockwise rotation of the shaft 420.

Figure 29B:
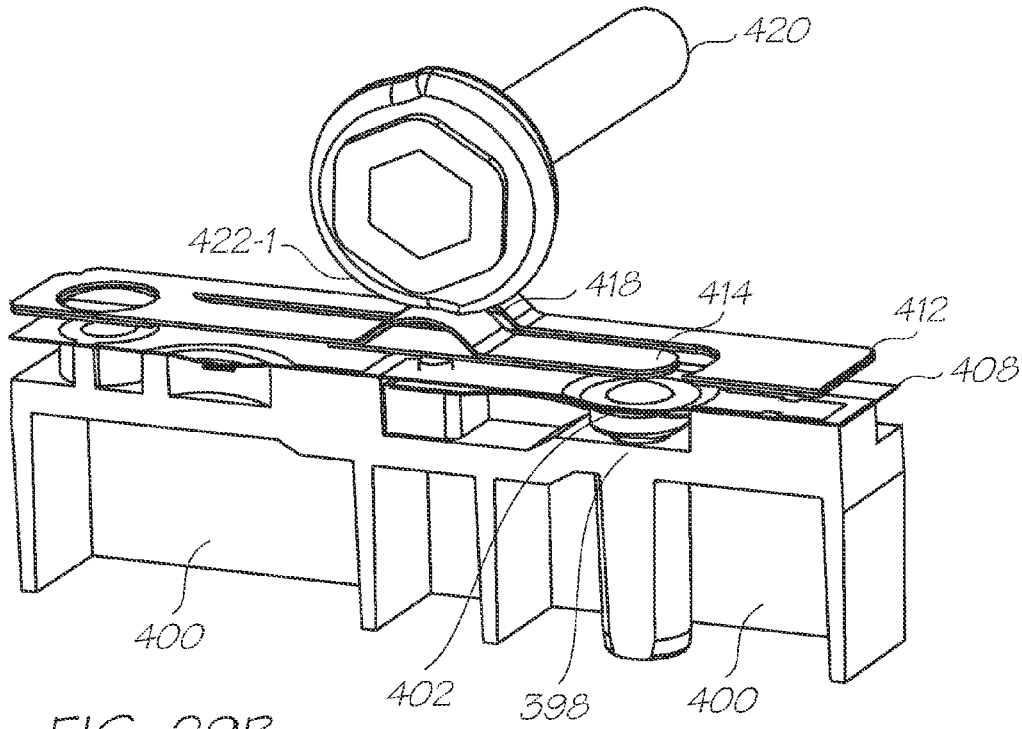
FIG. 29B illustrates a first position of a single cam disc of the cam drive arrangement.
Figure 29C:
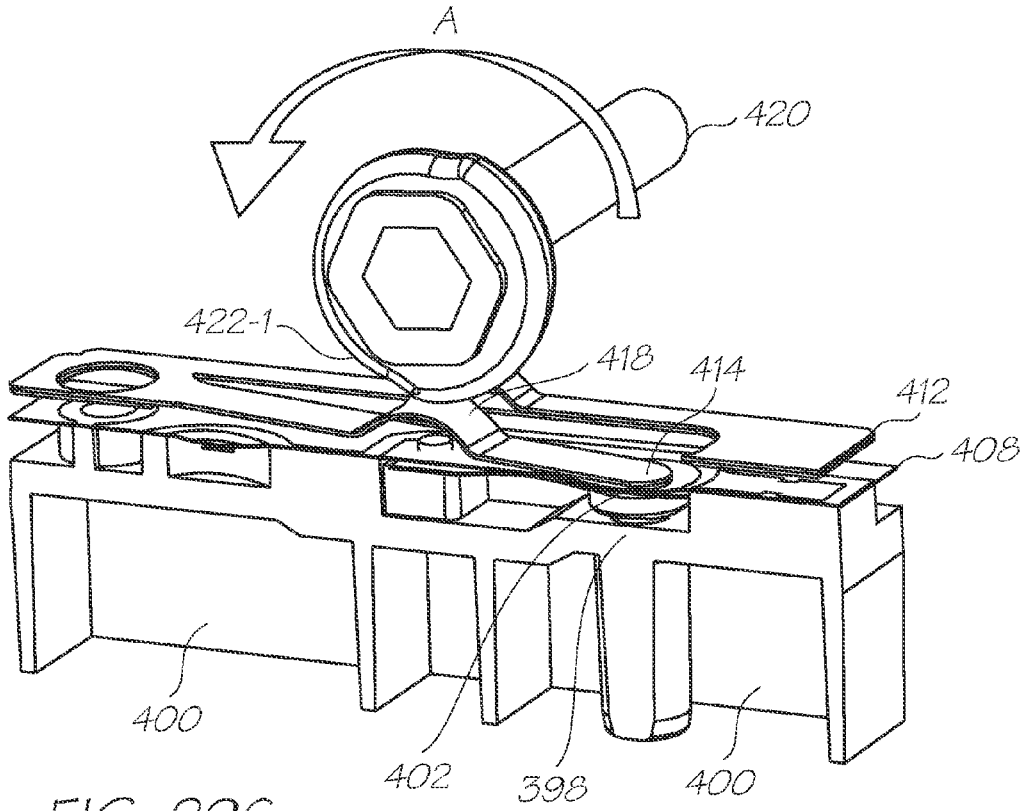
FIG. 29C illustrates a second position of the single cam disc of FIG. 29B.
Figure 30A:
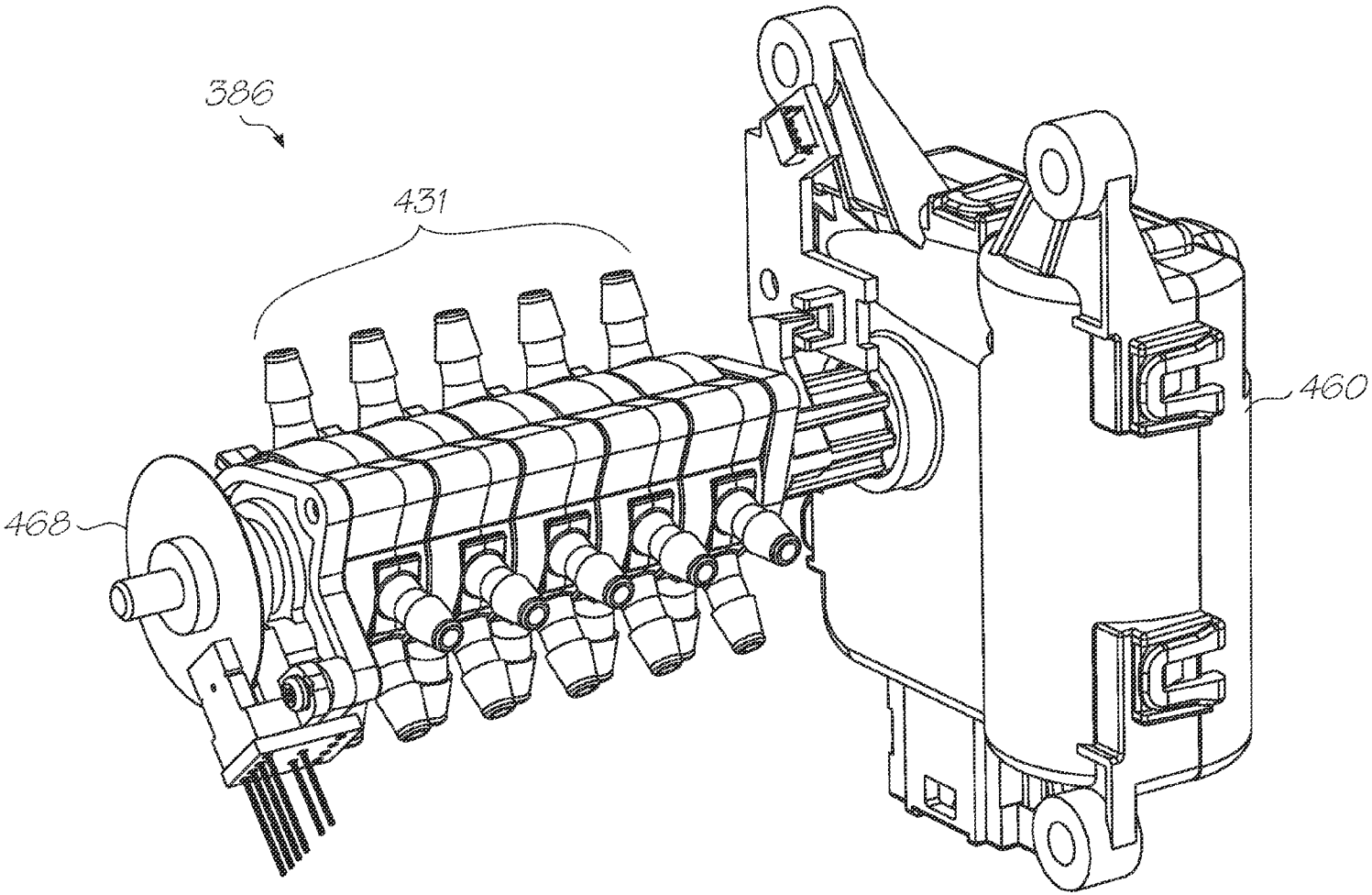
FIG. 30A illustrates a perspective view of an exemplary rotary multi-channel valve of the fluid distribution system.
Figure 30B:
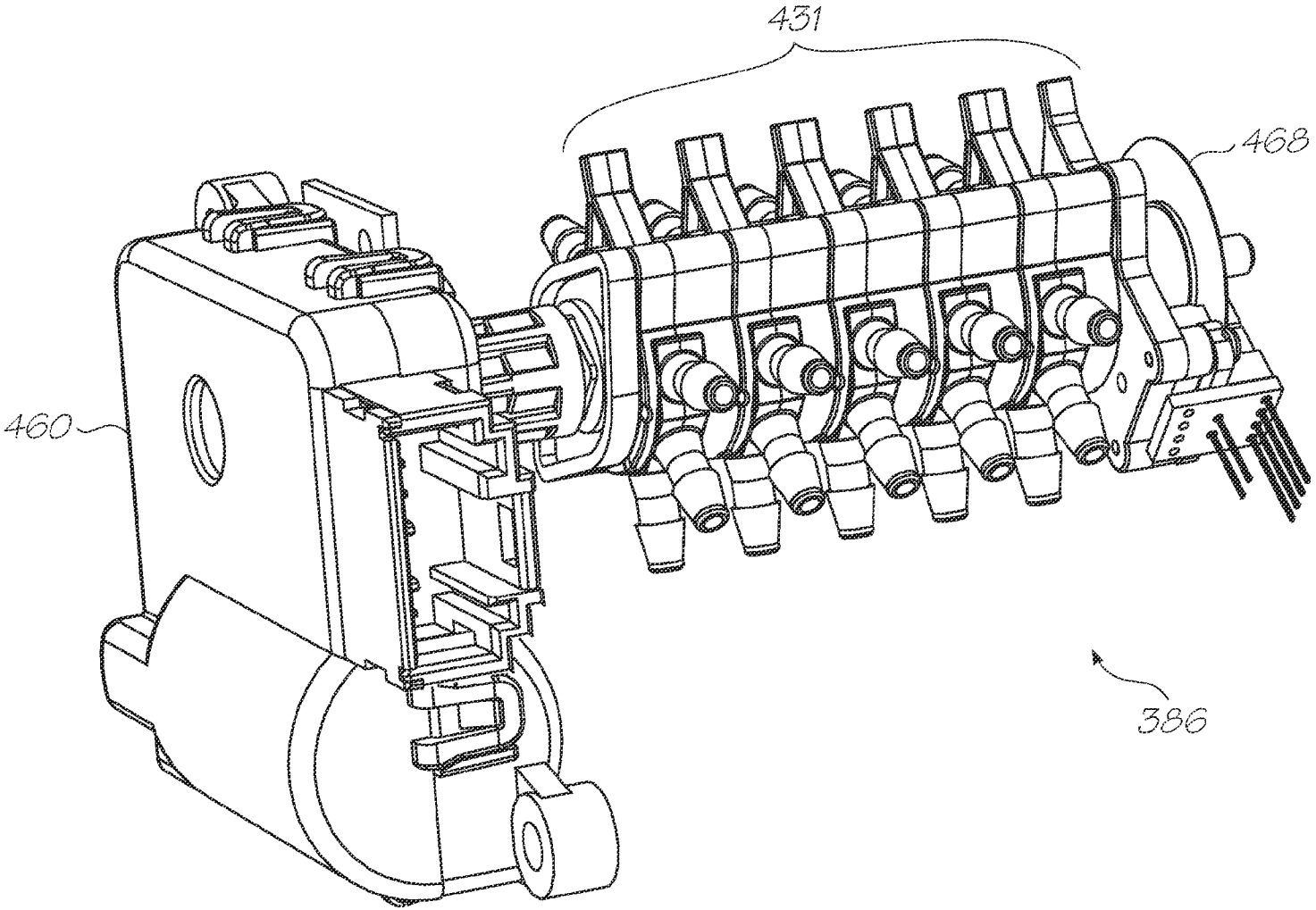
FIG. 30B illustrates another perspective view of the rotary valve.

The operation states of this cam drive arrangement of the cam member 416 with respect to a single disc of one of the cams 422 are illustrated in FIGS. 29B and 29C.

As illustrated in FIG. 29B, when the cam profile of the disc 422 is not engaged with the protrusion 418 of the finger 412, the finger 412 is spaced from the flap 404 and as such the seal 402 is not pressed into the port 398. As illustrated in FIG. 29C, when the cam profile of the disc 422 is rotated in the direction of arrow A to engage the protrusion 418 of the finger 412, the finger 412 engages with the flap 404 which discretely deforms the diaphragm pad 406 at the seal 402 to urge the seal 402 into the port 398.

The offsets of the cam profiles of the discs 422-1, 422-2, 422-3, 422-4 in each cam 422 are provided so that as the cams 422 are rotated by the cam drive arrangement each of the valve states of Table 1 can be simultaneously selected for the plural fluid channels.

In the illustrated embodiment, each port arrangement 396 has an independently formed diaphragm pad 406 and finger plate 410, whilst the sealing film 408 is formed as a single member which is mounted to the frame 397 to cover all of the port arrangements 396. However, other arrangements are possible in which the individual port arrangements are integrally formed and the individual finger plates are also integrally formed.

FIGS. 30A to 36 illustrate an exemplary rotary multi-channel 4-way valve 386 (herein termed "rotary valve") for use with the multi-channel fluid distribution system.

The rotary valve 386 has five groups of ports or port arrangements 431 in series along a shaft 434. Each port arrangement 431 has a port cylinder 435 concentrically enclose a selection member in the form of a channel cylinder 436 which is mounted on the shaft 434. Each port cylinder 435 has four ports 432, respectively labelled 432-1, 432-2, 432-3 and 432-4, around along the circumference of the cylinder. Each port 432 has opposite, connected ends, with an external end projecting from the port cylinder 435 and an internal end opening into a channel 438 defined along the circumference of the channel cylinder 436. By this arrangement, the four ports 432 of each port cylinder 435 are in selective fluid communication (as detailed below) with one another via the channel or chamber 438 of the corresponding channel cylinder 436.

The external ends of the ports 432 are formed as tubing connectors for connection to the tubing of the closed loop 348. In particular, the portion 380*a* of each print line 380 connects to the external end of the port 432-1 of the corresponding port arrangement 432, the portion 380*b* of each print line 380 connects to the external end of the port 432-2 of the corresponding port arrangement 431, the bypass line 384 connects to the external end of the port 432-3 of the corresponding port arrangement 432, and the vent line 392 of each (or a single) de-prime vent 390 connects to the external end of the port 432-4 of the corresponding port arrangement 431.

Accordingly, the ports 432-1, 432-2, 432-3 and 432-4 respectively correspond to the previously described "ink", "printhead", "bypass" and "air" ports.

Referring to the single port arrangement 431 illustrated in FIGS. 32A to 34B, the port cylinder 435 has a housing 440 in which tubing connectors 442 of the external ends of the ports 432 are formed and a body 444 which is mounted within the housing 440 and in which apertures 446 are defined as the internal ends of the ports 432. The body 444 is formed of a resilient material, such as elastomer, so that the assembled housing 440 and body 444 seal against one another.

Figure 35:
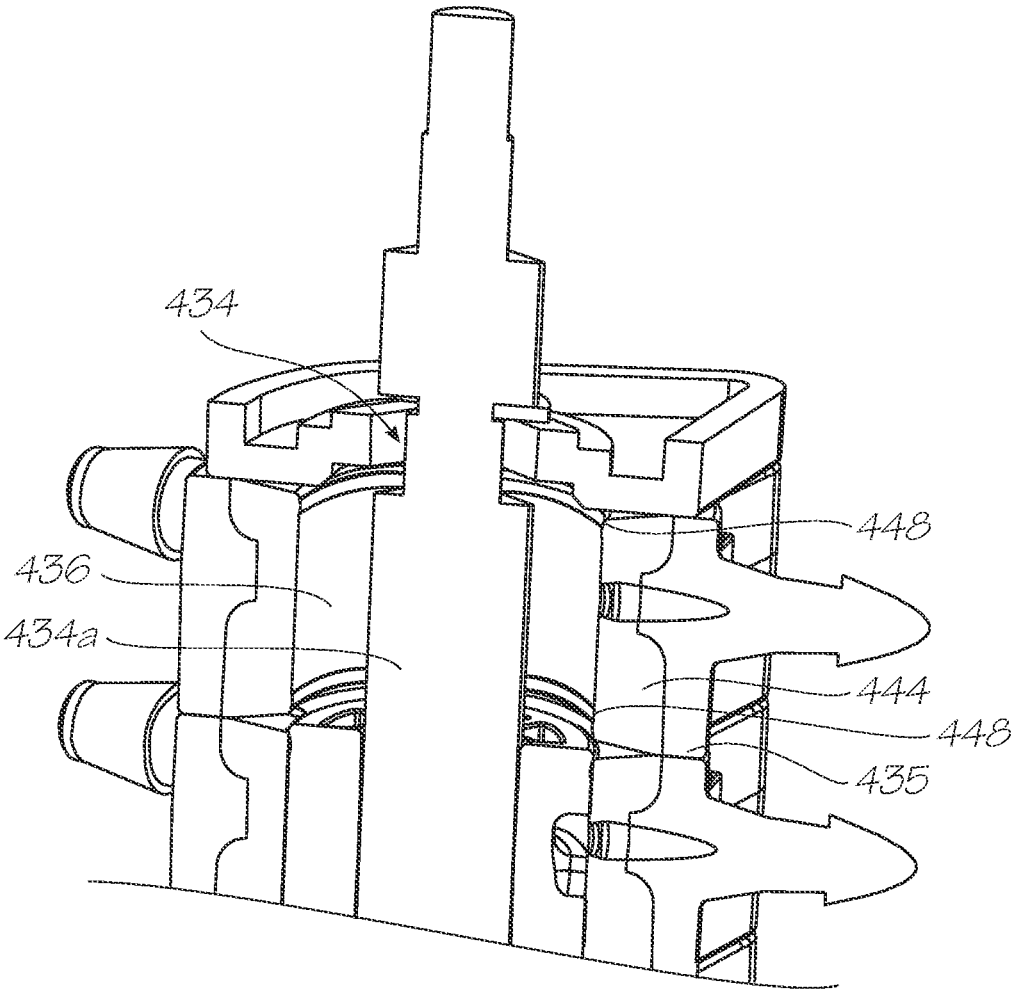
FIG. 35 illustrates a cross-sectional view of O-ring seal ridges of the port cylinder.
Figure 36:
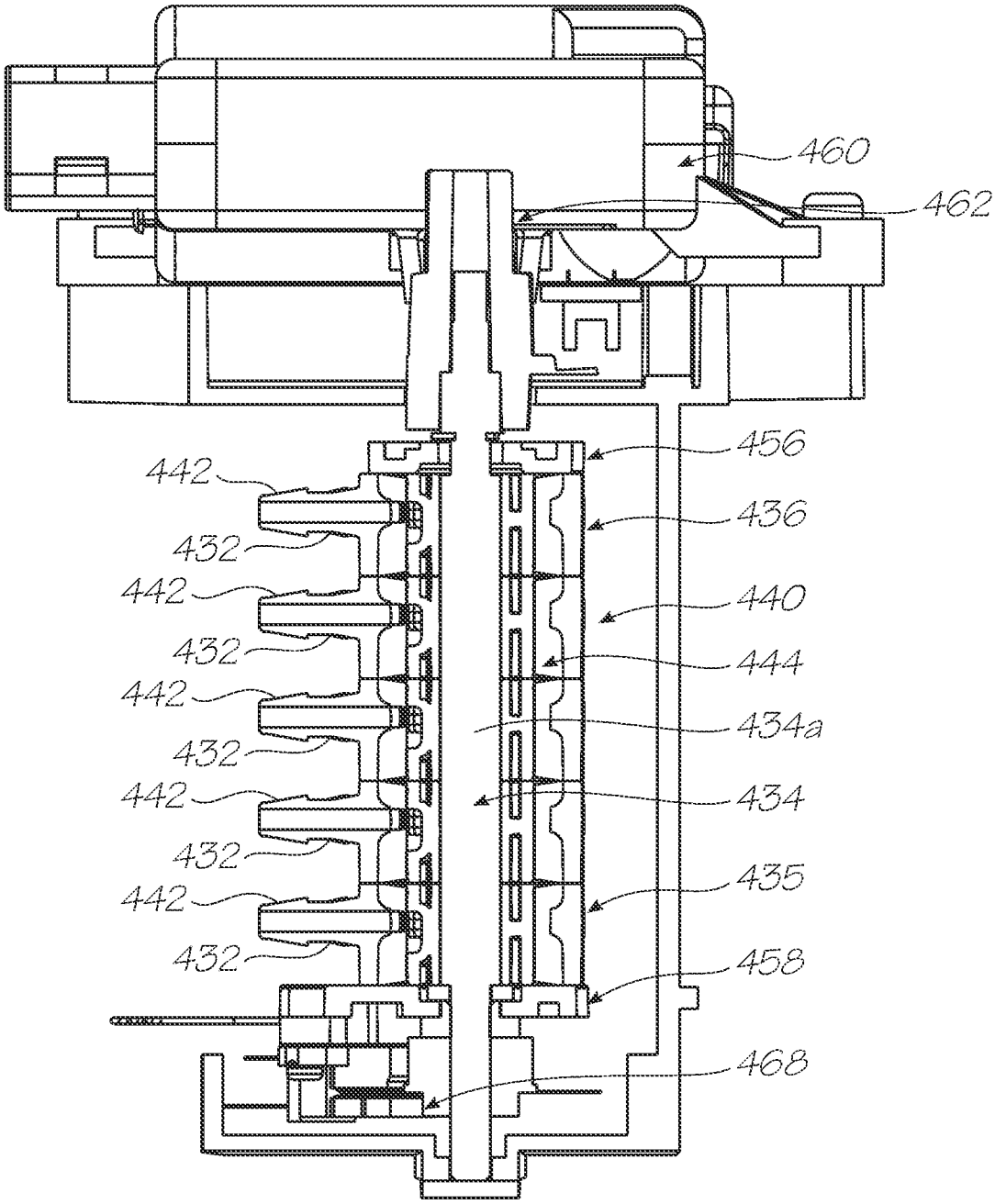
FIG. 36 illustrates a cross-sectional view of the rotary valve.

The internal cylindrical surface of the body 444 has inner circumferential ridges 448 at either edge which contact the outer surface of the channel cylinder 436 (see FIG. 35). Due to the resiliency of the body 444, the ridges 448 act as O-ring seals between the port and channel cylinders thereby sealing the channel 438.

The housing 440 of each of the port cylinders 435 has pins 450 and holes 452 on opposite sides of projections 454. The pins 450 and the holes 452 are aligned with one another and are dimensioned so that the pins 450 fit within the holes 452. When the port and channel cylinders are assembled onto the shaft 434, the port cylinders are brought into contact with one another so that the pins 450 and the holes 452 of the adjacent port cylinders engage one another. End plates 456 and 458 are positioned over the shaft 434 at either end of the adjacently arranged port and channel cylinders.

The end plate 456 has pins 450 which engage the holes 452 of the adjacent end port cylinder and the other end plate 458 has holes 452 which engages the pins 450 of the adjacent end port cylinder. By this assembly, the series of independently sealed channels 438 in selective fluid communication with their associated ports 432 is provided, with the ports being fixedly mounted to the body channels.

The tubing connectors 442 of the ports 432 are connected with the tubing of the closed loop 348 within a housing 102 of the printer 100. The rotary valve is mounted to the housing 102 so that in this connected state of the rotary valve, the end plates and the port cylinders, connected together by the engaged pins and holes, are held in place whilst the channel cylinders are free to rotate with the shaft 434.

Figure 31:
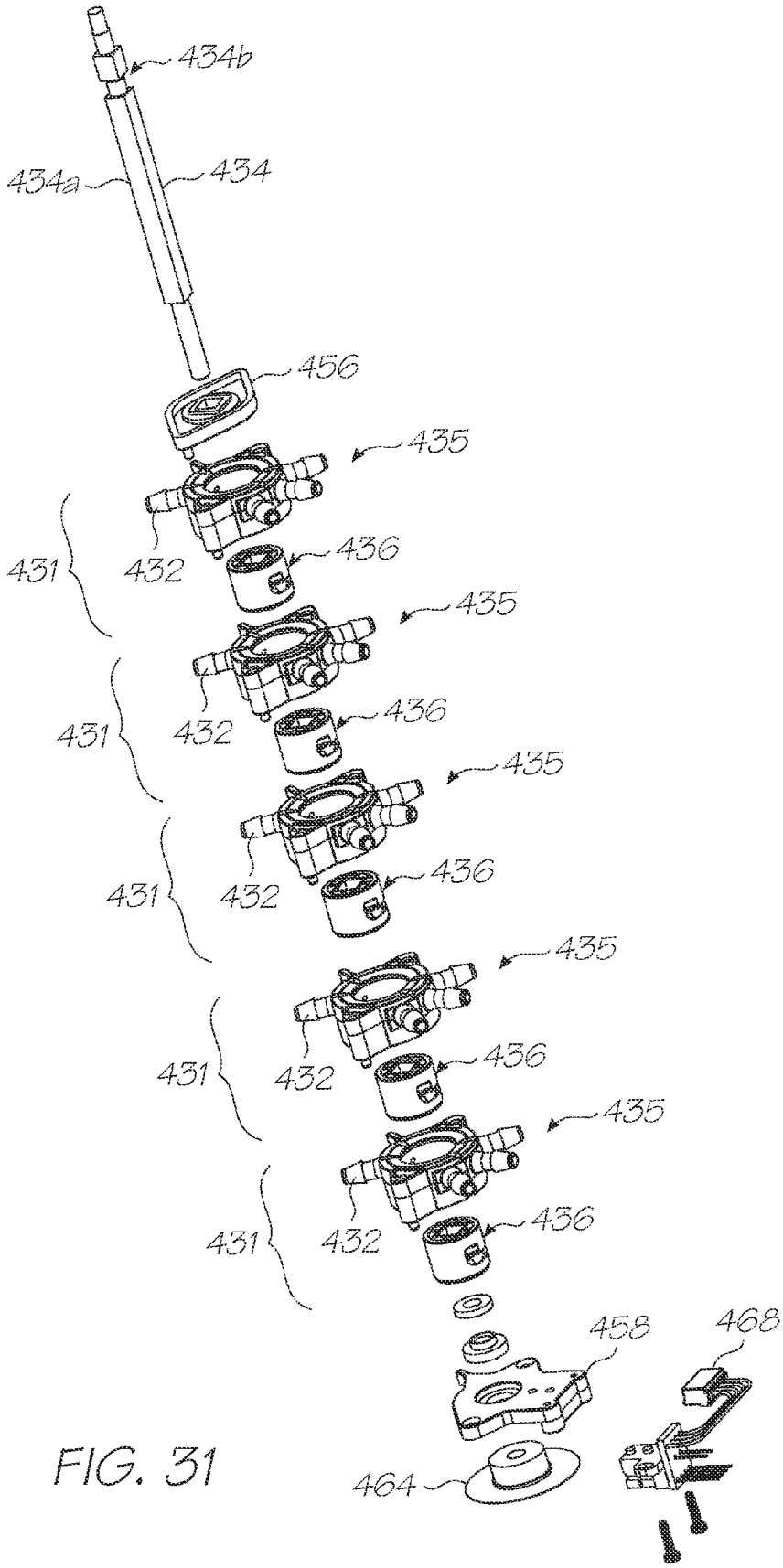
FIG. 31 illustrates an exploded view of the diaphragm valve.
Figure 32A:
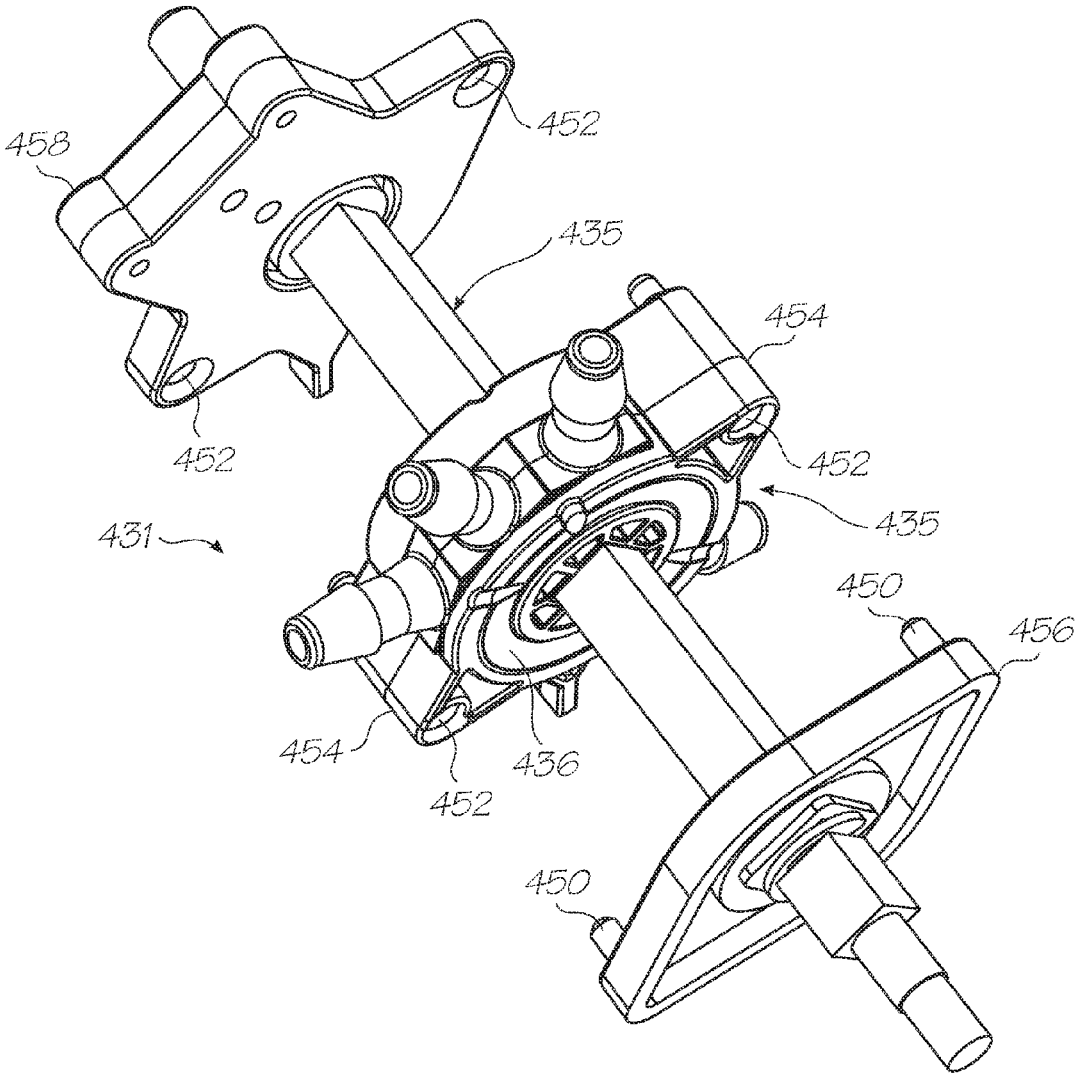
FIGS. 32A and 32B illustrate different views of a cylinder port arrangement for one fluid channel of the rotary valve.
Figure 32B:
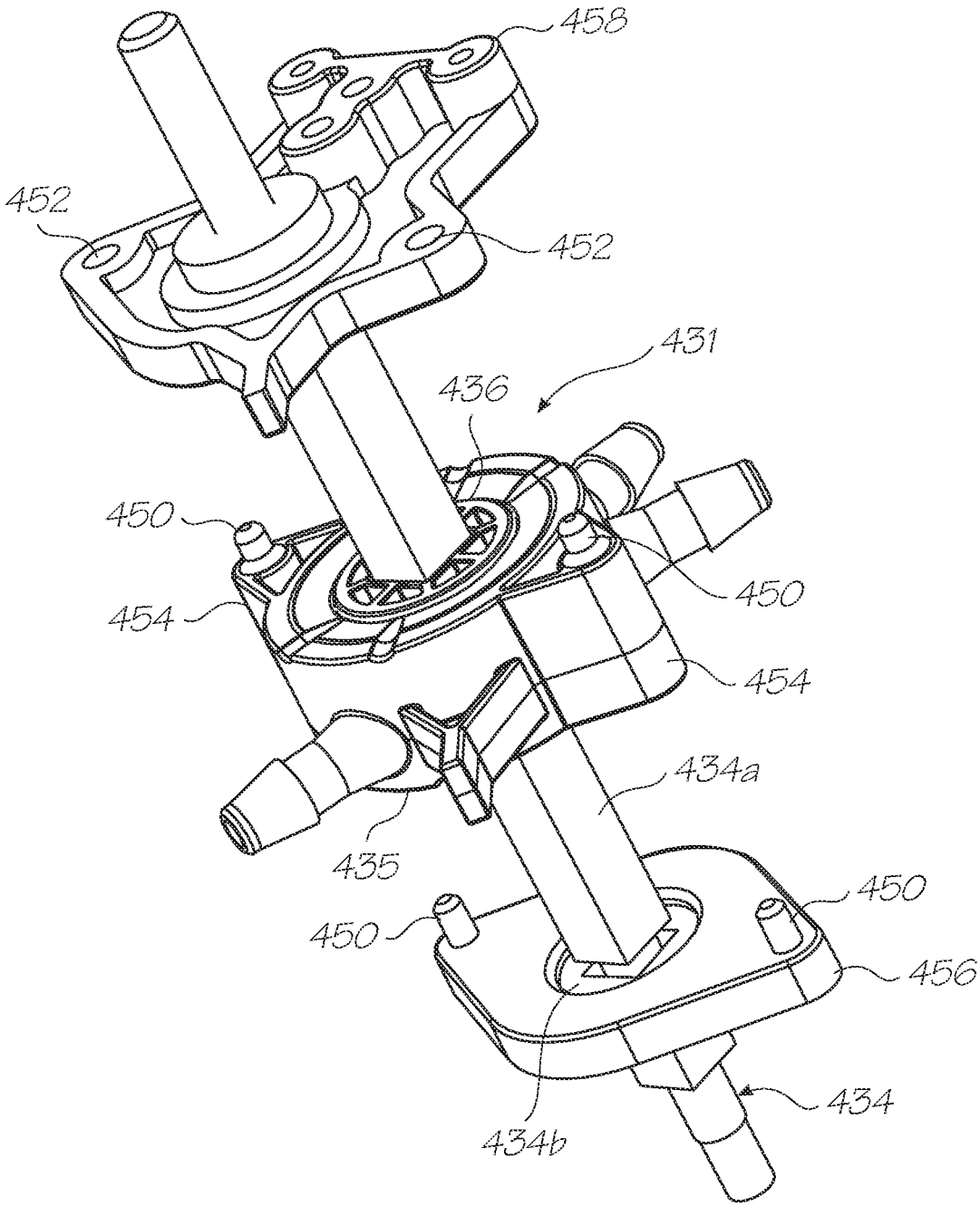
Figure 33B:
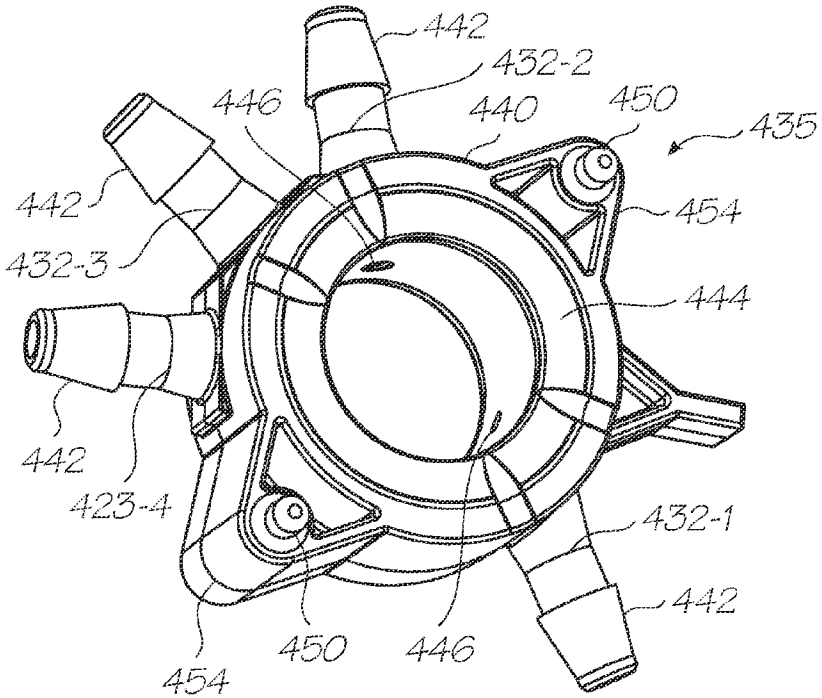
FIGS. 33A and 33B illustrate different views of a port cylinder of the rotary valve.
Figure 33A:
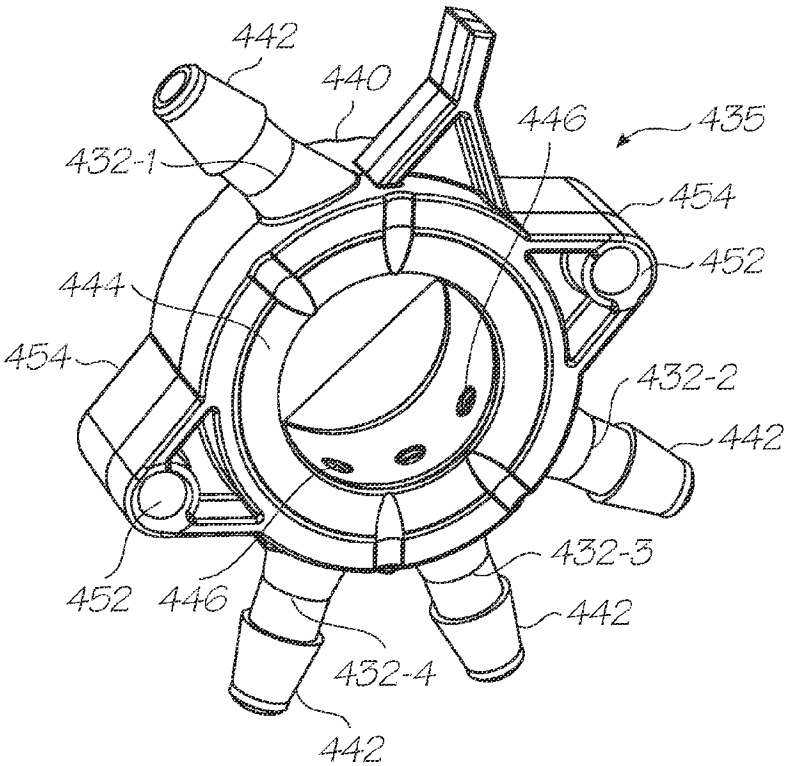

This is facilitated by providing the shaft 434 with a square spline section 434*a* which conforms with, and fits snugly into, an internal corresponding square spline form 455 of the channel cylinders 436, whilst positioning the end plate 456 over a gap 434*b* in the square spline section 434*a* and positioning the end plate 458 beyond the square spline section 434*a*, as illustrated in FIGS. 31 and 32B. In the drawings, an E-clip is shown as holding the end plate 456 in position over the gap 434*b* and a bushing is shown as holding the end plate 458 in position beyond the square spline section 434*a*, however other holding means are possible.

Rotation of the shaft 434 is provided through a cylinder drive arrangement 460. The cylinder drive arrangement 460 has a motor coupling 462 mounted at one end of the shaft 434 and an encoder disc 464 mounted at the other end of the shaft 434. The motor coupling 462 couples with a motor 466 to be rotated and the encoder disc 464 is part of an encoder 468 for sensing a rotated position of the shaft 434. However, other sensing or operational arrangements for controlling the rotated position of the shaft 434 are possible.

The encoder 468 has a structure well understood by one of ordinary skill in the art and outputs the sensing result to the control electronics 802 of the printer 100 so that operation of the motor 466 can be controlled by the control electronics 802 to select predetermined rotated positions of the channel cylinders 436 for selecting the valve states of Table 1. The motor 466 is preferably a stepper motor with uni-directional operation so that the shaft 434 and channel cylinders 436 are rotated in the one direction to effect the various port state changes.

However, other arrangements are possible, such as a bi-directional motor which allows both clockwise and anti-clockwise rotation of the shaft 434.

The associated channel cylinders 436, shaft 434, motor 466 and encoder 468 form a selection device for selecting the valve states detailed above by selectively sealing and unsealing the ink, printhead, bypass and air ports 432-1, 432-2, 432-3 and 432-4 through rotation of the channel cylinders 436.

Figure 34B:
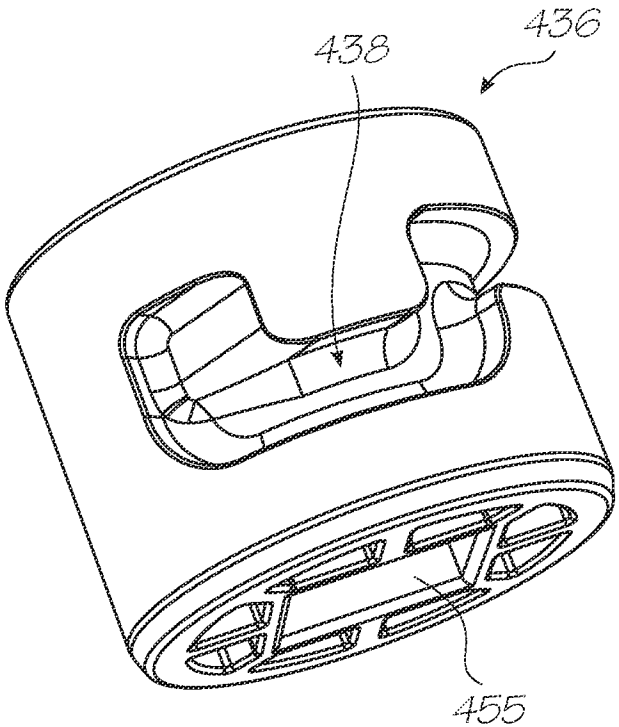
FIGS. 34A and 34B illustrate different views of a channel cylinder of the rotary valve.
Figure 34A:
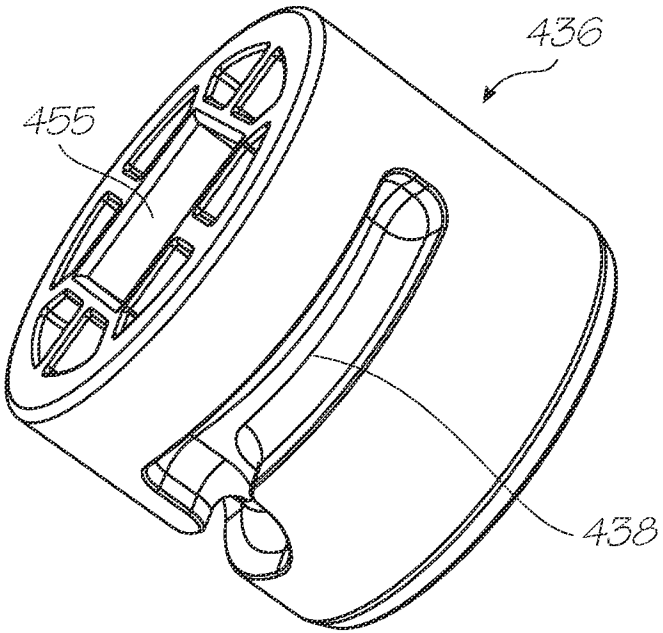

This is achieved, by snugly and sealingly fitting the port cylinders 435 over the associated the channel cylinders 436 and by forming the channel 438 of each channel cylinder 436 with a serpentine form as shown in FIGS. 34A and 34B so that depending upon the rotated position of the channel cylinders 436 relative to the port cylinders 435 some or all of the ports 432 in the port cylinders are aligned with a straight portion of the serpentine form of the associated channels 438 thereby allowing fluid flow therebetween, and the other or all of the ports 432 are blocked by the portions of the associated channel cylinders 436 at which the channels 438 are not present. In this way, as the channel cylinders 436 are rotated by the cylinder drive arrangement 460 each of the valve states of Table 1 can be simultaneously selected for the plural fluid channels In the illustrated embodiment, the ports and the straight portion of the serpentine form of the channels are arranged generally normal to the rotation direction of the channel cylinders on the shaft. Other arrangement are possible however, such as the ports being offset from each other and this normal direction and/or the channels being oblique relative this normal direction.

The use of the O-ring seals 448 between the port and channel cylinders eliminates the need to use lubrication materials, such as silicone, within the port arrangements 431 for providing the relative rotation between the port and channel cylinders. Accordingly, the amount of possible fluid contaminants within the fluid distribution system are reduced and compatibility with the fluids, such as ink, in the system is increased.

In the illustrated embodiment, individual port cylinders 435 are mounted over the individual channel cylinders 436 between the end plates 456,458. However, other arrangements are possible in which the individual port cylinders are integrally formed as a port arrangement and the individual channel cylinders are also integrally formed as a channel arrangement.

The above described diaphragm and rotary multi-path valves provide simple and effective structures for the automatic selection of the valve states of Table 1. Different structures or different drive mechanisms for driving the above described structures are possible however, so long as selection of the various valve states is provided.

In the above described embodiment of the fluid distribution system 300 of FIG. 8, the use of the 4-way valve and bypass line in the closed fluid path loop 348 assists in maintaining fluid pressure differentials across the printhead 200. However, the fluid distribution system can be configured so that fluid pressure differentials within tolerable levels can be obtained without use of the 4-way valve and bypass line.

Figure 37:
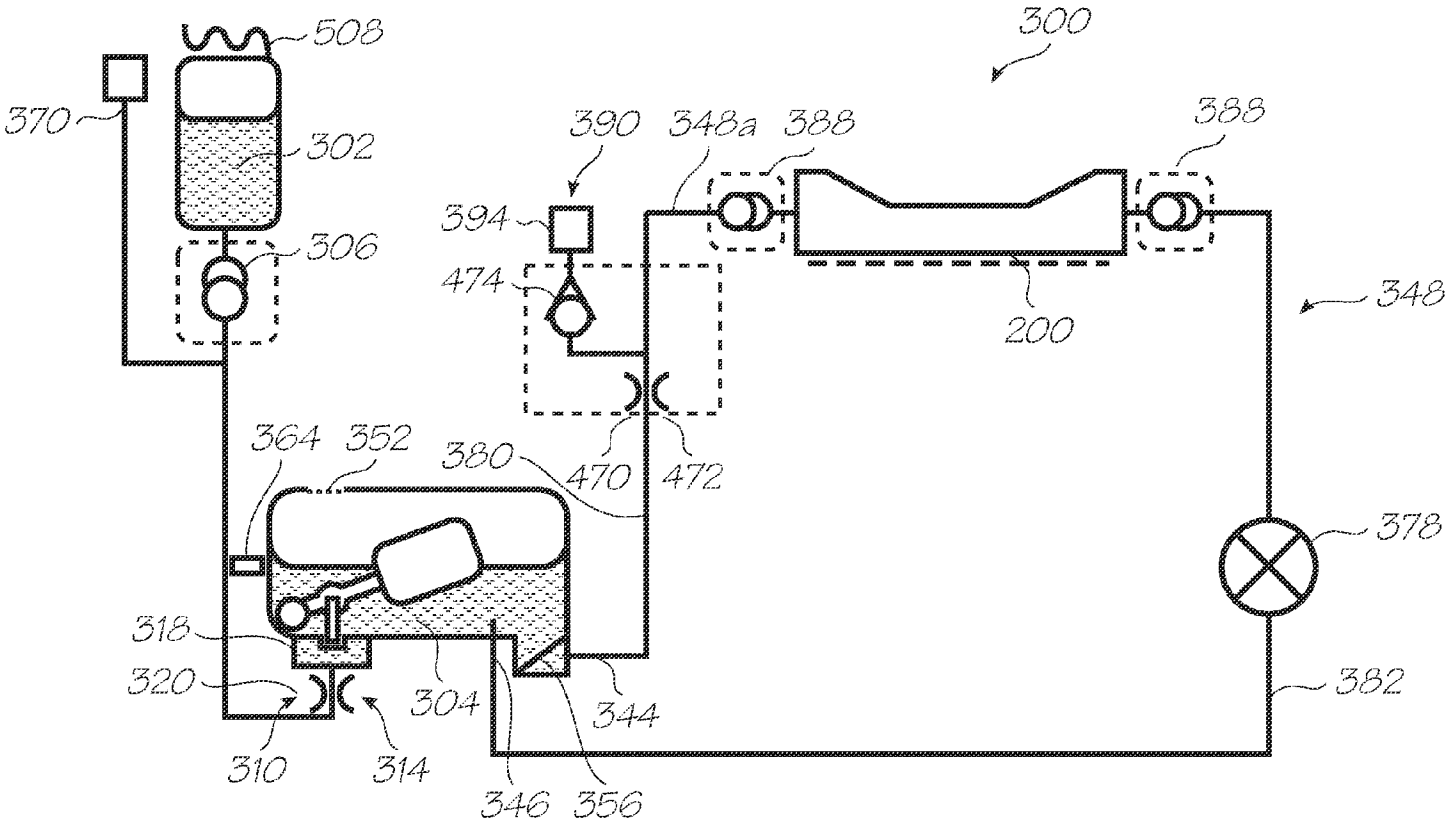
FIG. 37 schematically illustrates another embodiment of the fluid distribution system.
Figure 38A:
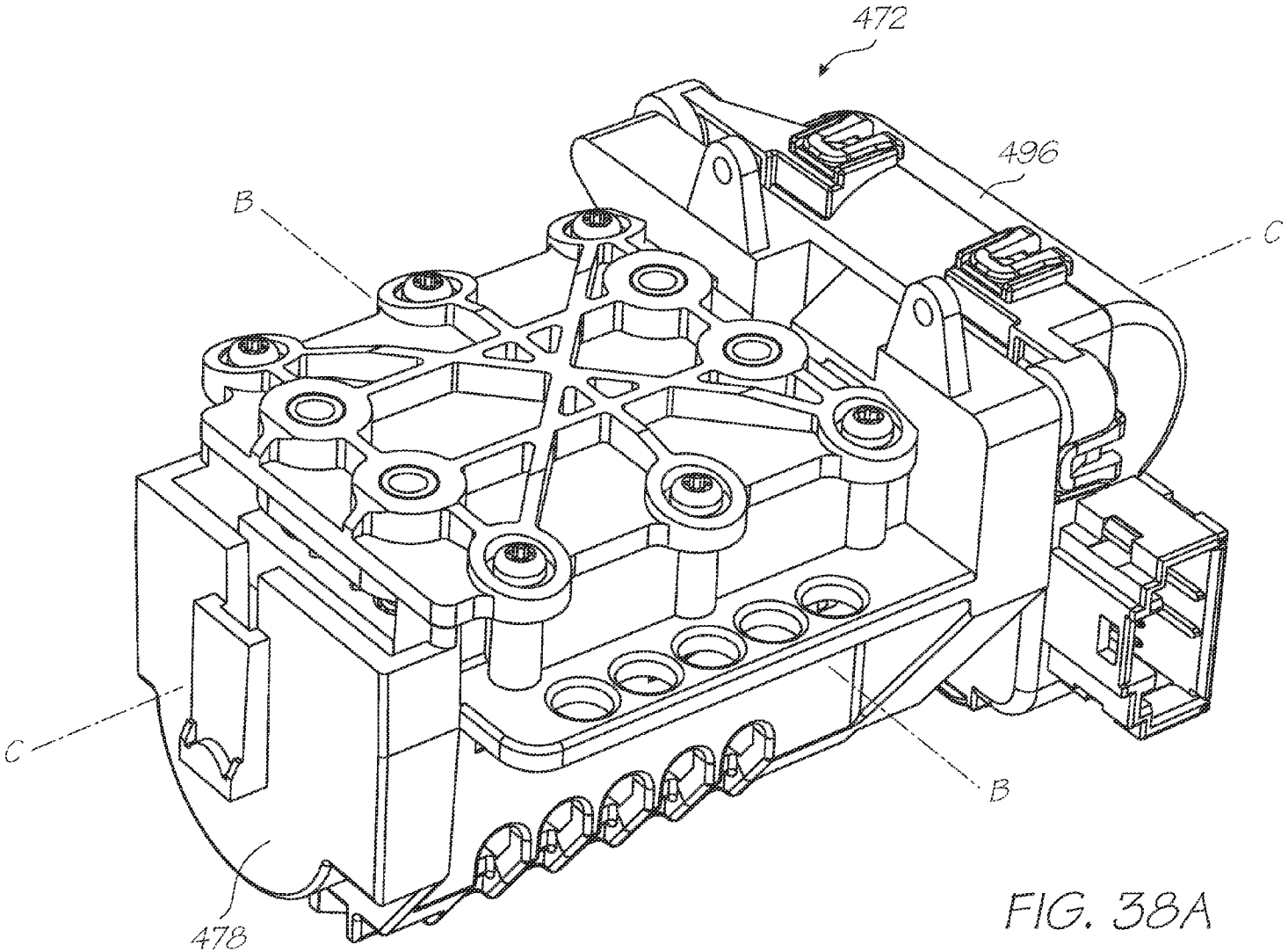
FIGS. 38A and 38B illustrates different views of an exemplary pinch valve of the fluid distribution system of FIG. 37.
Figure 38B:
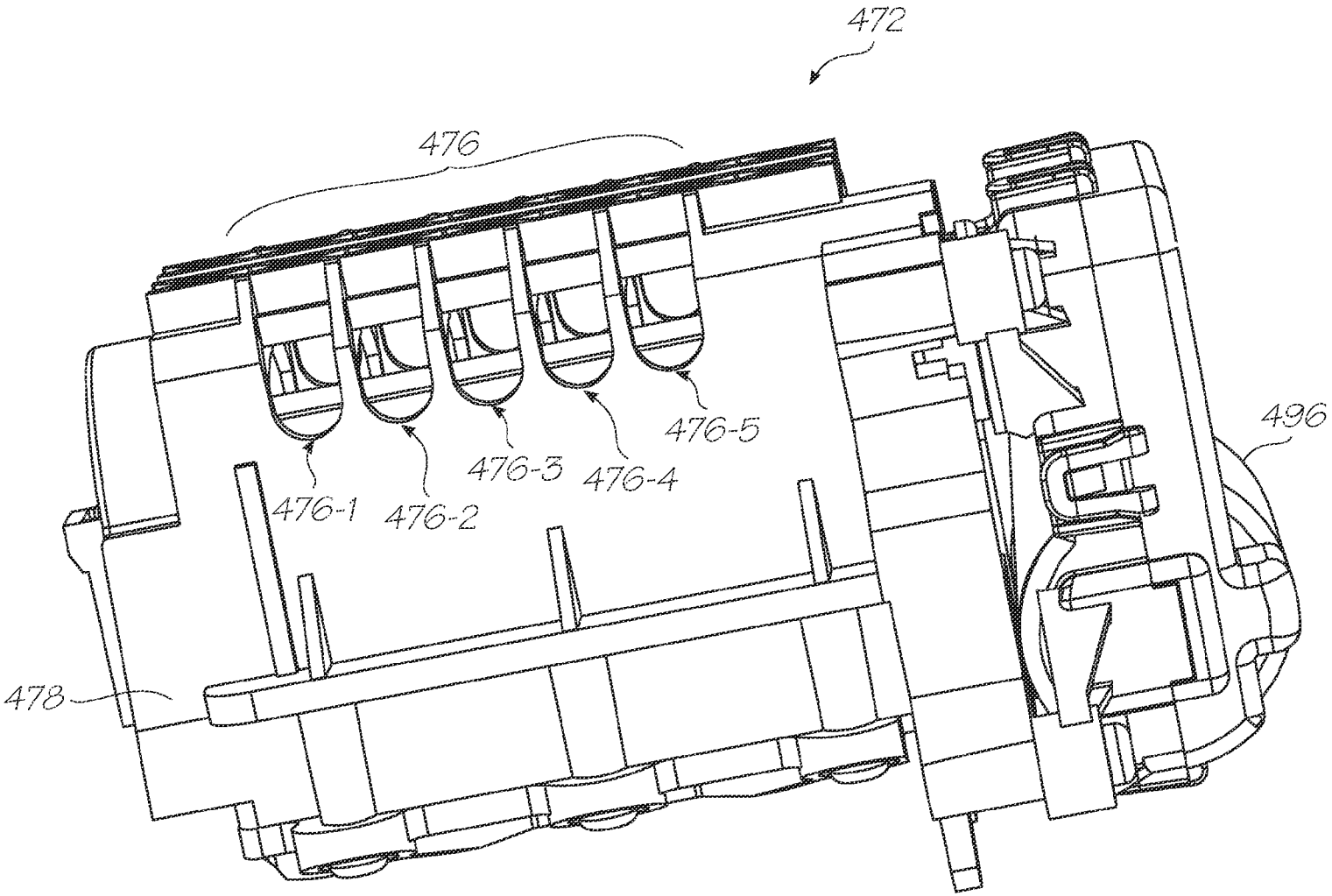
Figure 39:
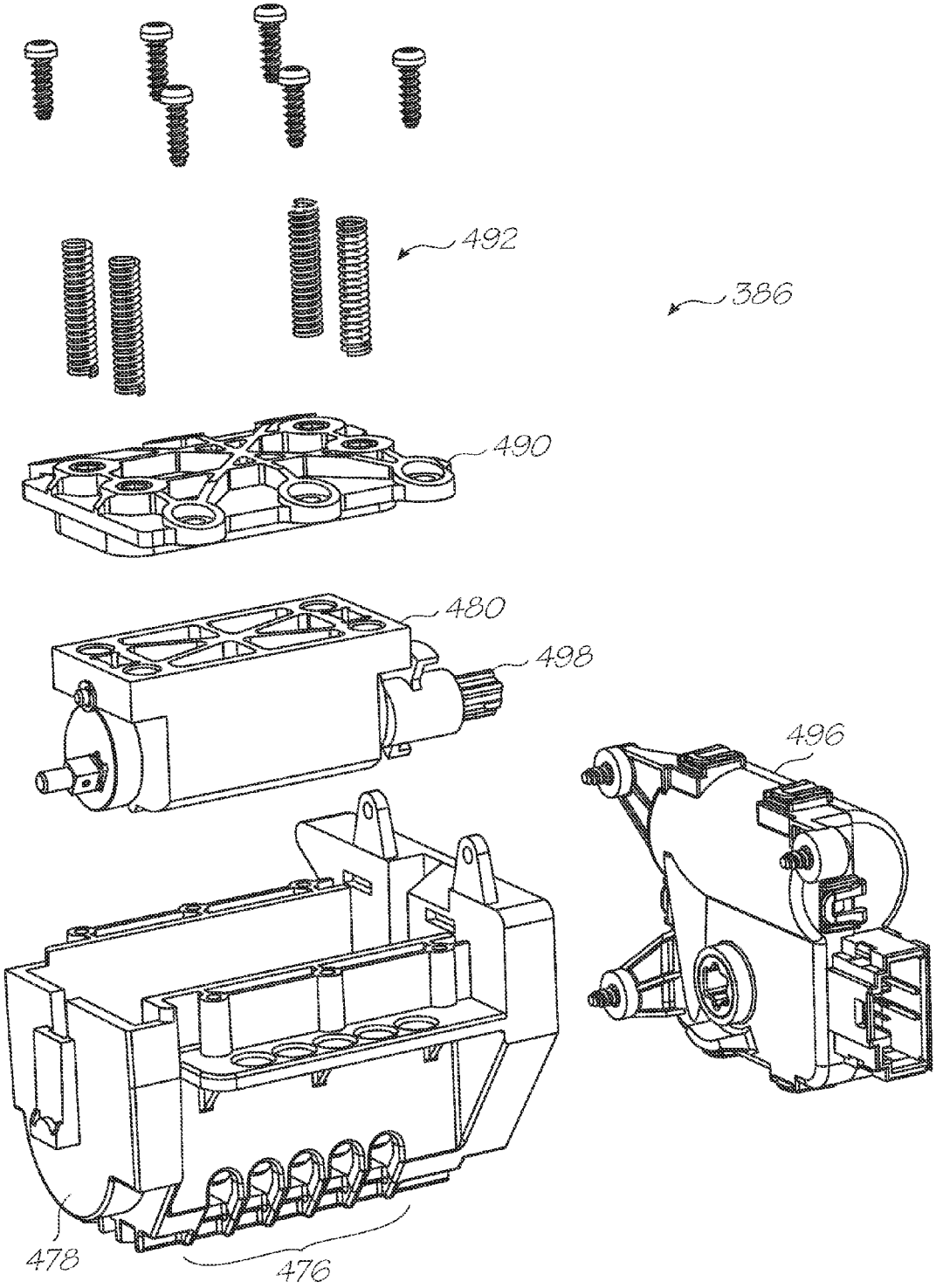
FIG. 39 illustrates an exploded view of the pinch valve.

FIG. 37 schematically illustrates an alternative embodiment of the fluid distribution system 300 for a single fluid, i.e., a single colored ink or other printing fluid, in which the bypass line and 4-way valve are omitted and an alternative valve arrangement is used.

In the embodiment of FIG. 37 all components labelled with the same reference numbers as in FIG. 8 are the same components described in relation to the embodiment of FIG. 8, including their material and dimensional selections. The embodiment of FIG. 37 differs from the embodiment of FIG. 8 only in that the valve 386 and the bypass line 384 are omitted and a multi-channel valve arrangement 470 is added.

The closed loop 348 of FIG. 37 comprises the printhead loop 348*a* of the print fluid line 380 between the accumulator tank outlet 344 and the printhead 200 and the pump fluid line 382 between the printhead 200 and the accumulator tank priming port 346. The valve arrangement 470 has a pinch valve 472 on the print line 380 and a check valve 474 which interconnects the de-prime vent 390 and print line. The vent line 392 of the de-prime vent 390 has one end connected to the check valve 474 and has the filter 394 disposed at the other end.

The state of the check valve 474 is controlled by the control electronics 802 of the printer 100 so that in the closed state of the check valve 474, the vent line 392 is isolated from the print line 380, and in the open state of the check valve 474, air can enter the system 300 via the de-prime vent 390. The check valve 474 has a structure and function well understood by one of ordinary skill in the art. A single check valve 474 can be provided for a single de-prime vent 390 in the system 300, or if the system has multiple de-prime vents 390, such as the five discussed earlier, a separate check valve 474 can be provided for each de-prime vent 390.

The exemplary pinch valve 472 illustrated in FIGS. 38A to 43B, like the 4-way valve 386, is a multi-channel valve. The pinch valve 472 has five port or aperture groups 476, respectively labelled 476-1, 476-2, 476-3, 476-4 and 476-5, in series along a body or housing 478 providing five fluid channels when the tubing of the five print lines 380 are inserted through the respective aperture groups 476. A pinch element 480 is disposed in the housing 478 extending across the aperture groups 476. The pinch element 480 has a feature 482 configured to be brought into and out of contact with the print line tubing to selectively "pinch" the tubing and thereby selectively obstruct and allow fluid flow through the print lines, respectively.

In the illustrated example, the feature 482 has a semi-cylindrical form and a corresponding semi-cylindrical feature 482 of the housing 478 is aligned therewith. This provides a pinch zone on the tubing of two half-rounds, which minimizes the pinch force required to cease fluid flow through the pinched print lines (see FIGS. 40A and 40B).

The movement of the pinch element 480, which effects this pinching contact, is provided by a pinch drive arrangement 484 disposed in the housing 478. The pinch drive arrangement 484 has a shaft 486 rotatably mounted to the housing 478 on which two eccentric cams 488 are fixedly mounted in parallel, a plate 490 fixedly mounted to the housing 478, springs 492 disposed between, and interconnecting, the pinch element 480 and the plate 490, and an optical interrupt element 494. The shaft 486 has a square spline section 487 which cooperates with an internal corresponding square spline form 489 of the cams 488 which conforms with, and fits snugly onto, the square spline section 487 of the shaft 486. This cooperation ensures that the cams 488 are accurately rotated with rotation of the shaft 486.

The springs 492 are configured to bias the pinch element 480 away from the securely mounted plate 490. The springs 492 are preferably compression springs and there are preferably four springs symmetrically arranged about the pinch element and plate as illustrated in the drawings, but other arrangements are possible.

Figure 41A:
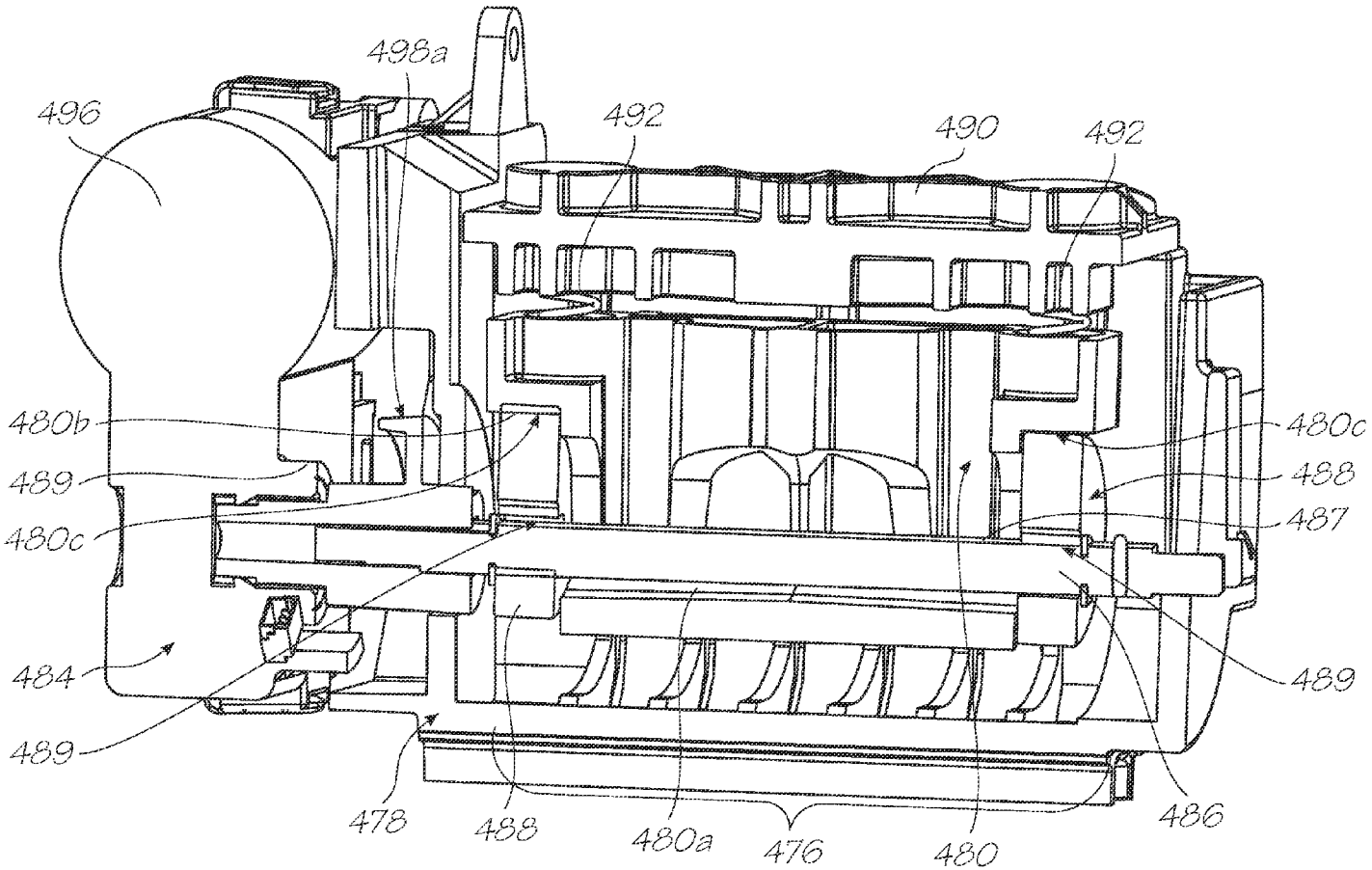
FIG. 41A illustrates a cross-sectional view along line C-C in FIG. 38A of the pinch valve in the open state.
Figure 41B:
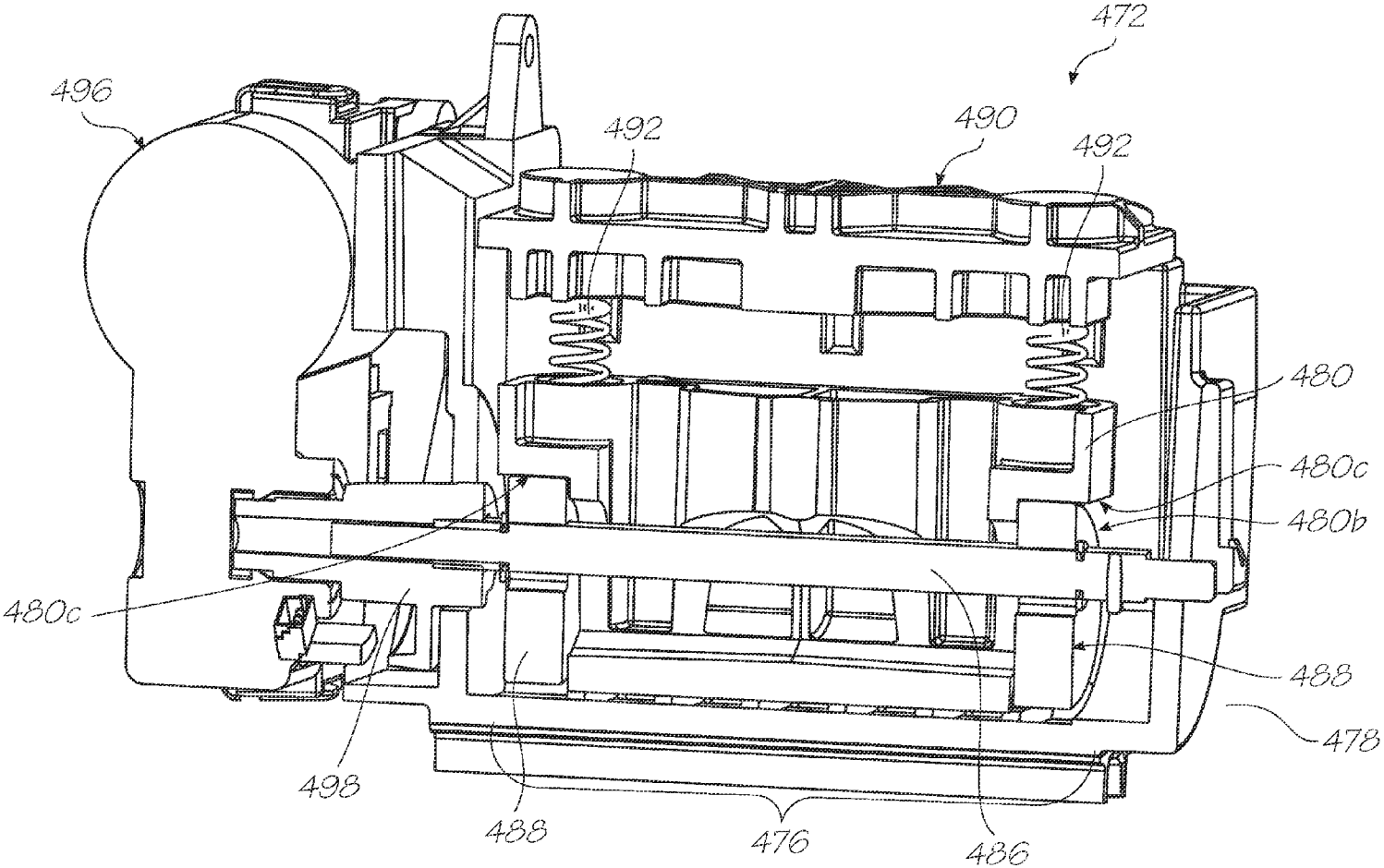
FIG. 41B illustrates the cross-sectional view of FIG. 41A with the pinch valve in the closed state.

As illustrated in the cross-sectional views of FIGS. 41A and 41B, the shaft 486 passes through a channel 480*a* in the pinch element 480 so as to be located within the pinch element 480 and between the aperture groups 476 and the springs 492. One each of the two cams 488 is mounted at either longitudinal end of the shaft 486 so as to be located within a recess 480*b* on opposite sides of the pinch element 480. The pinch element 480 has engagement faces 480*c* within the recesses 480*b* which are aligned with, and selectively engage, the cams 488 due to the eccentricity of the cams 488 and the biasing of the springs 492.

Figure 40A:
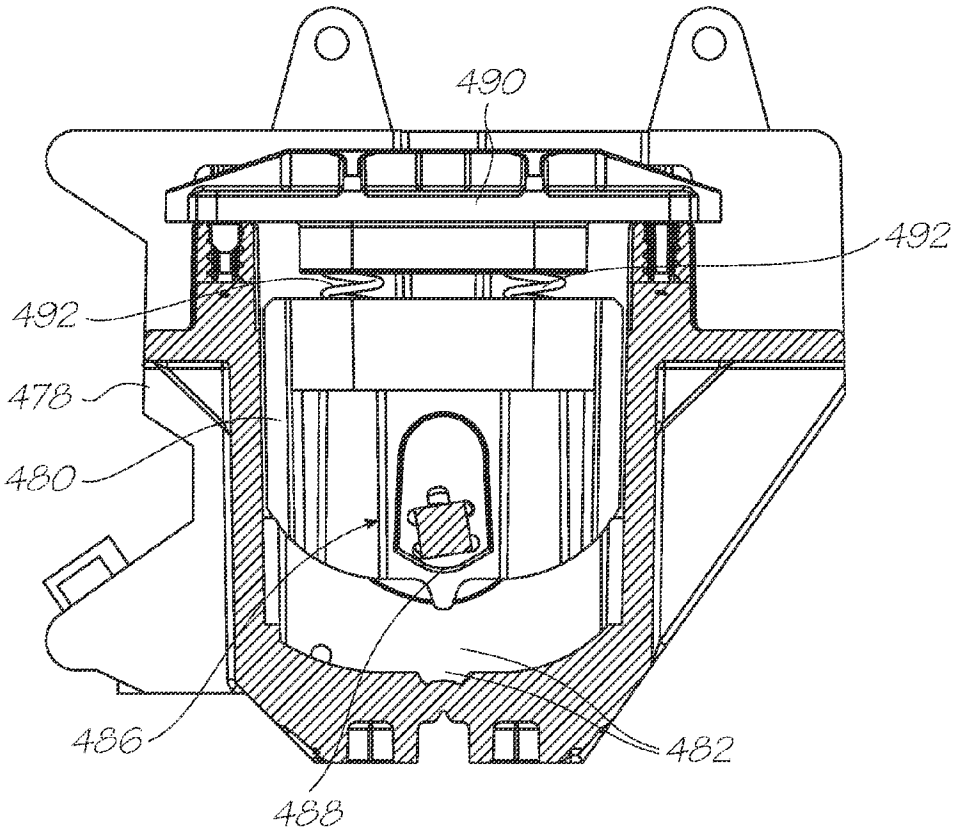
FIG. 40A illustrates a cross-sectional view along line B-B in FIG. 38A of the pinch valve in an open (non-pinched) state.

When the pinch valve 472 is in the open (non-pinched) state, the feature 482 of the housing 478 is not in the pinch zone so that no obstruction of the print line tubing is made. The open state is provided by rotating the shaft 486 so that the cams 488 engage the engagement faces 480*a* of the pinch element 480 and force the pinch element 480 toward the plate 490 against the bias of the springs 492, as illustrated in FIGS. 40A and 41A.

Figure 40B:
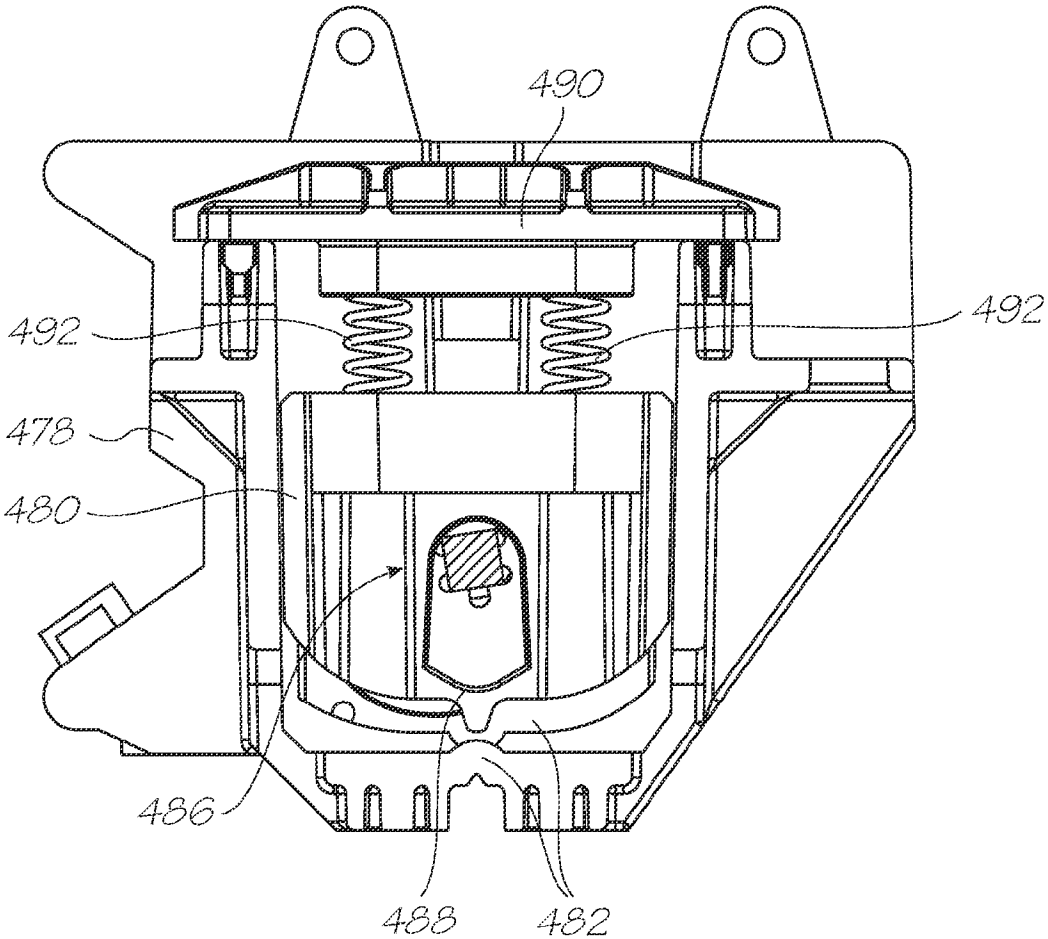
FIG. 40B illustrates the cross-sectional view of FIG. 40A with the pinch valve in a closed (pinched) state.

When the pinch valve 472 is in the closed (pinched) state, the feature 482 of the housing 478 is in the pinch zone so that the print line tubing is obstructed. The closed state is provided by rotating the shaft 486 so that the cams 488 disengage the engagement faces 480*a* of the pinch element 480 thereby allowing the pinch element 480 to be forced away from the plate 490 with the bias of the springs 492 and into contact with the print line tubing, as illustrated in FIGS. 40B and 41B.

Figure 42A:
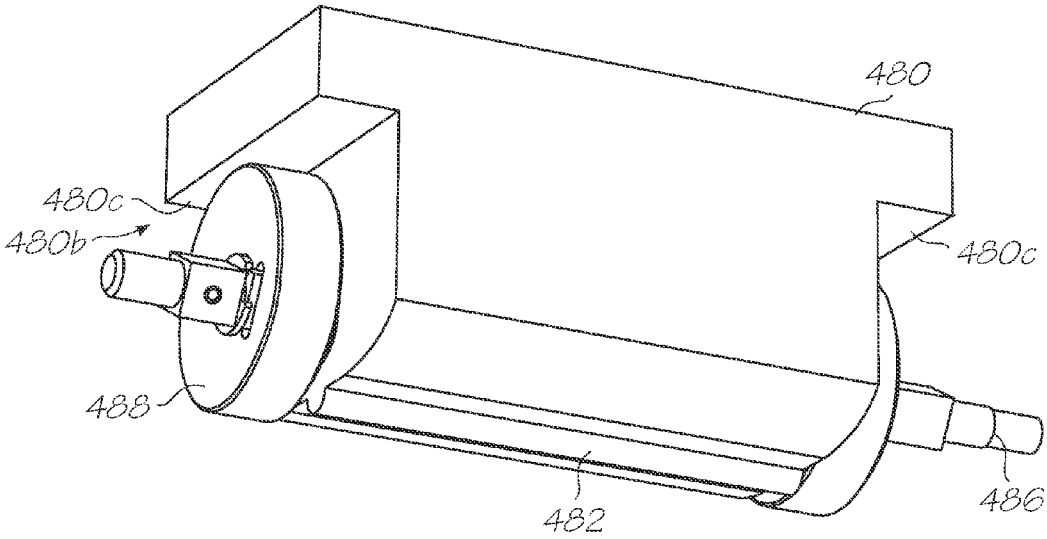
FIG. 42A illustrates one exemplary cam drive arrangement of the pinch valve.
Figure 42B:
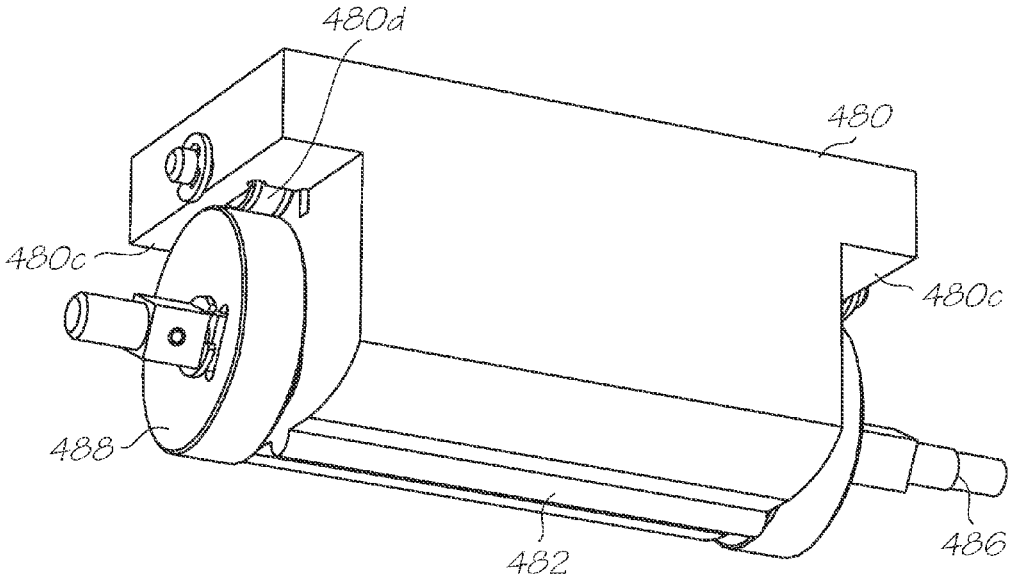
FIG. 42B illustrates another exemplary cam drive arrangement of the pinch valve.

This arrangement of the cams 488 contacting the engagement faces 480*c* of the pinch element 480 directly in the closed state of the pinch valve 472 is illustrated in isolation in FIG. 42A. Similar operation is provided by arranging roller bearings 480*d* in the engagement faces 480*c* of the pinch element 480. One roller bearing 480*d* is illustrated in FIG. 42B. These roller bearings 480*d* contact the cams 488 in the closed state of the pinch valve 472 and facilitate smooth rolling of the cams 488 during the rotation of the shaft 486.

The pinch drive arrangement 484 further has a motor 496 which is coupled at one end of the shaft 486 by a motor coupling 498 to provide the rotation of the shaft 486. The motor coupling 497 is provided with a projection 498*a* with which the optical interrupt element 494 cooperates to sense a rotated position of the shaft 486.

Figure 43A:
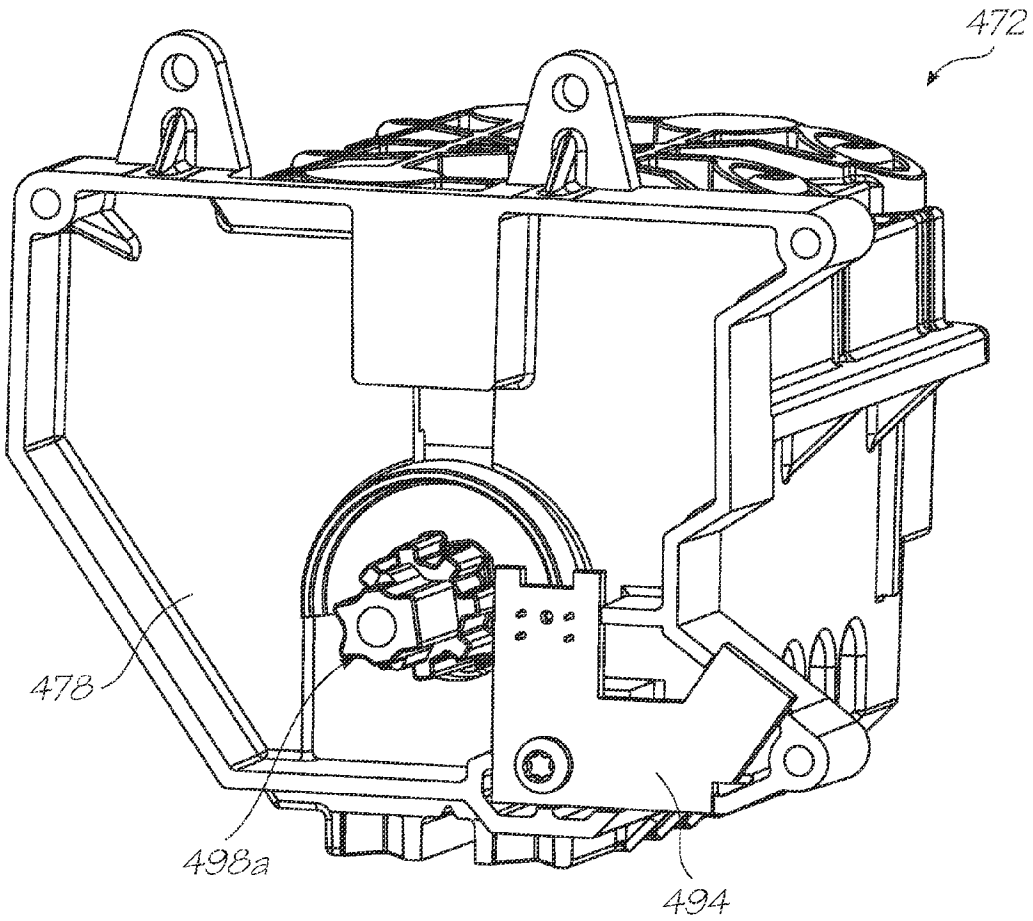
FIG. 43A illustrates an end view of the pinch valve in the open state.
Figure 43B:
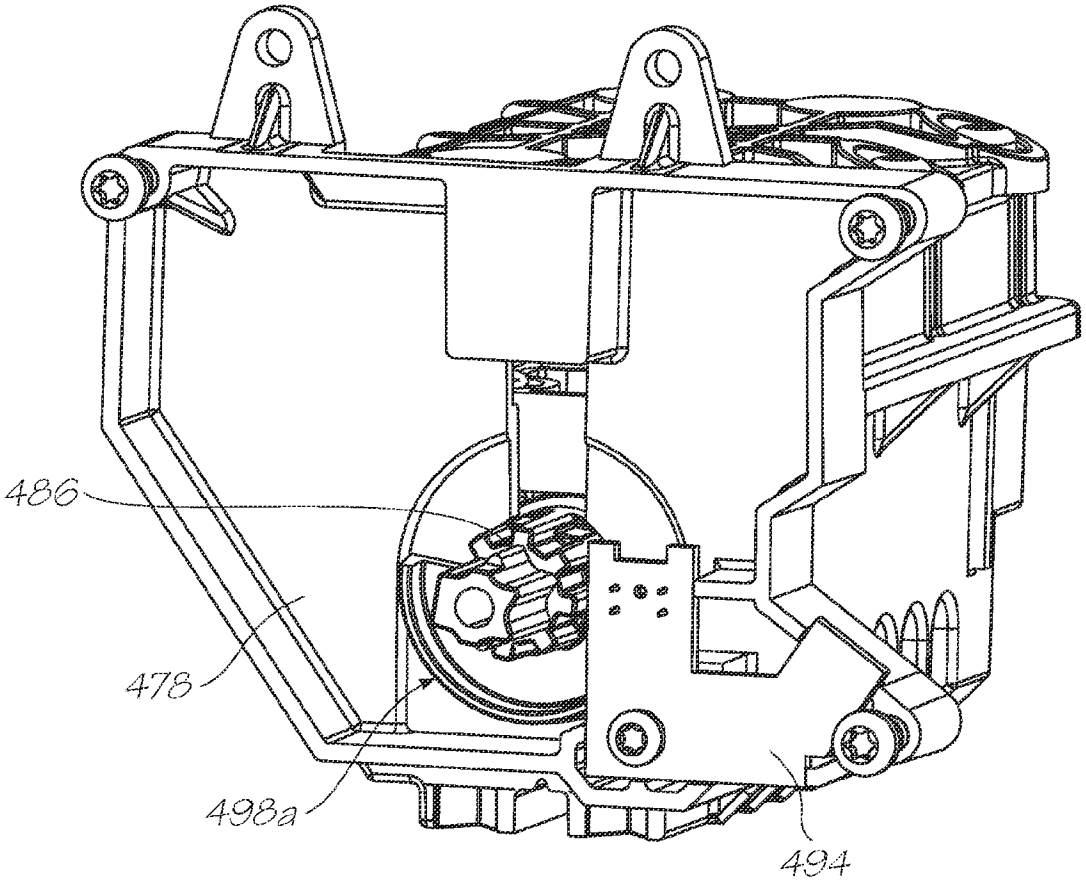
FIG. 43B illustrates the end view of FIG. 43A with the pinch valve in the closed state.

In particular, the projection 498*a* is preferably a half-circular disc dimensioned to pass between an optical emitter and optical sensor of the optical interrupt element 494, and the optical interrupt element 494 is disposed as illustrated in FIGS. 43A and 43B so that when the pinch valve 472 is open the projection 498*a* does not obstruct the emitter and sensor of the optical interrupt element 494 (see FIG. 43A) and when the pinch valve 472 is closed the projection 498*a* obstructs the emitter and sensor of the optical interrupt element 494. However, other sensing or operational arrangements for controlling the rotated position of the shaft 486 are possible.

The pinch element 480 and pinch drive arrangement 484 form a selection device for selecting the valve states detailed below by selectively closing and opening the pinch valve.

The optical interrupt element 494 has a structure well understood by one of ordinary skill in the art and outputs the sensing result to the control electronics 802 of the printer 100 so that operation of the motor 496 can be controlled by the control electronics 802 to select predetermined rotated positions of the cams 488 for selecting the pinch valve states of Table 3.

The motor 496 is preferably a stepper motor with unidirectional operation so that the shaft 486 and cams 488 are rotated in the one direction to effect movement of the pinch element 480 relative to the plate 490 and print line tubing. However, other arrangements are possible, such as a bi-directional motor which allows both clockwise and anti-clockwise rotation of the shaft 486.

In the above described embodiment of the pinch valve, the housing 478, pinch element 480, plate 490 and motor coupling 498 are each preferably formed of a plastics material, such as 20% glass fibre reinforced acrylonitrile butadiene styrene (ABS) for the housing and plate, Acetal copolymer for the pinch element, and 30% glass fibre reinforced ABS for the motor coupling. Further, the cam shaft 486 and cams 488 are preferably formed of a metal, such as aluminium.

The states of the check and pinch valves of the valve arrangement 470 are shown in Table 3. In Table 3, an "X" indicates that the associated state is selected and a blank indicates that the associated state is not selected.

TABLE 3 pinch and check valve states

| | PINCH VALVE | | CHECK VALVE | |
|---|---|---|---|---|
| STATE | Open | closed | open | closed |
| PRIME | X | | | X |
| PRINT | X | | | X |
| FLUSH | X | | | X |
| STANDBY | X | | | X |
| PULSE | | X | | X |
| NULL | | X | | X |
| DEPRIME | | X | X | |

The manner in which these state settings of the valve arrangement 470 are used is now discussed with respect to the schematic outlay illustrated in FIG. 37.

Figure 44:
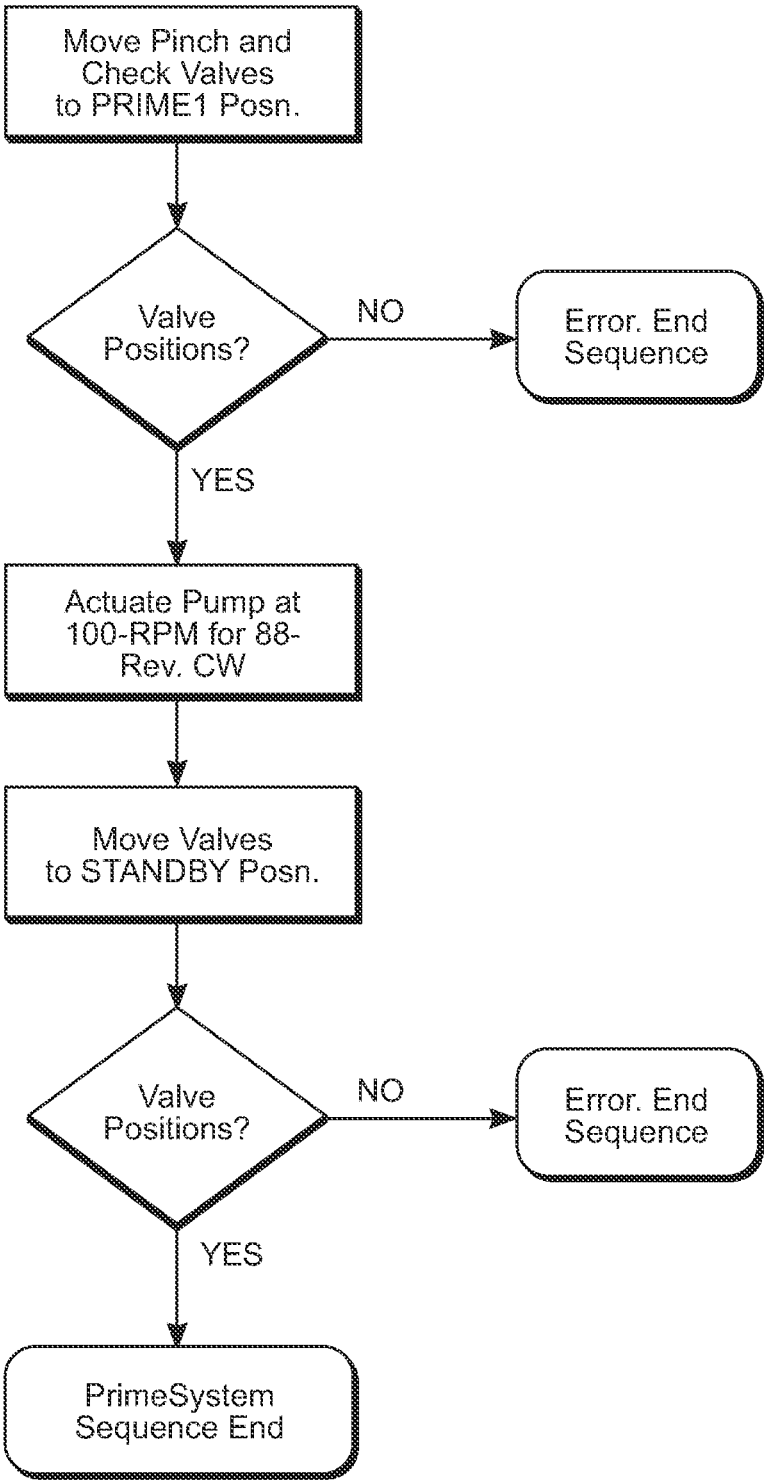
FIG. 44 illustrates an alternative priming procedure of the fluid distribution system.

At the first power up of the printer 100 and at times subsequent to first power up when priming is required, the fluid distribution system 300 is primed, air in the printhead 200 is displaced to the accumulator tank via the priming port 346, and it is ensured that the pump 378 is fully wetted prior to beginning any further volumetric pumping procedures. As is illustrated in FIG. 44, in this priming procedure the valves 472 and 474 are set to PRIME and the pump is operated in the clockwise direction for 88 revolutions at 100 rpm so that ink is moved from the accumulator tank outlet 344 to the accumulator tank priming port 346 via the print line 380, printhead 200 and pump line 382 priming the closed loop 348. Then, the valves 472 and 474 are set to STANDBY.

When printing is to be carried out, the valves 472 and 474 are set to PRINT and ejection of ink from the nozzles causes ink flow from the accumulator tank to the printhead via the print line 380. After printing, the valves 472 and 474 are set to STANDBY.

Figure 45:
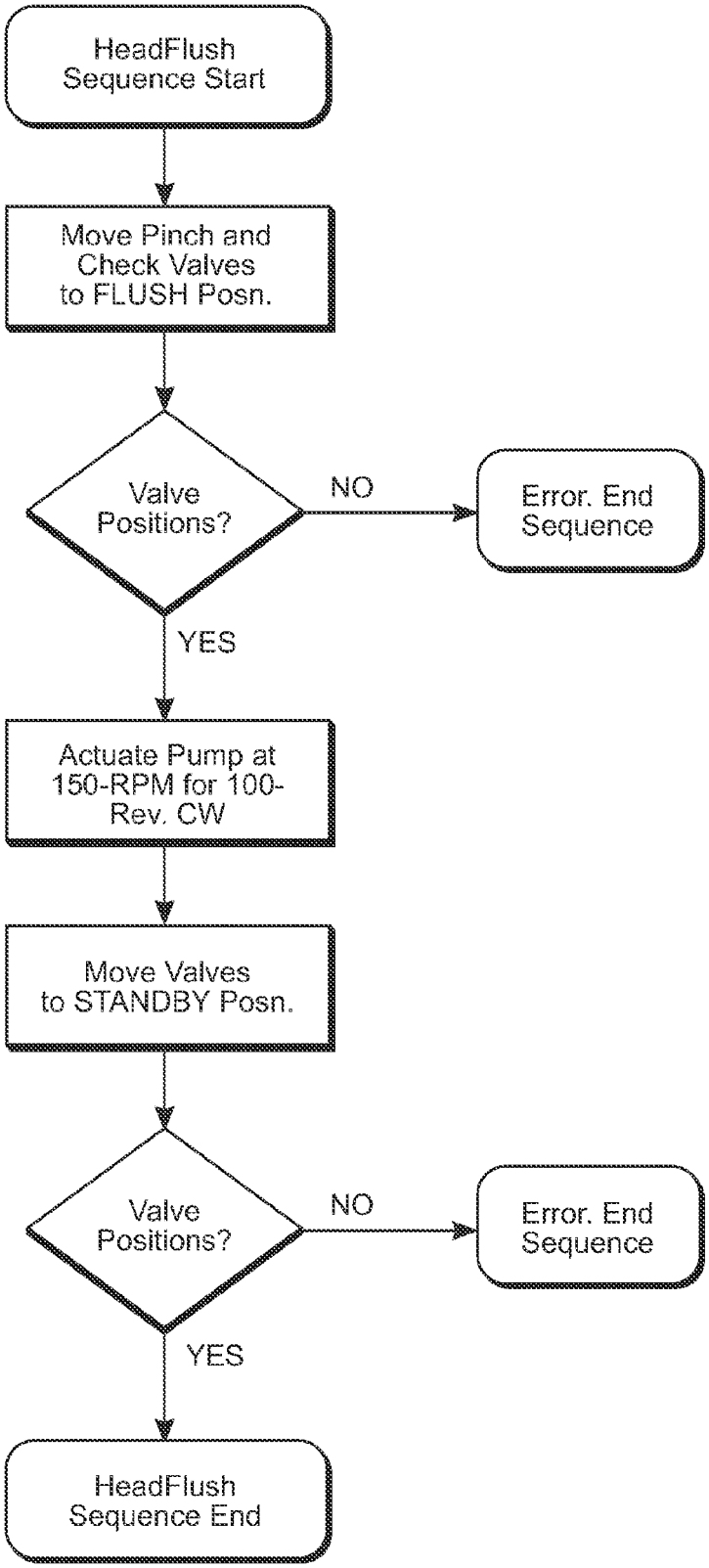
FIG. 45 illustrates an alternative printhead flush procedure of the fluid distribution system.

At times it is necessary to recover the printhead from mild dehydration of ink at the nozzles as well to flush back channel gas bubbles from the printhead. As is illustrated in FIG. 45, in this printhead flush procedure the valves 472 and 474 are set to FLUSH and the pump is operated in the clockwise direction for 100 revolutions at 150 rpm to move fresh ink into the printhead and to move any gas bubbles to the accumulator tank via the priming port 346. Then, the valves 472 and 474 are set to STANDBY.

Figure 46:
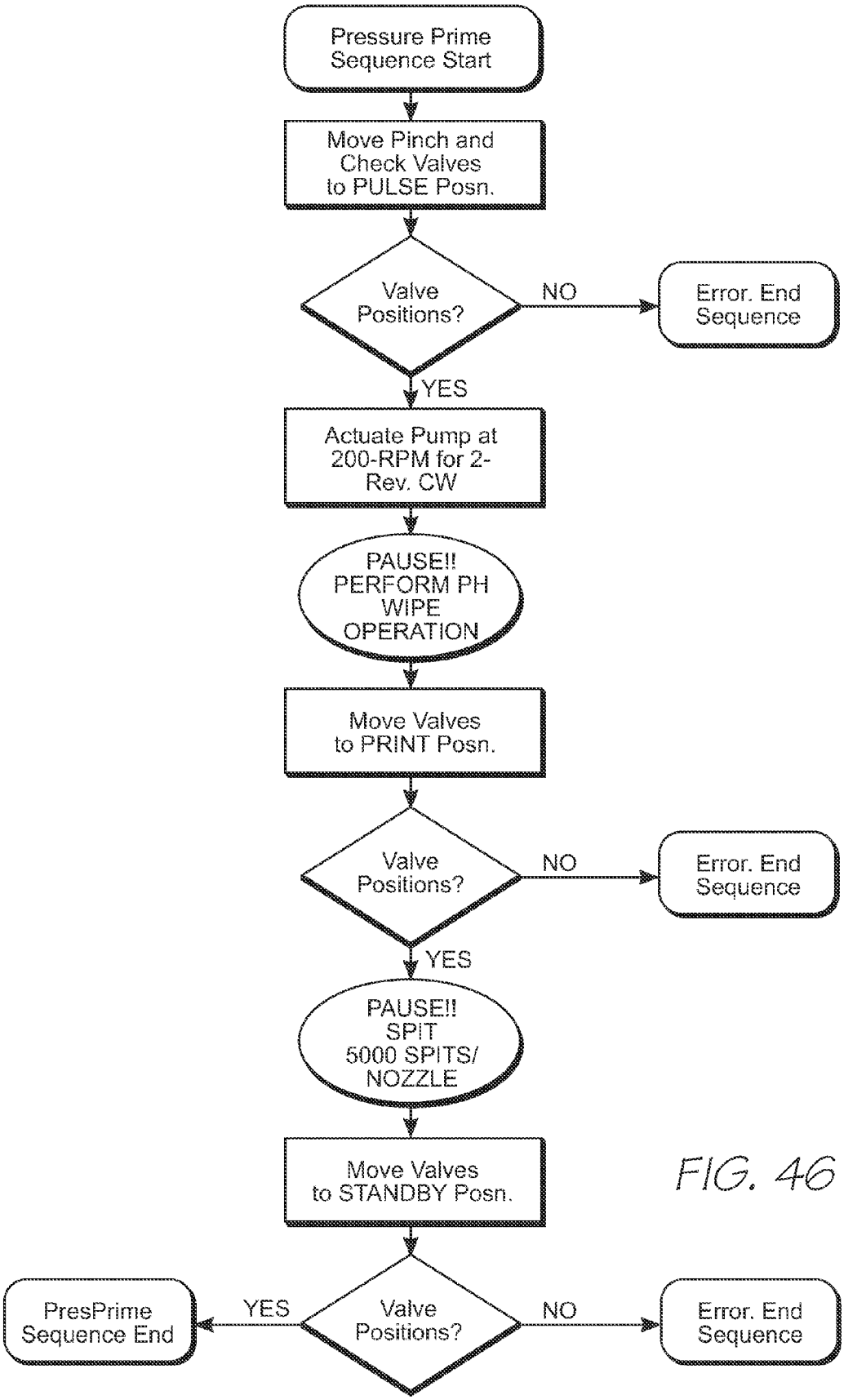
FIG. 46 illustrates an alternative pressure prime procedure of the fluid distribution system.

At times it is necessary to recover the printhead from heavy dehydration and/or remove air bubbles trapped within the fine ink delivery structure of the printhead 200 by priming the printhead at increased fluid pressure. As illustrated in FIG. 46, in this pressure prime procedure the valves 472 and 474 are first set to PULSE and the pump is operated in the anticlockwise direction for 2 revolutions at 200 rpm to cause ink to be egested from the nozzles of the printhead. Then, the maintenance system 600 is operated to wipe the ejection face of the printhead so as to remove the egested ink, as described in the incorporated description of US Provisional Patent Application No. 61/345,559. Then, the valves 472 and 474 are set to PRINT and the printhead is operated so that each nozzle ejects 5000 drops. This "spitting" operation of the printhead is carried out in relation to an absorber of the maintenance system 600, described in the incorporated description of US Provisional Patent Application No. 61/345,559. Then, the valves 472 and 474 are set to STANDBY.

It is important to note in this pressure prime procedure that the printhead wipe is performed before moving the valves 472 and 474 from the PULSE setting to the PRINT setting. This is to prevent the ink on the ejection face of the printhead being sucked into the nozzles due to the negative fluid pressure at the nozzles which is established when the accumulator tank is reconnected to the printhead via the printhead loop 348*a* when the valve 472 is opened.

The Applicant has found that the pressure priming can result in color mixing. The spitting of 5000 drops from each nozzle of the printhead has been found by the Applicant to sufficiently clear this color mixing. This spitting procedure equates to about 0.35 milliliters of ink being spat out by the entire printhead when the ejection drop size of each nozzle is about one picoliter.

Figure 47:
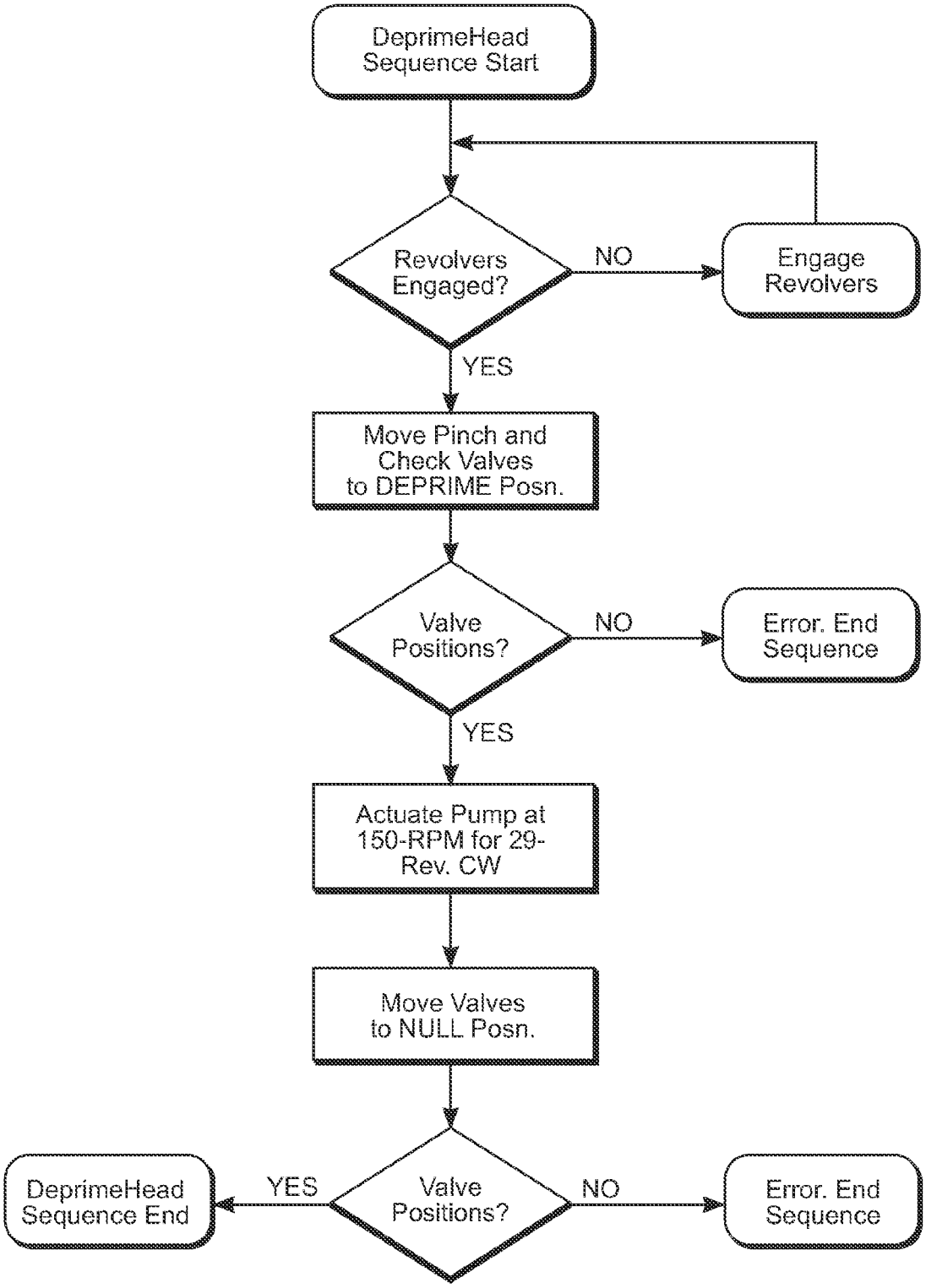
FIG. 47 illustrates an alternative de-prime procedure of the fluid distribution system.
Figure 48:
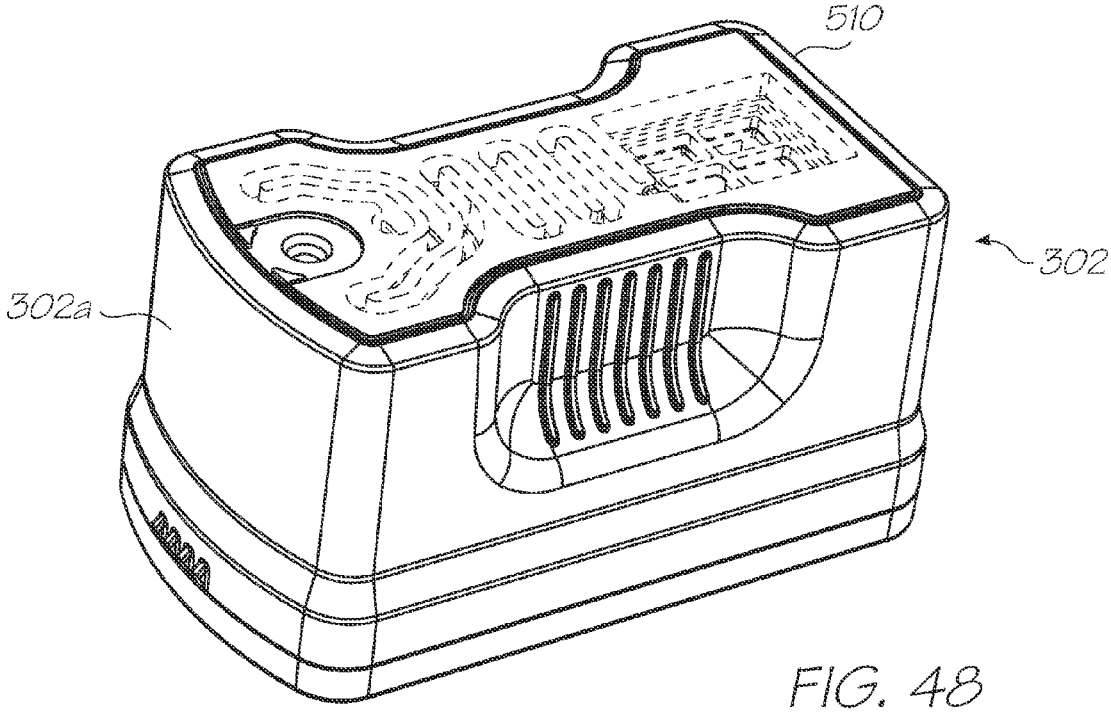
FIG. 48 illustrates a supply tank of the fluid distribution system.

When the printhead 200 is to be removed from the fluid distribution system 300, long term storage of the printer 100 is desired or an empty supply tank is not replaced or refilled within a certain period (e.g., 24 hours), it is necessary to de-prime the printhead. As illustrated in FIG. 47, in this de-prime procedure the valves 472 and 474 are set to DEPRIME and the pump is operated in the clockwise direction for 29 revolutions at 150 rpm to de-prime the print line 380, printhead 200 and pump line 382 by allowing air to pass through the printhead from the de-prime vent 390 which pushes the ink from the print line 380, the printhead and the pump line 382 into the accumulator tank so that the ink is moved into the pump line 382 to at least a leak safe location downstream of the pump relative to the printhead. Then, the valves 472 and 474 are set to NULL, which closes the valves 472 and 474 and thereby allows leak safe removal of the printhead or the like.

The above described values for the pump operation in the various priming and de-priming procedures are approximate and other values are possible for carrying out the described procedures. Further, other procedures are possible and those described are exemplary. The levels of uncertainty in the described values, where appropriate, are shown in Table 4.

TABLE 4 pump operation value ranges

| Procedure | Pump Action | RPM | No. of Revs. | Time |
|---|---|---|---|---|
| (Power up) prime | prime printhead | 100 +/− 20 | 88 +/− 8 | 52.8 s |
| Printhead flush | bubble flush the printhead | 150 +/− 50 | 100 +/− 50 | 40 s |
| Pressure prime | push ink out through nozzles | 200 +/− 50 | 2 + 2/−0 | 0.8 s |
| De-prime | de-prime printhead | 150 +/− 50 | 29 +/− 3 | 11.6 s |

The above described de-prime procedures of the multi-path valve clears the printhead of ink with about 1.8 milliliters of ink being left in the printhead, which was determined by the Applicant through relative weight measures of the printhead prior to first priming and after de-priming. This is considered the dry-weight of the printhead.

The described diaphragm and rotary valves and the pinch valve arrangement for the fluid distribution system are exemplary, and other alternative arrangements are possible to provide selective fluid communication within the closed fluid loop of the system, such as the dual pinch valve arrangement described in the US Provisional Patent Application No. 61/345,572, the entire contents of which is hereby incorporated by reference.

Some requirements for the functional attributes of the valve arrangement for ink distribution and air intake that are met by the described diaphragm and rotary valves and the pinch valve arrangement, and which should be met by any alternative arrangement, are shown in Table 5.

TABLE 5 valve specification requirements

| ITEM | SPECIFICATION | NOTE |
|---|---|---|
| pressure loss at max flow rate | less than 10 mm at 15 mL/min per channel | allowable flow loss of ink flowing through the valve in open condition |
| ink leak rate @ pressure | 0.1 cc/min @ 10 psi | leak rate of ink across the ink sealing surfaces |
| air leak rate | 0.05 cc/day | air leak rate into the ink lines |
| life | 50000 cycles over three years | |
| physical size | 50 × 42 × 100 mm | envelope to fit the five valve assembly and drive components |
| burst pressure | 150 KPa (22 psi) | maximum pressure valve can survive |
| trapped air | less than 0.05 cc of air per channel | amount of air allowed in the ink path of the valve after priming |
| barb size of tubing connectors | 3.18 mm | |
| valve actuation | automatically actuated with feedback for valve states | requires motor transmission and sensor/encoder |
| transition time | two seconds to change from standby state to print state | |

As discussed above, upon depletion, the supply tanks 302 are disconnected from the system 300 at the coupling 306, either replaced or refilled either in situ or remote from the system 300, and then reconnected to the system 300 via the coupling 306.

Figure 49:
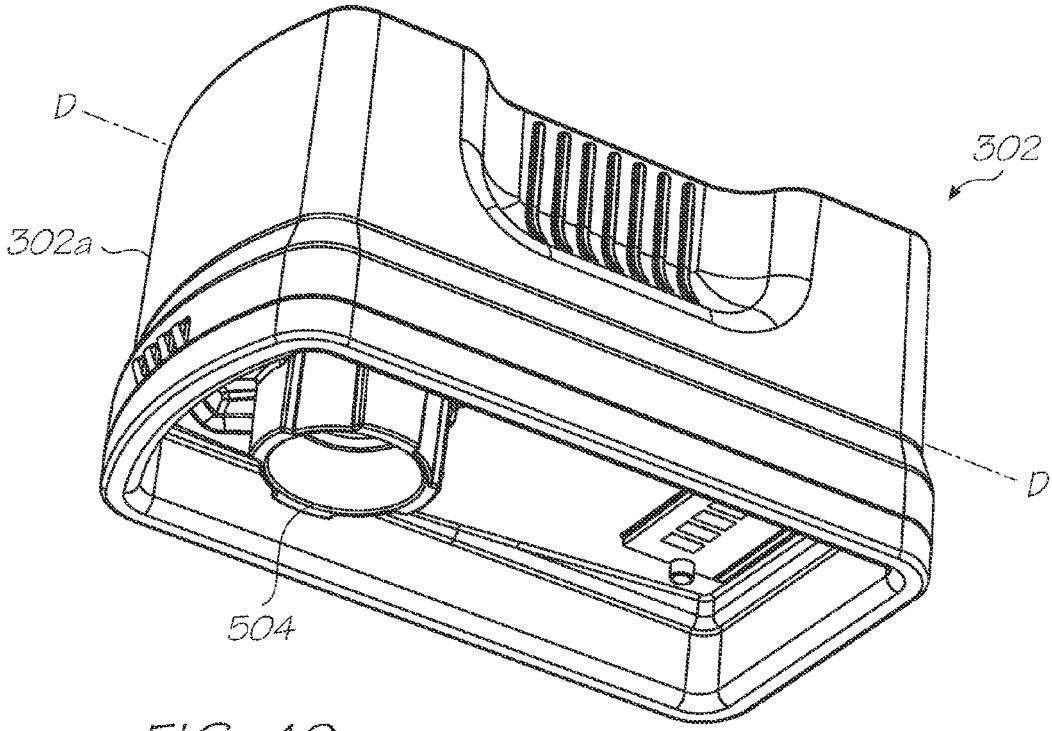
FIG. 49 illustrates the supply tank in a different view than that of FIG. 48.
Figure 50:
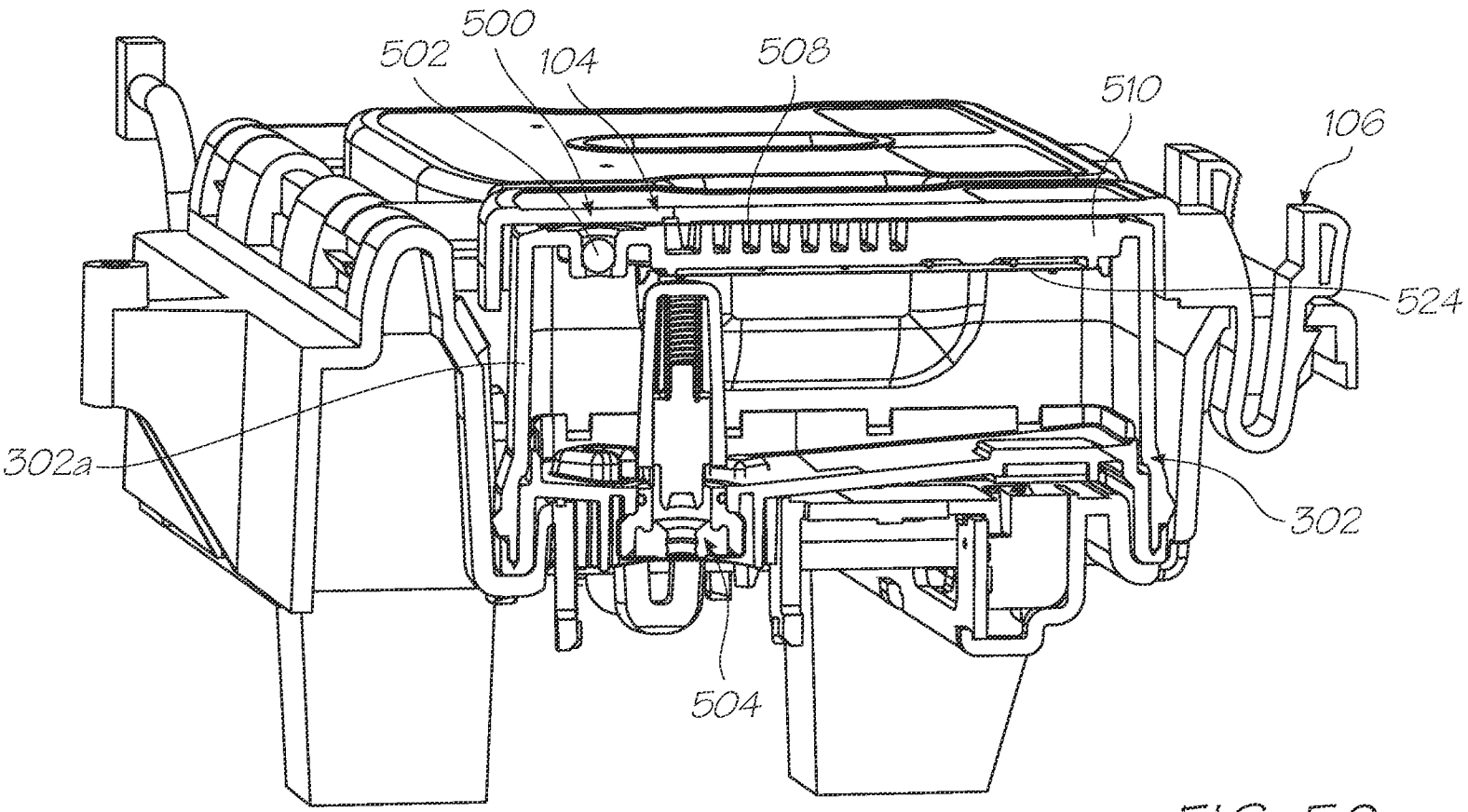
FIG. 50 illustrates a cross-sectional view of the supply tank taken along line D-D in FIG. 49 within a receiving bay of the printer.

In the exemplary supply tank 302 illustrated in FIGS. 48 to 51, refilling of the supply tank 302 is provided by connecting a refill port 500 through an upper surface of a body 302*a* of the supply tank 302 with a refilling station or the like. For example, the refill port 500 may comprise a ball valve 502, as illustrated in FIGS. 49 and 50, or other valve arrangement, which is actuated to open by the refilling station and refilling is carried out under gravity.

The lower surface of the supply tank body 302*a* incorporates an outlet coupling 504 as an outlet from the tank body 302*a*, which constitutes the aforementioned supply side of the coupling 306. When the supply tank 302 is installed in the printer 100, the outlet coupling 504 is coupled with the aforementioned delivery side of the coupling 306 so as to be in fluid communication with the fluid line 308. Ink from the supply tank 302 is drawn into the fluid line 308 under gravity. This is facilitated by an air chimney 506 in the supply tank body 302*a* which is open to atmosphere, thereby allowing air to enter the supply tank 302. The air chimney 506 is closed to atmosphere prior to installation of the supply tank 302 in the printer 100 in order to prevent leakage of ink from the tank and potential ink drying. Different exemplary arrangements of the air chimney 506 are illustrated in FIGS. 50 and 51.

In the example of FIG. 50, the air chimney 506 is located in the upper surface of the supply tank body 302*a* and vents to atmosphere from the interior fluid containing space of the supply tank body 302*a* via a tortuous liquid path 508 which allows air to enter the supply tank 302 whilst discouraging liquid ink to pass through the air chimney 506. The path 508 may be provided as an aperture through the upper surface of the supply tank body 302*a* having a serpentine channel between a gas vent in the interior wall of the body and a gas vent 512 in the external wall of the body.

The path 508, and therefore the air chimney 506, is closed to atmosphere by an air impervious film 510 covering the vent 512 of the air chimney 506. The film 510 may, for example, be adhesively attached to the upper surface of the supply tank, and is piercable by a pin 104 or like member incorporated in a cover 106 of a receiving bay 107 for the supply tank of the printer 100 to open the air chimney 506 to atmosphere upon installation of the supply tank in the printer 100. Upon refilling of the ink supply tank 302 of FIG. 50, a complete film 510 may be replaced over the vent 512 at the refill station.

Figure 51:
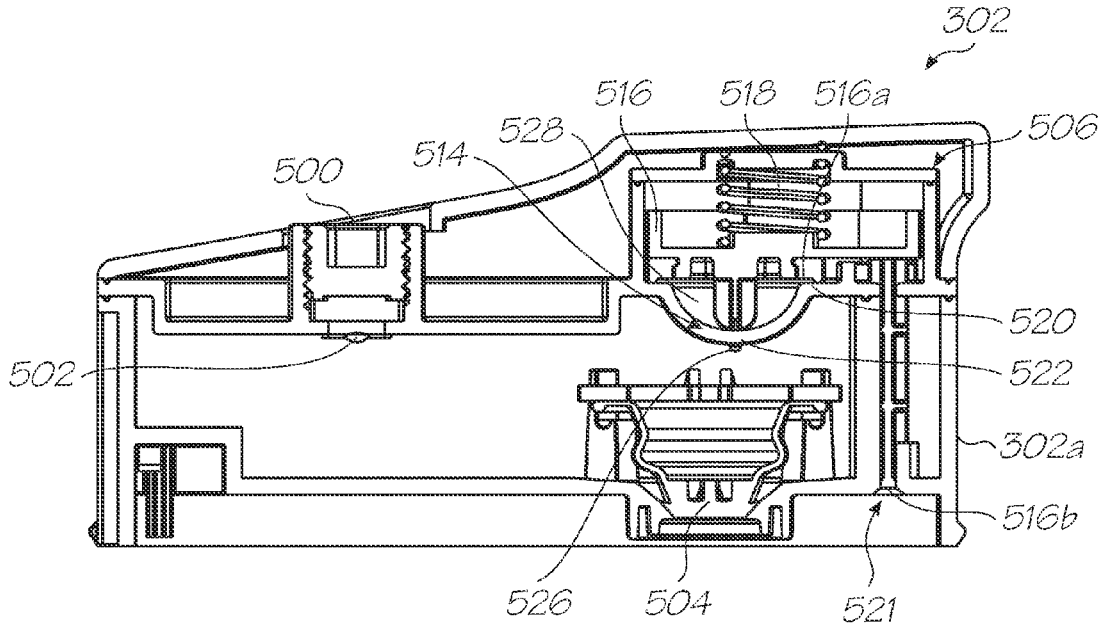
FIG. 51 illustrates an cross-sectional view of an alternative supply tank of the fluid distribution system.

In the example of FIG. 51, the air chimney 506 is defined by a mechanically actuated valve 514. The valve 514 has a movable body 516 which is biased by a spring 518 so that a seal portion 516*a* of the movable body 516 sealingly rests against a seat 520 to position the valve 514 in a normally closed position. An end portion 516*b* of the movable body 516 is exposed at a gas vent 521 on the body 302*a* through which the end portion 516*b* engages with an actuation feature (not shown) in the receiving bay of the printer 100 upon installation of the supply tank in the printer 100. This engagement causes the movable body 516 to be urged against the bias of the spring 518 which de-seats the seal portion 516*a* from the seat 520 thereby opening the valve 514 and opening the interior of the supply tank 302 to atmosphere via the gas vent 521 and an aperture 522 within the supply tank.

During refilling, determination of when the supply tank 302 has reached its full state can be provided in a number of ways. By "full state" it is meant that the supply tank contains liquid to a predetermined capacity. For example, a measured amount of ink or other printing fluid can be refilled into the supply tank consistent with the supply tank capacity. However, some ink may remain in the supply tank upon depletion, and the amount of this remaining ink is difficult to determine. Thus, refilling such measured amounts may result in some ink being egested from the supply tank during refilling, which is a waste of ink.

Alternatively, the full state can be sensed within the supply tank. This can be achieved by internalising a member within the supply tank which causes a change in fluid pressure at the refill port when the full state is reached. This pressure change can be sensed by a sensing arrangement SA (see FIG. 52) thereby providing a means to detect the full state. Alternative exemplary arrangements of such a fluid pressure changing member are illustrated in FIGS. 50 and 51.

In the arrangement of FIG. 50, a hydrophobic film 524 is positioned at an aperture of the path 508 within the interior of the supply tank 302. The hydrophobic material of the film 524 is selected so as to allow gas transit whilst preventing ink entering the path 508. A suitable hydrophobic material is expanded polytetrafluoroethylene.

The Applicant has found that the hydrophobic nature of the film 524 causes a change in the fluid pressure within the supply tank when the ink or other liquid being refilled into the supply tank 302 via the refill port 500 comes into contact with the underside of the film 524 as the ink fills the supply tank from its lower to upper surfaces. This pressure change is a pressure spike caused by a sudden increase in back pressure experienced at the refill port 500. This change in back pressure can be easily detected by a sensing arrangement in a manner well understood by those skilled in the art and used as a determination that the full state of the supply tank 302 has been reached.

In the alternative arrangement of FIG. 51, a protrusion 526 from the movable body 516 is located within the aperture 522 so as to provide a small restriction within a chamber 528 below the seat 520 and movable body 516. This small restriction, of the order of millimeters, results in a change in the fluid pressure within the supply tank when the ink or other liquid being refilled into the supply tank 302 via the refill port 500 comes into contact with the aperture 522 as the ink fills the supply tank from its lower to upper surfaces. This pressure change is a pressure spike caused by a sudden increase in back pressure experienced at the refill port 500. This change in back pressure can be easily detected in a manner well understood by those skilled in the art and used as a determination that the full state of the supply tank 302 has been reached. Movement of the protrusion 526 as the movable body 516 is moved assists in clearing the aperture 522 of any dried ink, thereby enhancing the reliability of the full state detection provided by the valve 514.

Figure 52:
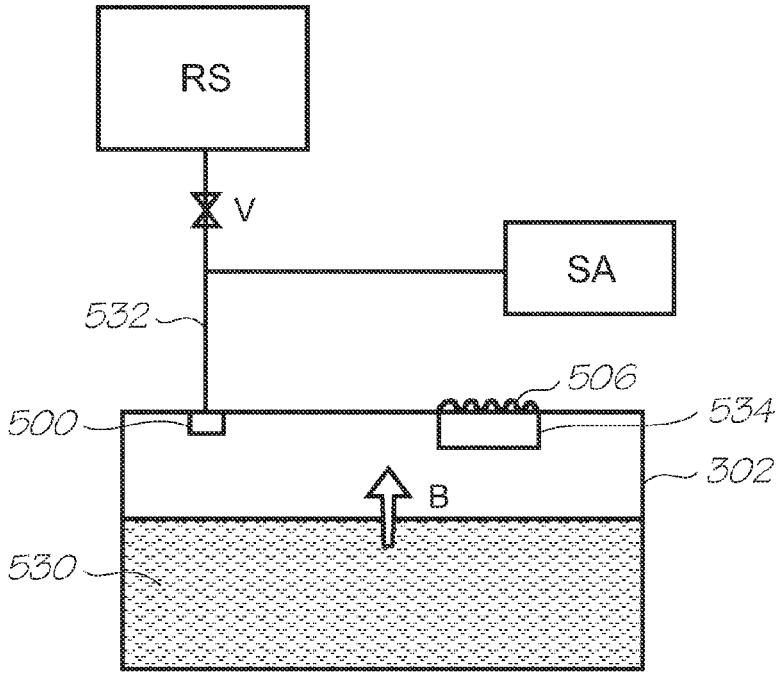
FIG. 52 illustrates a system diagram for sensing pressure changes during refilling of the supply tank.

An exemplary system for sensing the pressure changes provided by the above described embodiments is illustrated in FIG. 52. In this exemplary system, a refilling station RS as a liquid delivery apparatus is connected to the refill port 500 of the supply tank 302 to refill liquid 530 into the supply tank 302 such that the liquid 530 fills the supply tank 302 in the direction of arrow B. The sensing arrangement SA is connected to a fluid line 532 between the refilling station RS and the supply tank 302. The sensing arrangement SA is configured to monitor the fluid pressure within the fluid line. As discussed above, once the liquid 530 contacts pressure changing member 534 a change in fluid pressure occurs in the fluid line 532 which is detected by the sensing arrangement SA.

The amount of pressure change at which the full state has been actually reached can be measured experimentally and quantified as a predetermined pressure change. Accordingly, the fluid pressure can be monitored for this predetermined pressure change and supply of the refilling liquid can be ceased by closing a valve V or the like on the fluid line 532 when the predetermined pressure change is detected. This reduces false full state detection caused by unrelated pressure spikes due to normal or anomalous fluctuations in the fluid pressure during refilling.

The above-described embodiments of the supply tank 302 illustrate a supply tank for connection to a single fluid line 308 thereby supplying ink of a single color to the connected fluid line 308. Accordingly, to provide the five fluid channels of the illustrated embodiment of the printhead 200, five of the supply tanks 302 are provided. Alternatively, in applications where one or more of the ink channels provides the same ink color, e.g., CYMKK, it is possible to configure the respective supply tank 302 for the repeated ink color channels as a double or two-channel supply tank. Such an alternative configuration is illustrated in FIGS. 6 and 7.

The double supply tank 302 has the same configuration as the single supply tank 302 with respect to having a single refill port 500 and air chimney 506, and associated components, however either a single outlet coupling 504 can be provided for connection to a single fluid line 308 which connects to two of the accumulator tanks 304 or two outlet couplings 504 can be provided for connection to two fluid lines 308 which connects to two of the accumulator tanks 304.

As discussed above, the supply couplings 388 couple with the printhead 200 on both the print and pump line sides to connect the printhead 200 within the fluid distribution system 300. The supply couplings 388 are configured to couple with the inlet and outlet printhead couplings 224,226 of the printhead 200 as illustrated in FIGS. 53A-57E.

The supply coupling 388 has ports 536 which receive the inlet and outlet spouts 236,238 of the printhead 200. Five of the ports 536 are shown in the illustrated embodiment of the supply coupling 388 to provide for the aforementioned five ink channels. The ports 536 are connected to the either the print lines 380 or the pump lines 382 depending on the respective side of the printhead 200 and the respective ink colour being distributed.

In order to ensure reliable sealed connections between the various components, the supply couplings 388 and their ports 536 are assembled from the minimum number of parts possible. Accordingly, in the illustrated embodiment, each of the ports 536 have four assembled parts: a port plate 538, a seal member 540, a housing 542 and a retainer 544. In the coupling assembly, the port plate 538, seal member 540 and retainer 544 are mounted to the housing 542 in a non-fastened manner, as explained below, which again reduces the number of assembled parts.

The seal member 540 is formed as a ring which is received in a recess 546 of the housing 542, and the port plate 538 is mounted thereover so that sealed printhead ports 536*a* are formed for receiving the spouts 236,238 of the printhead 200.

The housing recess has apertures 546 which project into the housing to form apertured pins 546*a*. The retainer 544 is received within the housing by holes 548 in the retainer 544 being received over the pins 546*a* so that sealed distribution ports 536*b* are formed for receiving the tubing of the fluid lines of the closed loop 348 (i.e., the print and pump lines 380,382). The circumferential edge of the retainer 544 is formed as a rim 550 having cylindrical details 552. The retainer 544 is formed from resiliently flexible material, such as being molded from rubber, so that the rim 550 is resiliently received within a groove or slot 554 in an interior wall 542*a* of the housing 542 and the details 552 engage with slots 556 formed across the circular slot 554. This arrangement allows the retainer to be mounted to the housing in a self-fastening manner, however screws or the like could alternatively be used for this purpose.

The resiliency of the retainer 544 serves not only to provide mounting of the retainer 544 in the housing 542 but also to frictionally and sealingly hold the tubing of the fluid lines of the closed loop 348 in engagement over the apertured pins 546*a*. The level of resilient hold provided by the retainer 544 is selected to resist fluid leakage, tube pressure blow-off and accidental pulling-off of the tubing. Other configurations are possible to assist in retaining the tubing such as clipping and crimping arrangements.

The seal ring 540 has a seal portion 540*a* for each fluid channel joined together by linking portions 540*b*. This simplifies assembly and manufacture of the seal ring as the seal and linking portions can be integrally molded from a resilient, compressible material which is inert to ink, such as rubber, and also ensures that the seal portions of each seal ring are from the same manufactured batch such that the relative sizes and thickness are uniform across the seals. As illustrated, the seal portions 540*a* are circular and the linking portions 540*b* define arcs between the respective seal portions 540*a* about the seal ring 540.

Figure 55:
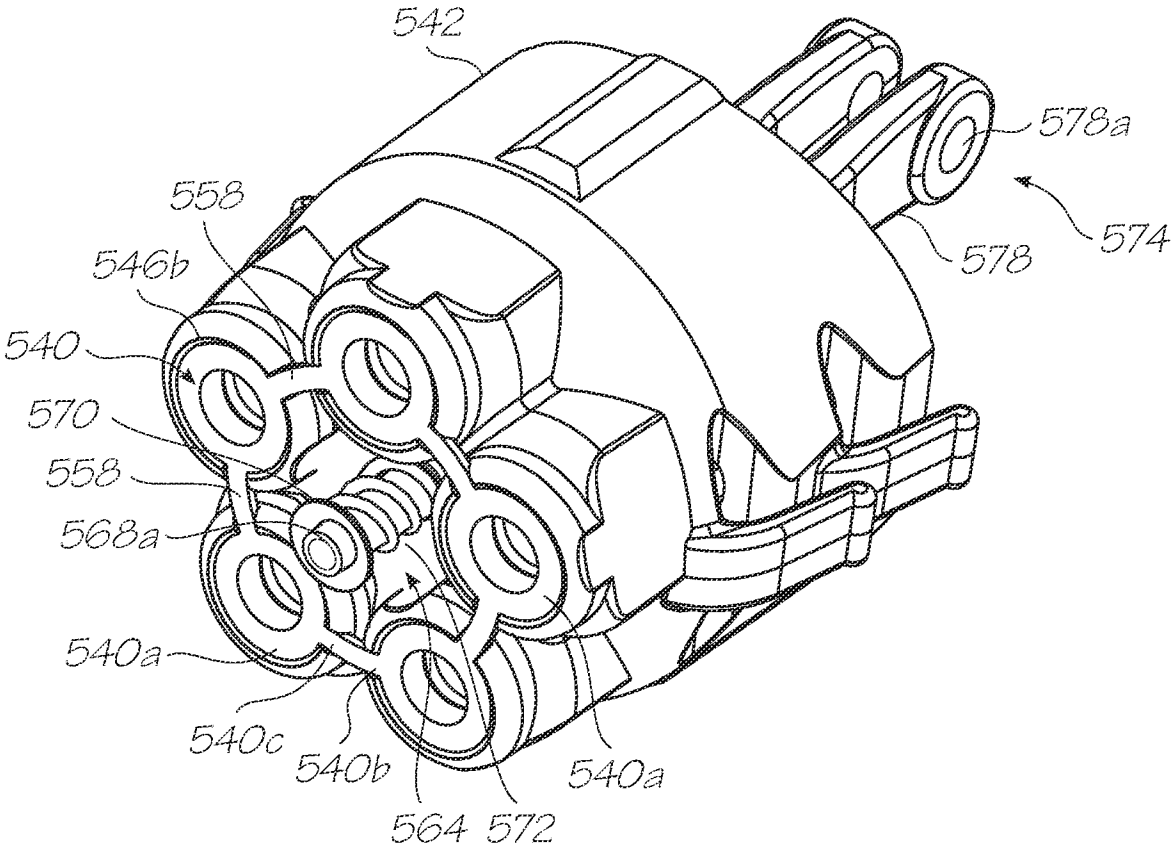
FIG. 55 illustrates the supply coupling with a port plate omitted.

The apertures 546 of the housing 542 are provided with circular recesses 546*b* into which the circular seal portions 540*a* are received and with curved recesses 546*c* between the circular recesses 546*a* into which the curved linking portions 540*b* are received. This arrangement is illustrated in FIG. 55 and assists in providing a seal at the printhead side of the coupling 388. As shown, slots 558 are further provided across the curved recesses 546*c* which serve to capture and wick away any fluid which may leak from the apertures 546, thereby reducing the possibility of cross-contamination of fluids between the individual fluid channels.

Figure 53A:
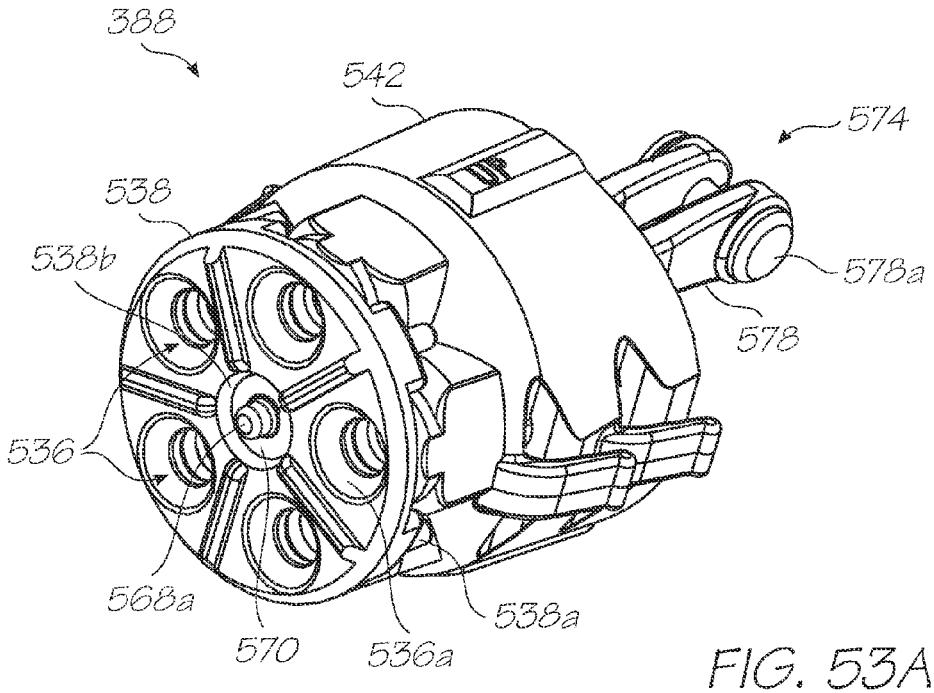
FIGS. 53A and 53B illustrate different views of a fluid supply coupling of the fluid distribution system.
Figure 53B:
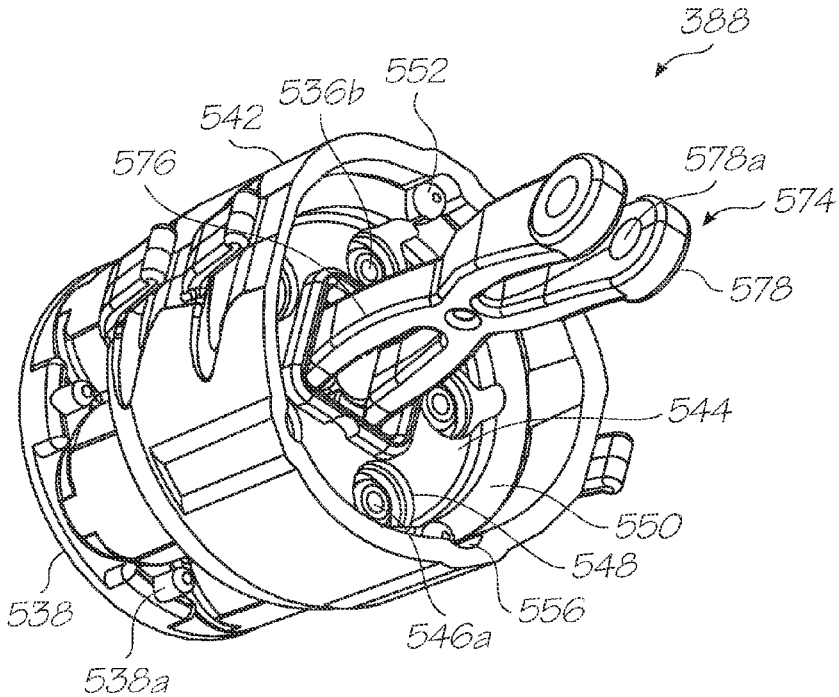
Figure 54A:
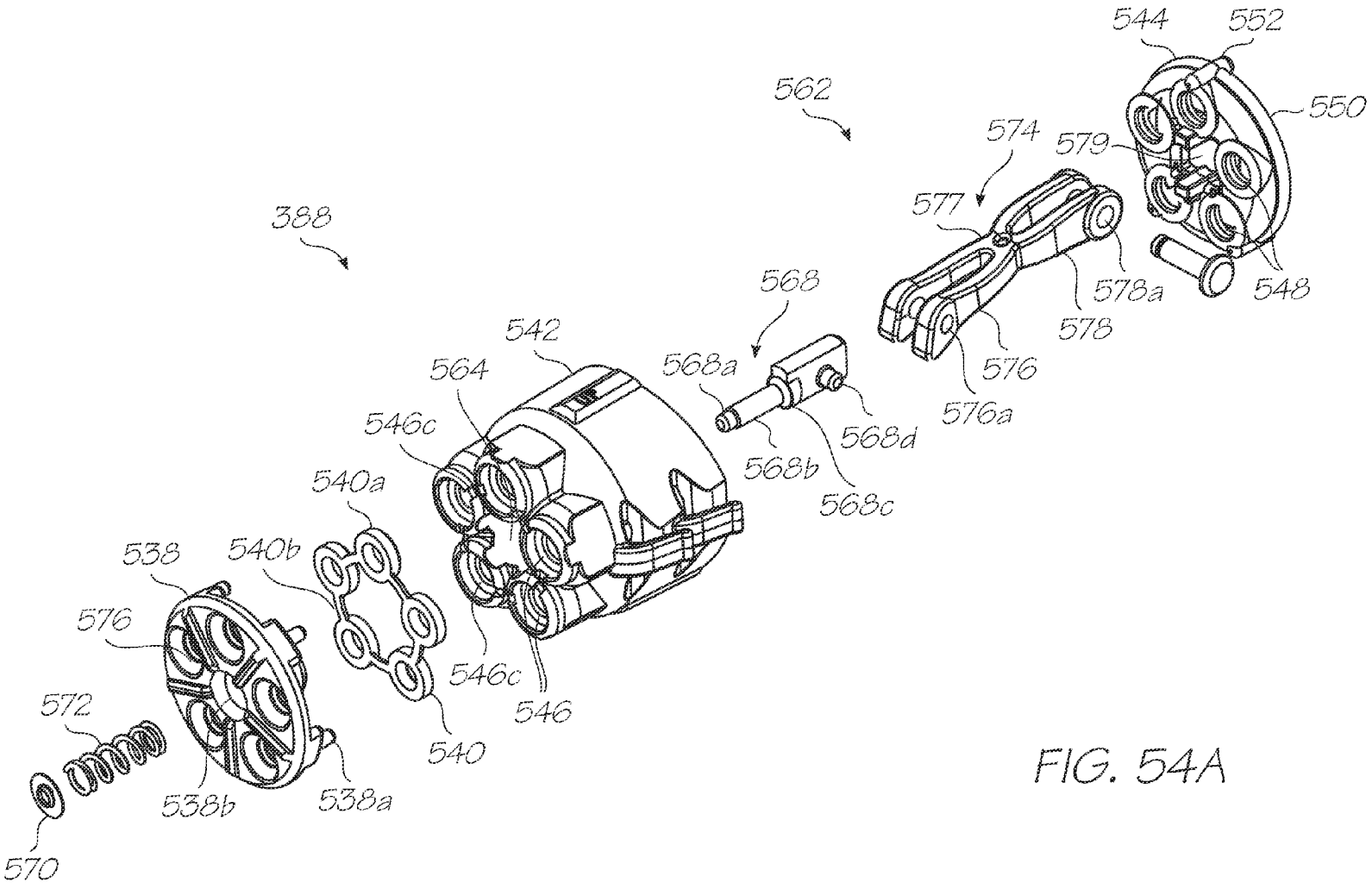
FIGS. 54A and 54B illustrate exploded views of the different views of FIGS. 53A and 53B.
Figure 54B:
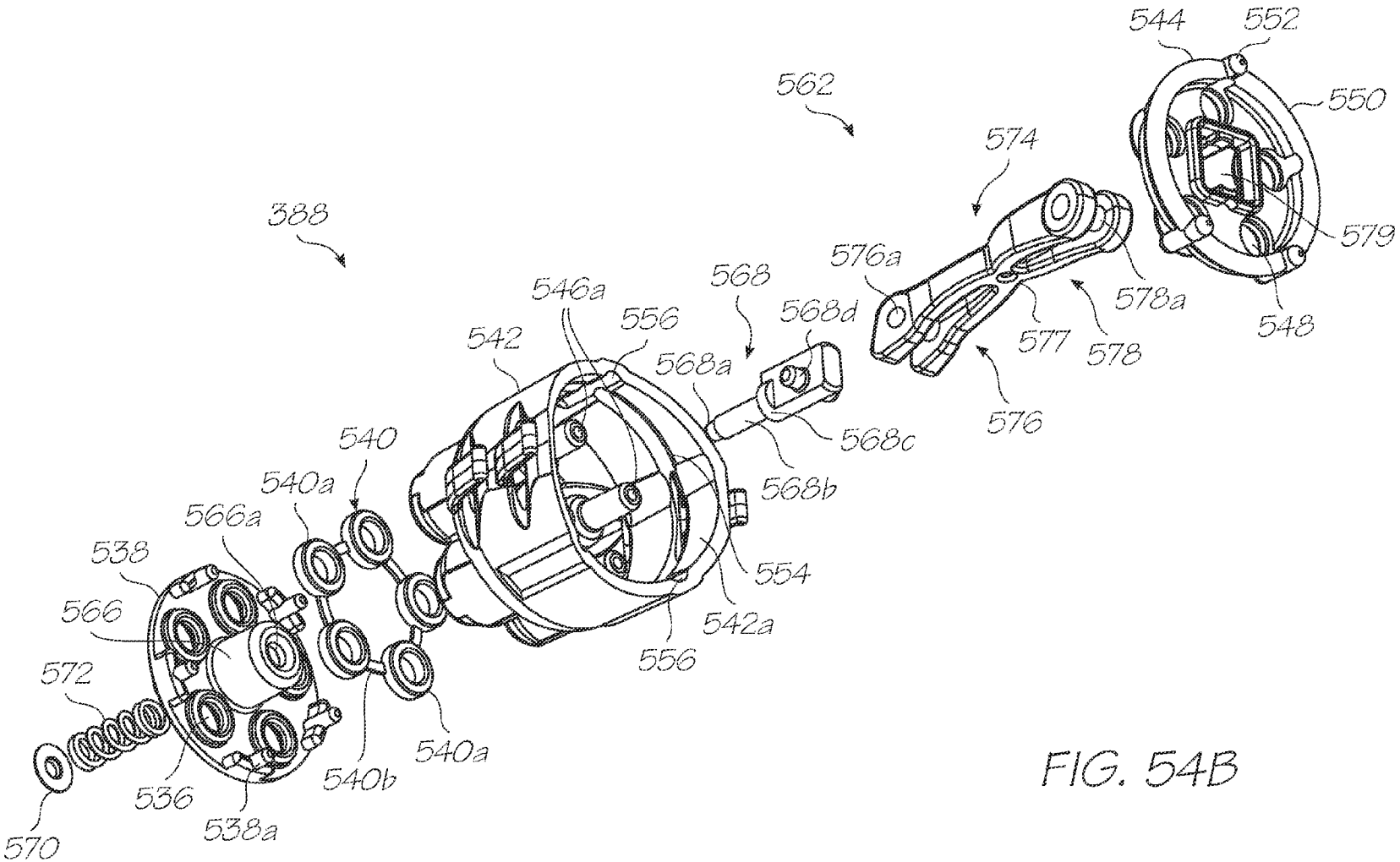

The port plate 538 has holes 560 through which the spouts 236,238 of the printhead 200 pass. Alignment of the holes 560 and the apertures 546 is facilitated by bosses 538*a* on the port plate 538 being received in between the adjacent peripheries of the apertures 546, as illustrated in FIG. 53B.

The holes 560 are provided with circumferential rims 560*a* which are configured to compress the seal portions 540*a* of the seal ring 540 when pressed thereagainst, which provides a complete seal against the outer surfaces of the spouts 236, 238. Accordingly, the coupling 388 is required to press against the inlet and outlet manifolds 230,232 of the inlet and outlet couplings 224,226 of the printhead 200 to provide this pressing action.

For example, this releasable pressing engagement could be achieved by clipping the couplings together in a manner well understood by one of ordinary skill in the art. Alternatively, in the illustrated embodiment, a coupling drive mechanism 562 is used to provide the necessary releasable pressing engagement, as described below.

In the illustrated embodiment, the apertures 546 are radially arranged about a central hole 564 in the housing 542 so as to coincide with the radially arranged spouts 236,238 of the printhead 200. The central hole 564 receives an apertured projection 566 in the port plate 538 about which the holes 560 are similarly radially arranged. A shaft 568 is received within an aperture 566*a* of the projection 566 so that a distal end 568*a* of the shaft 568 projects from the aperture 566*a* on the printhead side of the port plate 538. On this printhead side, a circular recess 538*b* is formed in the port plate 538 about the aperture 566*a* for receiving a washer or ring 570 which is pressed fitted onto the distal end 568*a* of the shaft 568.

The distal end 568*a* is a reduced section of a cylindrical portion 568*b* of the shaft 568 which is configured to receive the ring 570. The ring 570 is formed as a groove-less metal ring, which strengthens and simplifies the press-on mounting on the shaft 568. In this regard, the shaft 568 is preferably formed from die-cast metal so that the shaft withstands the notch load from the groove-less ring. Alternative arrangements to the press-on ring for mounting the shaft can be used, such as screws or other fasteners.

A compression spring 572 is positioned on the cylindrical portion 568*b* of the shaft 568 and is compressed between the ring 570 and the projection 566 of the port plate 538. The projection 566 is contacted by a hub 568*c* of the shaft 568 under this compression so as to retain the port plate 538 on the housing 542 in a non-fastened manner. Pins 568*d* projecting from two, opposite sides of the hub 568*c* mount an arm 574 to the shaft 568. The arm 574 has two pairs of beams 576 and 578 interconnected by a bridge portion 577. The pair of beams 576 have holes 576*a* at their distal ends relative to the bridge 577 which are configured to snap fit onto the pins 568*d* of the shaft 568. This arrangement eliminates the need for E-clips or other fastening means, which reduces potential de-linkage of the arm 574 from the shaft 568. The arm 574 projects through a hole 579 in the retainer 544.

The arm 574 is used as a 'conrod' between the port plate 538 and the coupling drive mechanism 562 so that the supply coupling 388 is effectively driven as a piston into sealed engagement with the printhead 200. This is achieved in the manner illustrated in FIGS. 57A-57E, as described below.

Figure 56A:
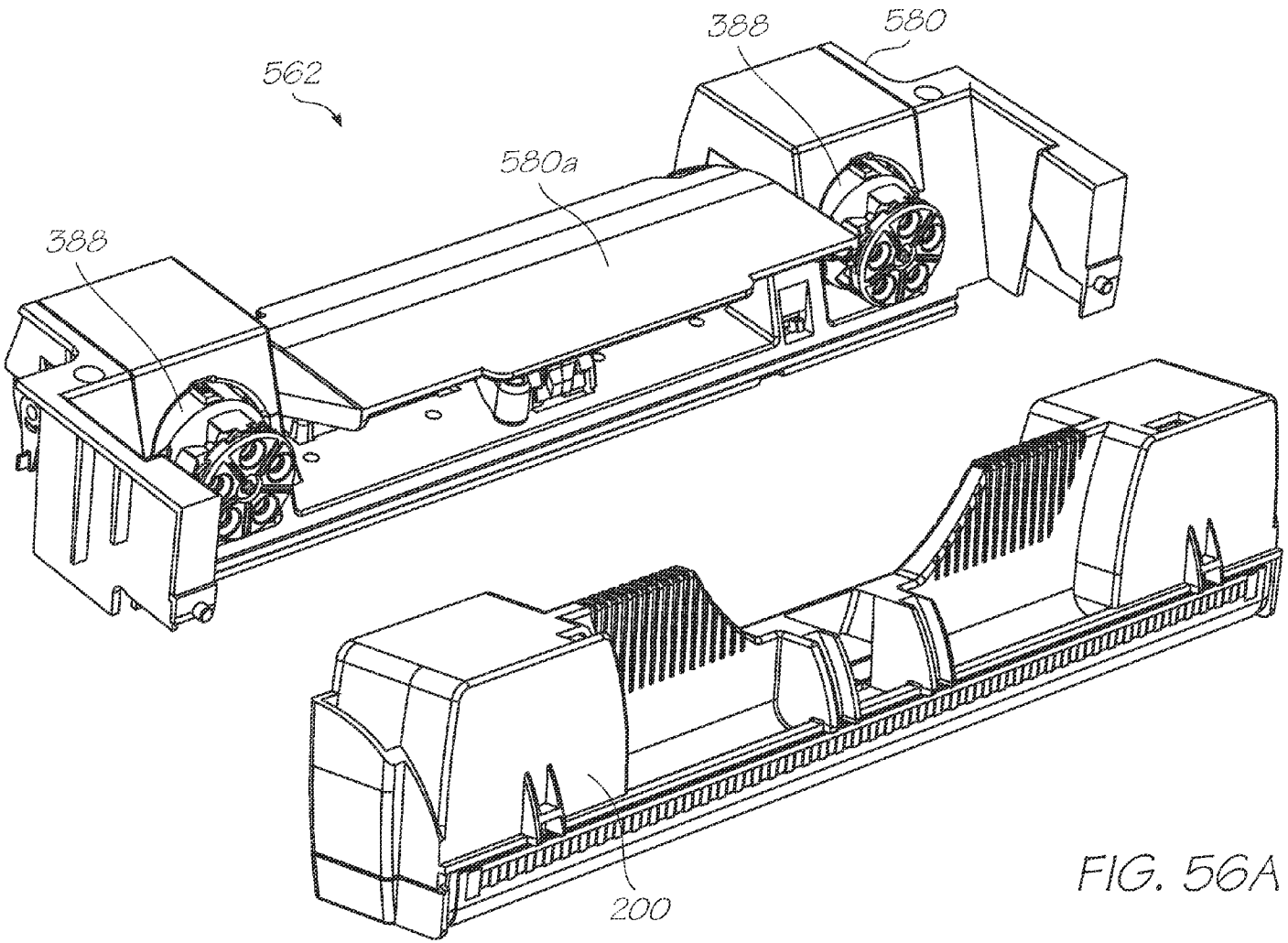
FIGS. 56A and 56B illustrate different views of a coupling drive mechanism of the supply couplings.
Figure 56B:
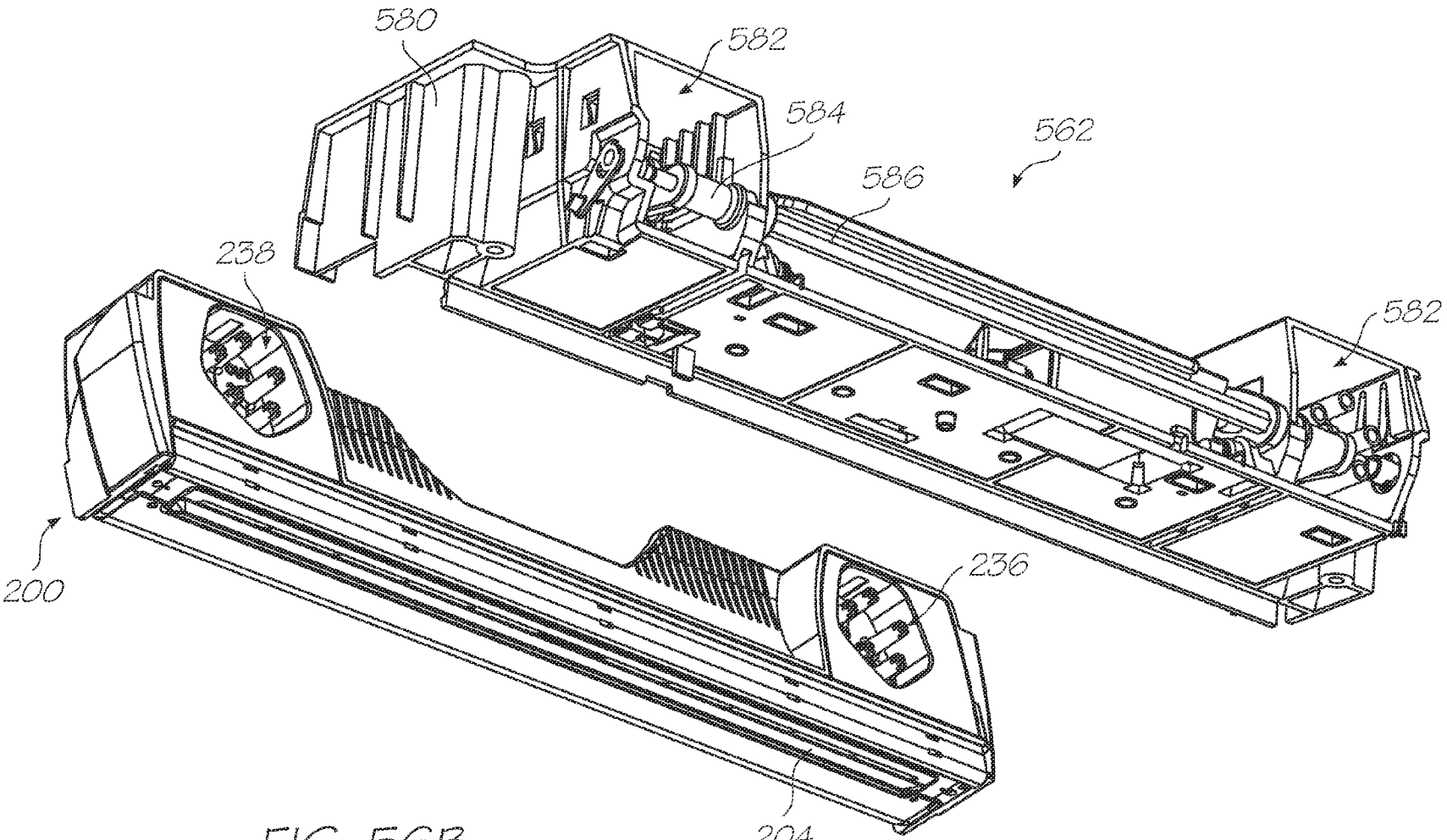

As illustrated in FIGS. 56A and 56B, the coupling drive mechanism 562 has a housing 580 in which the supply couplings 388 are housed. The housing 580 has generally cylindrical sockets 582 into which the generally cylindrical supply couplings 388 are positioned so that the port plates 538 are exposed for engagement with the respective couplings 224, 226 of the printhead 200 and so that the second pair of beams 578 of the arm 574 project into the housing 580. In FIGS. 57A-57E, one of the sockets is illustrated with the respective supply coupling received therein, however it is understood that the coupling drive mechanism is used to simultaneously drive the supply couplings into engagement with the corresponding printhead couplings.

The beams 578 of the arm 574 engage with a cam arm 584 provided on a rod 586 which is rotationally mounted within the socket 582. The beams 578 have holes 578*a* at their distal ends relative to the bridge 577 which snap fit onto pins 584*a* of the cam arm 584. in this way, the arm 574 is pivotally connected to both the cam arm 584 and the shaft 568 via the respective pin and hole arrangements.

The rod 586 is rotationally driven by a cam mechanism 587 upon rotation of a lever 580*a* rotationally mounted to the housing 580 so as to rotate the cam arm 584 and thereby move the supply coupling 388 within the socket 582 from a fully retracted position relative to the printhead 200 to an engagement position at which the ports 536 supply coupling 388 engage and seal with the spouts 236,238 of the printhead 200.

Figure 57A:
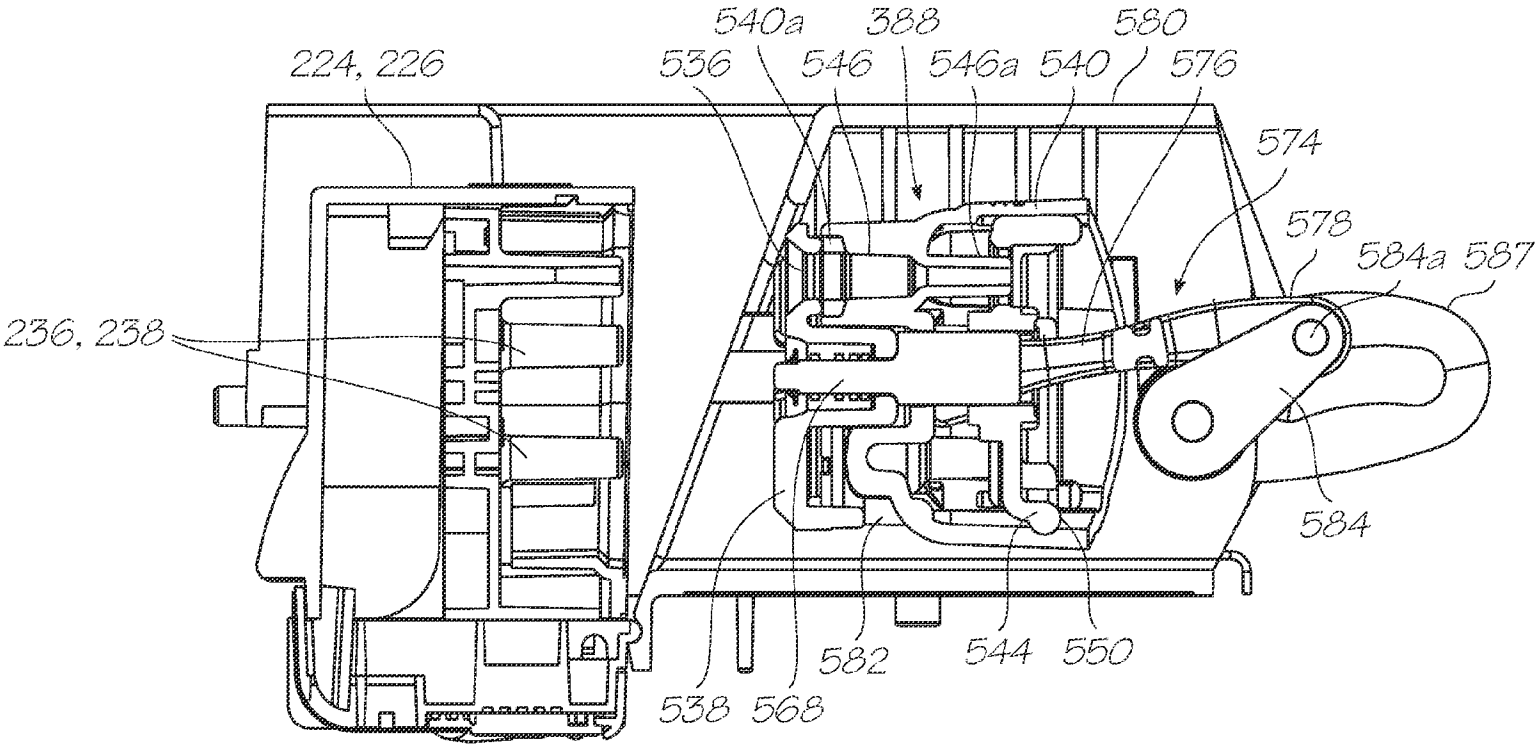
FIGS. 57A-57E illustrate, in cross-section, different coupling operational steps of the supply coupling.
Figure 57B:
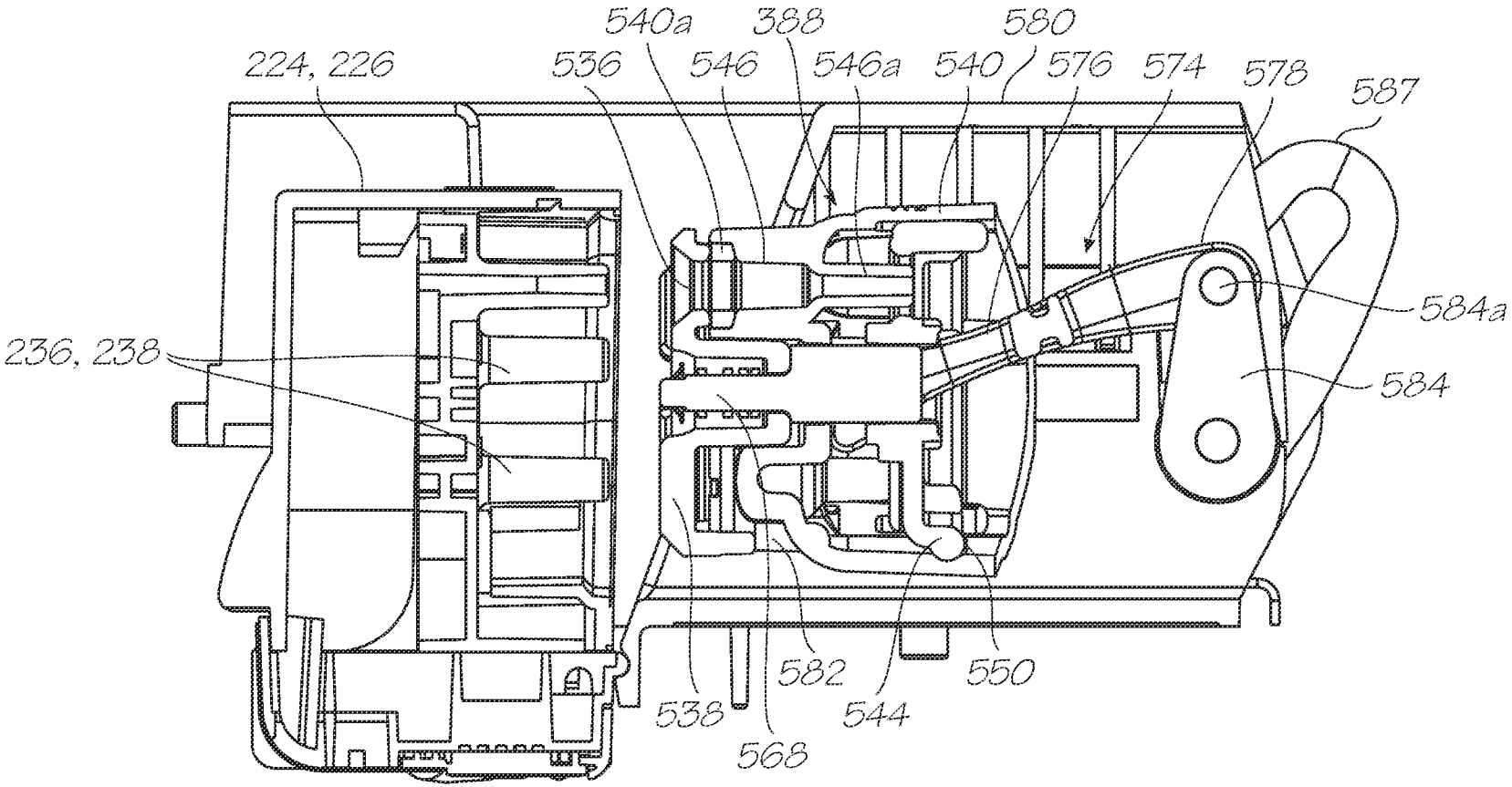
Figure 57C:
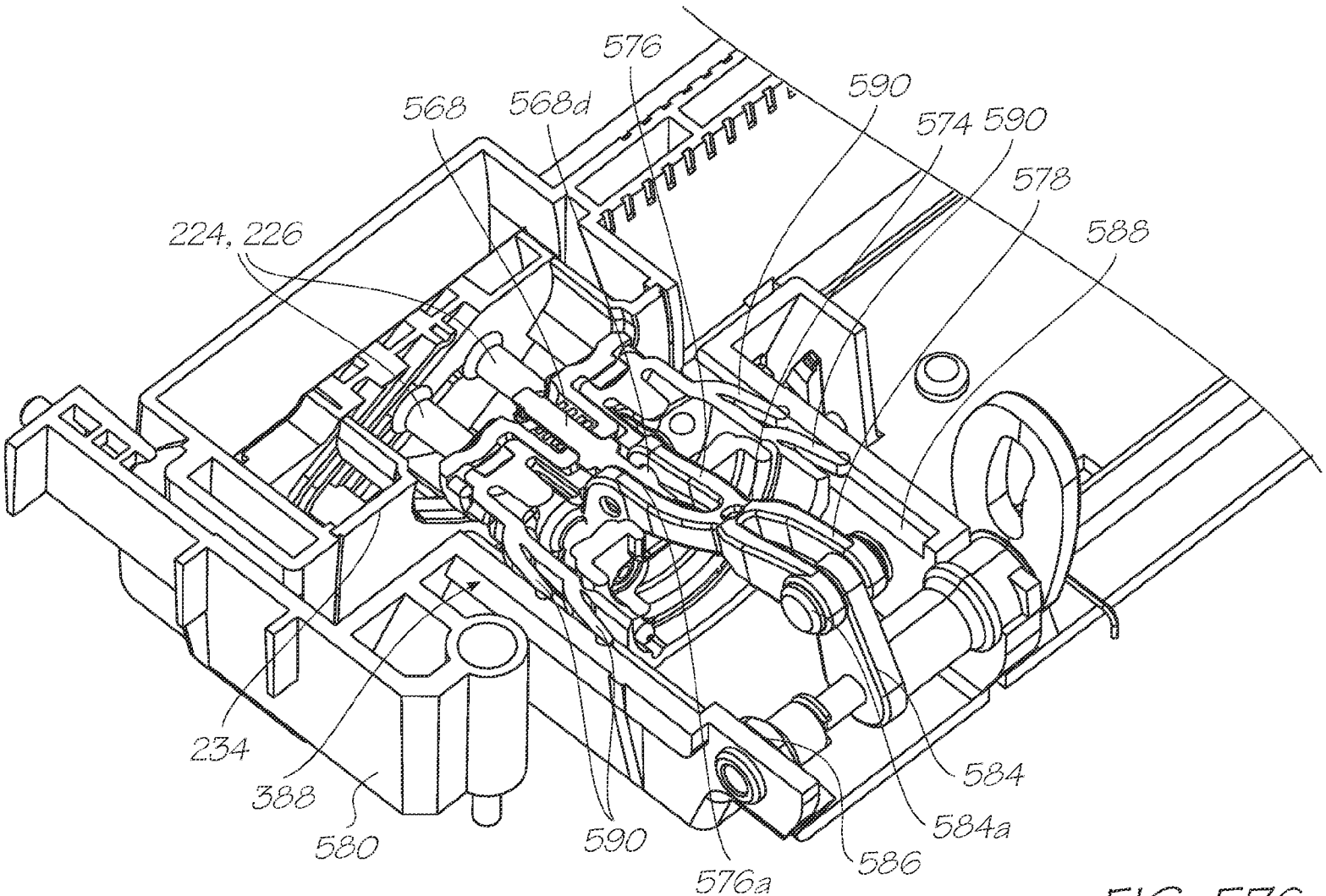
Figure 57D:
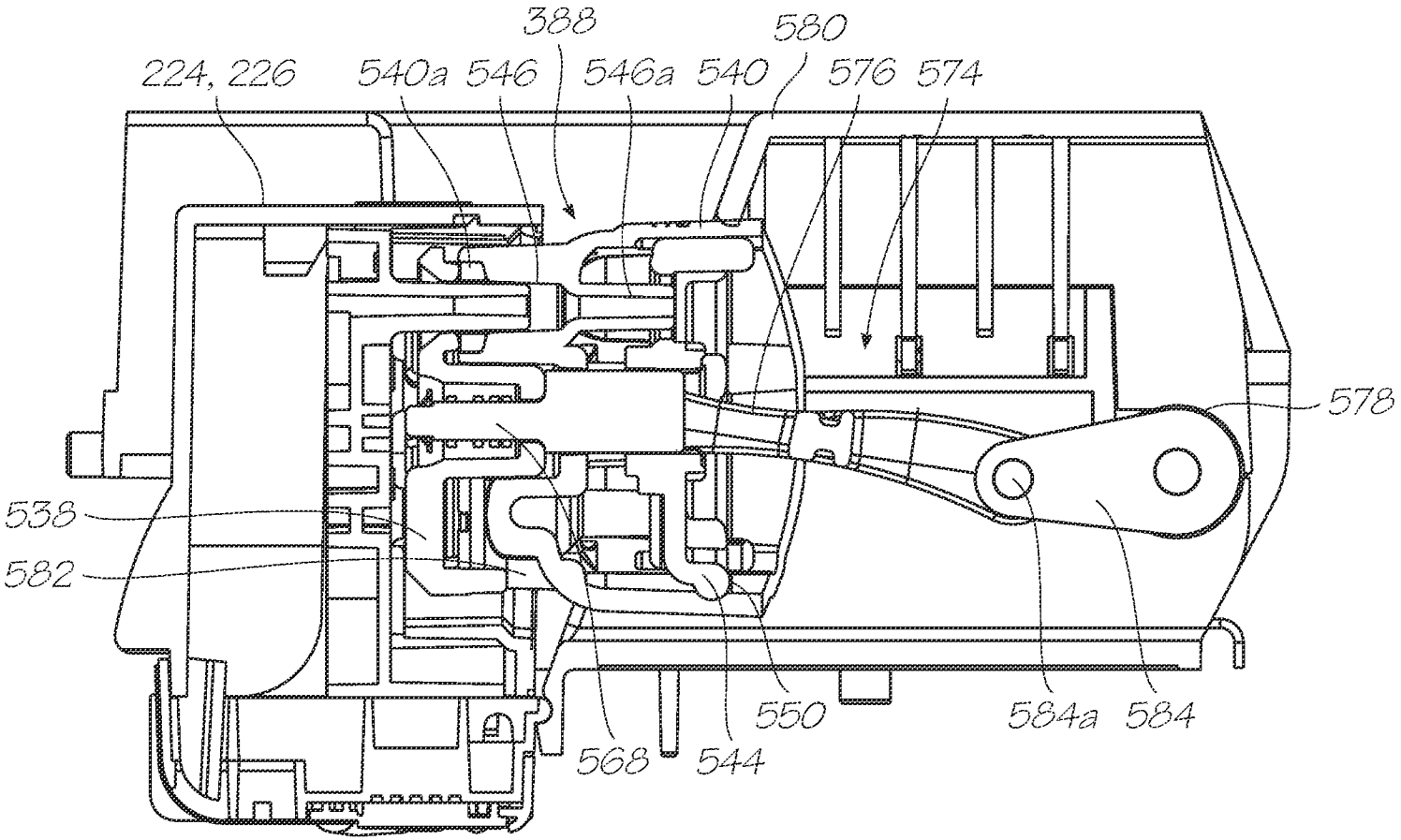
Figure 57E:
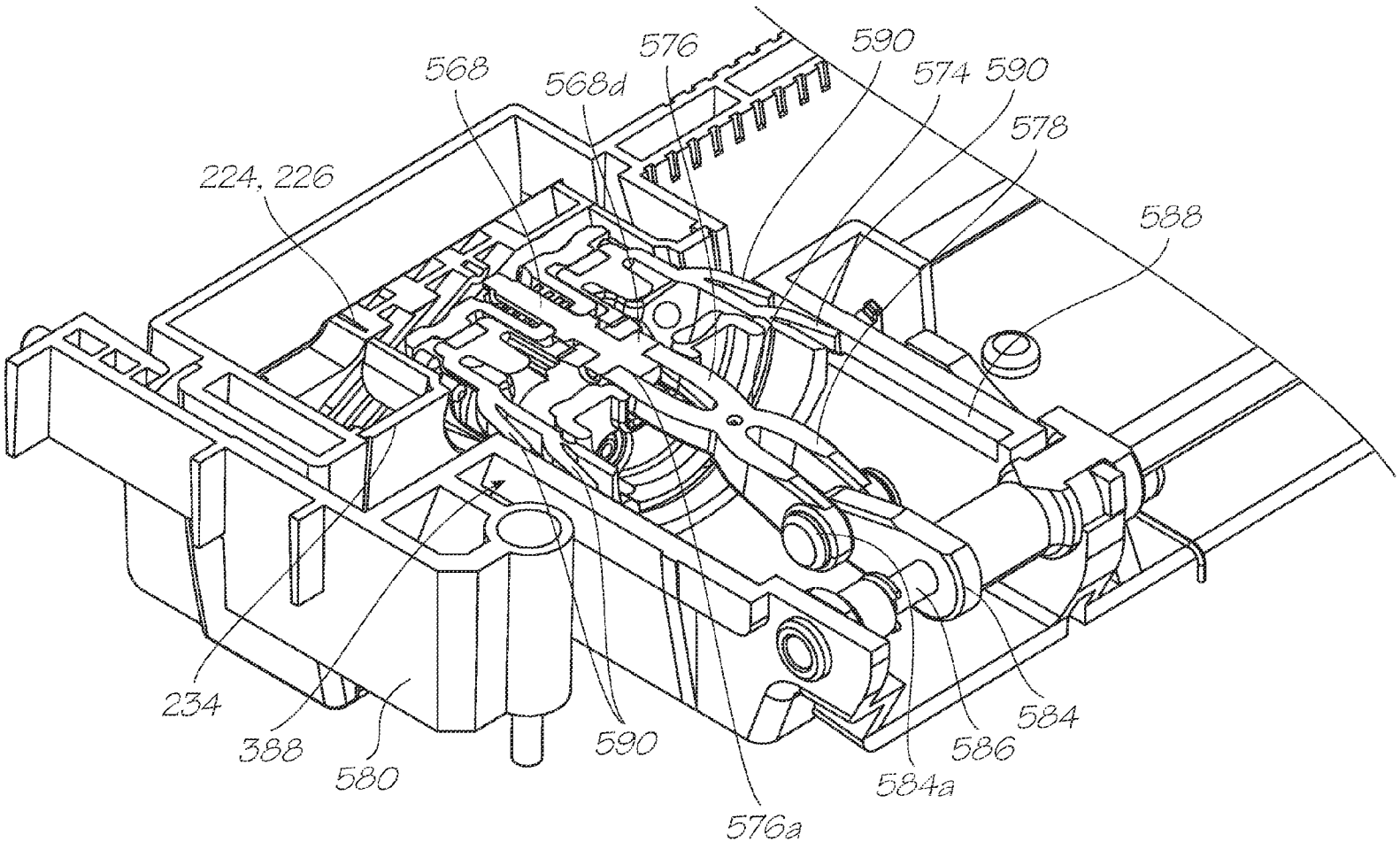

FIG. 57A illustrates a cross-sectional view of the supply coupling 388 at the fully retracted position. FIGS. 57B and 57C illustrates a cross-sectional view of the supply coupling 388 at a partly retracted position. FIGS. 57D and 57E illustrate alternative cross-sectional views of the supply coupling 388 at the engagement position. The hole 579 of the retainer 544 is configured so that full, unobstructed motion of the arm 574 and the cam arm 584 throughout these operative positions is provided.

At the engagement position, the circumferential rims 560*a* of the holes 560 in the port plate 538 compress the seal portions 540*a* of the seal ring 540 against the outer surfaces of the spouts 236,238, as described earlier. The pre-compression of the spring 572 between the ring 570 and the hub 568*c* of the shaft 568 causes the arm 574 to move along a constrained path with the cam arm 584 rotating through a fixed angle. This constrained movement means that the supply coupling is driven into the engagement position by the coupling drive mechanism without over-stressing the cam features, including the arm beams, cam arm, cam rod or cam mechanism which are typically molded and/or assembled from plastics materials, such as a crystalline thermoplastic, like 25% glass fibre reinforced Acetal copolymer (POM), which could otherwise cause failure of sealed engagement between the couplings of the fluid distribution system 300 and the printhead 200.

Figure 58:
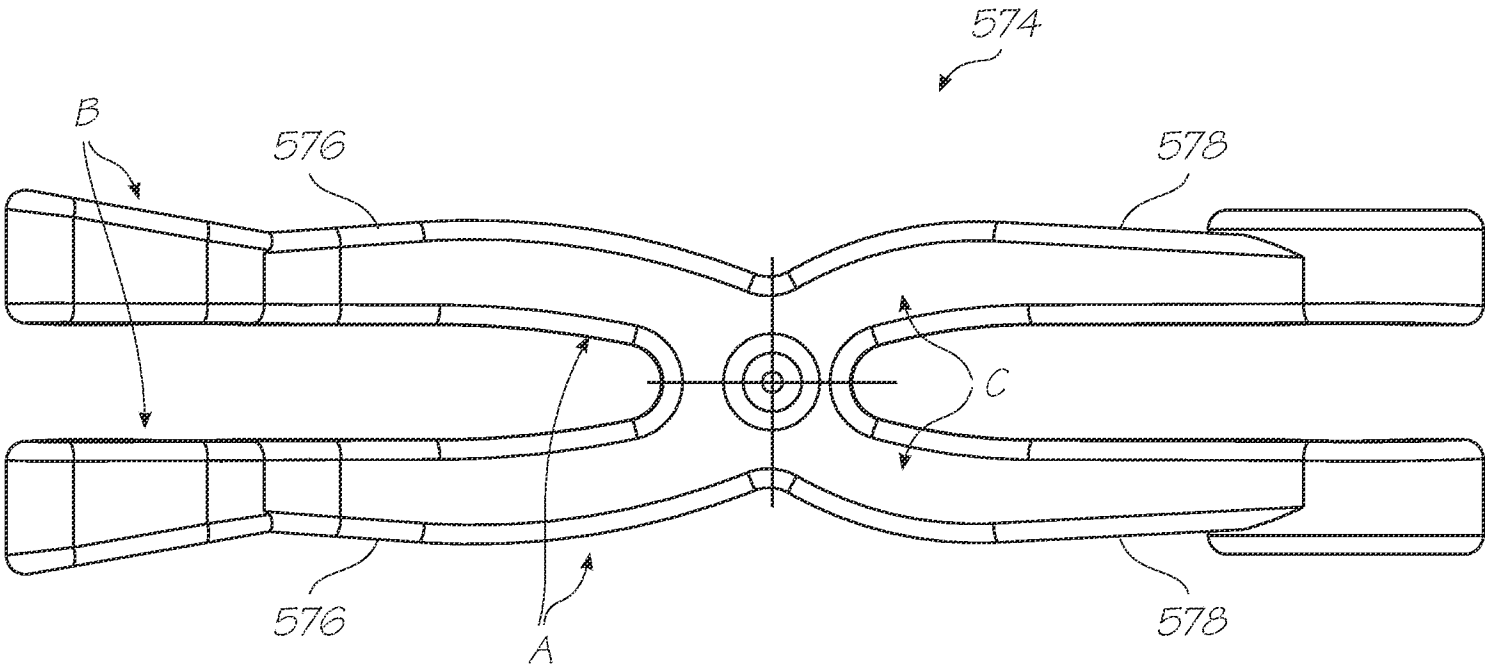
FIG. 58 illustrates, in isolation, an arm of the supply coupling.

Additional protection against over-stressing of the arm 574 is provided by tapering the beams 576 in the vicinity of the bridge 577, i.e., at point A illustrated in FIG. 58, which provides more uniform stress through the beams 576, by forming the distal ends of the beams 576 relative to the bridge 577, i.e., at point B illustrated in FIG. 58, with walls thicker than the rest of the beams 576 to strengthen weld lines and provide a relatively large surface area for mating with the shaft 568, and by forming the interconnection of the bridge 577 and the beams 578, i.e., at point C illustrated in FIG. 58, with relatively large bends to eliminate stress risers, provide uniform walls and better mold flow during molding of the arm 574.

Alternative configurations of the arm to those described and illustrated are possible, as too are alternative coupling drive mechanisms, so long as constrained movement of the supply couplings into and out of engagement with the coupling of the printhead is provided.

As illustrated in FIGS. 57C and 57E, slots 588 within the socket 582 receive wings 590 on two, opposite sides of the supply coupling 388. This slotted engagement provides proper alignment between the ports 536 of the supply couplings 388 and the spouts 236,238 of the couplings 224,226 of the printhead 200. The wings 590 are formed as cantilevered leaf springs which flex within the slots 588 to provide stability in this alignment throughout movement of the supply coupling 388. In the illustrated embodiment, two wings are provided on two sides of the supply coupling, however fewer or more wings can be provided on fewer or more sides of each coupling so long as stable movement of the couplings is achieved.

While the present invention has been illustrated and described with reference to exemplary embodiments thereof, various modifications will be apparent to and might readily be made by those skilled in the art without departing from the scope and spirit of the present invention. Accordingly, it is not intended that the scope of the claims appended hereto be limited to the description as set forth herein, but, rather, that the claims be broadly construed.

What is claimed is:

1. A coupling assembly for distributing fluid to a printhead, the coupling assembly comprising:

a housing having a recess defined by a plurality of circular recesses and curved recesses between the circular recesses;

a seal member comprising a plurality of circular seals linked together via linking portions defining an arc between each circular seal, the plurality of seals and linking portions being received in the plurality of circular recesses and curved recesses of the housing;

a port plate movably mounted on the housing by a washer which is press-on mounted to a shaft through the port plate and housing; and a tube retainer mounted within a groove of the housing for retaining fluid distribution tubes, the retainer having a plurality of holes aligned with respective ones of a plurality of ports in the port plate and the plurality of seals for fluidically connecting the retained fluid distribution tubes with respective fluid spouts of the printhead, wherein slots are defined across the curved recesses for capturing and wicking away any fluid present in the recess.

2. A coupling assembly according to claim 1, wherein the port plate has rims about the ports for compressing the respective seals of the seal member when pressed thereagainst.

3. A coupling assembly according to claim 1, wherein the washer is a groove-less ring press-on mounted on a reduced section of a cylindrical portion of the shaft.

4. A coupling assembly according to claim 1, wherein the retainer is formed from resiliently flexible material.

* * * * *